US009208643B2

(12) United States Patent
Okada

(10) Patent No.: US 9,208,643 B2
(45) Date of Patent: Dec. 8, 2015

(54) GAME-INFORMATION-INTEGRATING SYSTEM

(75) Inventor: Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 114 days.

(21) Appl. No.: 13/980,637

(22) PCT Filed: Jan. 13, 2012

(86) PCT No.: PCT/JP2012/050558

§ 371 (c)(1),
(2), (4) Date: Jul. 19, 2013

(87) PCT Pub. No.: WO2012/102095

PCT Pub. Date: Aug. 2, 2012

(65) Prior Publication Data

US 2013/0310177 A1 Nov. 21, 2013

(30) Foreign Application Priority Data

Jan. 25, 2011 (JP) ..... 2011-013271

(51) Int. Cl.
*G07F 17/32* (2006.01)

(52) U.S. Cl.
CPC ..... *G07F 17/3225* (2013.01); *G07F 17/3234* (2013.01)

(58) Field of Classification Search
None
See application file for complete search history.

(56) References Cited

U.S. PATENT DOCUMENTS

| | | | | |
|---|---|---|---|---|
| 2003/0109308 | A1* | 6/2003 | Rowe | 463/42 |
| 2004/0204244 | A1* | 10/2004 | Rathsack et al. | 463/42 |
| 2009/0055204 | A1* | 2/2009 | Pennington et al. | 705/1 |
| 2010/0016070 | A1* | 1/2010 | Walker et al. | 463/25 |
| 2010/0124980 | A1* | 5/2010 | Acres | 463/20 |
| 2010/0228526 | A1* | 9/2010 | Moore et al. | 703/1 |
| 2011/0294575 | A1* | 12/2011 | Morrow et al. | 463/30 |

FOREIGN PATENT DOCUMENTS

| | | |
|---|---|---|
| JP | 11-207001 | 8/1999 |
| JP | 2003-251048 | 9/2003 |
| JP | 2006-191983 | 7/2006 |
| JP | 2006-212286 | 8/2006 |
| JP | 2007-125094 | 5/2007 |
| WO | 2011/062008 | 5/2011 |

OTHER PUBLICATIONS

International Search Report of PCT/JP2012/050558 (Feb. 21, 2012).

* cited by examiner

*Primary Examiner* — Jason Yen
(74) *Attorney, Agent, or Firm* — Lex IP Meister, PLLC

(57) ABSTRACT

A game playing information integration system which outputs the operation state of game units installed in a gaming facility, the proportions of visitors by type, and the trends of the greatest common preferences of visitors seen from the proportion and other information so that such information can be grasped in real time, and provides useful information for appropriately managing the operation and management of the gaming facility while achieving greater harmony of players and the gaming facility (shop) is provided.

8 Claims, 38 Drawing Sheets

FIG. 7

| Type of reception data | Contents of reception data | Reception time | Player identification information | Gaming machine unit identification information | Flag indicating play of game in progress | Playing time |
|---|---|---|---|---|---|---|
| Game initiation | (100000) | 2009/11/12 10:25:00 | P01 | M01 | ○ | — |
| Game initiation | (50000) | 2009/11/12 10:25:05 | P02 | M05 | ○ | — |
| ⋮ | ⋮ | ⋮ | ⋮ | ⋮ | ⋮ | ⋮ |
| Number-of-consumptions data | −30 | 2009/11/12 10:25:30 | P01 | M01 | — | — |
| Number-of-consumptions data | −30 | 2009/11/12 10:25:35 | P02 | M05 | — | — |
| Number of payouts | 100 | 2009/11/12 10:25:38 | P01 | M01 | — | — |
| Number of payouts | 1500 | 2009/11/12 10:25:43 | P02 | M05 | — | — |
| Number-of-consumptions data | −30 | 2009/11/12 10:25:44 | P01 | M01 | — | — |
| Number-of-consumptions data | −30 | 2009/11/12 10:25:45 | P02 | M05 | — | — |
| Number of payouts | 200 | 2009/11/12 10:28:50 | P01 | M01 | — | — |
| Number of payouts | 0 | 2009/11/12 10:29:00 | P02 | M05 | — | — |
| ⋮ | ⋮ | ⋮ | ⋮ | ⋮ | ⋮ | ⋮ |
| Liquidation | (120000) | 2009/11/12 12:15:50 | P01 | M01 | × | 1:50:50 |
| ⋮ | ⋮ | ⋮ | ⋮ | ⋮ | ⋮ | ⋮ |
| Liquidation | (40000) | 2009/11/12 12:30:00 | P02 | M05 | × | 2:04:55 |
| ⋮ | ⋮ | ⋮ | ⋮ | ⋮ | ⋮ | ⋮ |

FIG. 8

(a)

| Gaming machine unit identification information | Date | (a) Playing time per player, visit and play | (b) Change with elapse of time in balance of the player (balance after correction) | (c) Operation time of gaming machine | (d) Profit on the shop side by gaming machine |
|---|---|---|---|---|---|
| M01 | 2009/11/12 | 3:10:00 | 60000 | 12:10:00 | 34000 |
| | ⋮ | ⋮ | ⋮ | ⋮ | ⋮ |
| M05 | 2009/11/12 | 1:50:00 | −10000 | 4:30:00 | 15000 |
| | ⋮ | ⋮ | ⋮ | ⋮ | ⋮ |
| ⋮ | ⋮ | ⋮ | ⋮ | ⋮ | ⋮ |

(b)

| Player identification information | (a') Visit frequency | (b') Consumed amount of money per visit |
|---|---|---|
| P01 | One time/3.5 days | 20000 |
| P02 | One time/5.4 days | 15000 |
| ⋮ | ⋮ | ⋮ |

(c)

| Gaming machine unit identification information | (c') Operability | (d') Gross profit |
|---|---|---|
| M01 | 78% | 10000 |
| M05 | 55% | 15000 |
| ⋮ | ⋮ | ⋮ |

FIG. 9

(a)

| Gaming machine unit identification information | Date | Degree of satisfaction of player | Degree of satisfaction of gaming facility |
|---|---|---|---|
| M01 | 2009/11/12 | 55 | 60 |
| | ⋮ | ⋮ | ⋮ |
| ⋮ | ⋮ | ⋮ | ⋮ |
| M05 | 2009/11/12 | 52 | 58 |
| | ⋮ | ⋮ | ⋮ |
| ⋮ | ⋮ | ⋮ | ⋮ |

(b)

| Player identification information | Date | Evaluation points of life cycle of player | | Group | Pattern |
|---|---|---|---|---|---|
| | | Visit frequency | Consumed-amount-of money | | |
| P01 | 2009/11/12 | 48 | 55 | C | 2 |
| | ⋮ | ⋮ | ⋮ | ⋮ | ⋮ |
| P02 | 2009/11/12 | 47 | 52 | C | 2 |
| | ⋮ | ⋮ | ⋮ | ⋮ | ⋮ |
| ⋮ | ⋮ | ⋮ | ⋮ | ⋮ | ⋮ |

(c)

| Gaming machine unit identification information | Date | Date Evaluation points of life cycle of gaming machine | | Group | Pattern |
|---|---|---|---|---|---|
| | | Operability | Gross profit | | |
| M01 | 2009/11/12 | 48 | 47 | D | 3 |
| | ⋮ | ⋮ | ⋮ | ⋮ | ⋮ |
| ⋮ | ⋮ | ⋮ | ⋮ | ⋮ | ⋮ |
| M05 | 2009/11/12 | 42 | 45 | D | 3 |
| | ⋮ | ⋮ | ⋮ | ⋮ | ⋮ |
| ⋮ | ⋮ | ⋮ | ⋮ | ⋮ | ⋮ |

FIG. 26

MM DD ddd Current time:10:22
Welcome, xxxxx

HOME | Real time analytics | Past data analytics | Prediction analytics

Analysis menu

Log out

Stability analysis

Popularity analysis

Ranking of gaming machines by customer
Proportion of customers by device type
Proportion of groups of device type by customer Characteristics analysis Degree of satisfaction analysis Life cycle analysis Security analysis Ranking of gaming machines by customer (time of update: 17:00)

10:00 11:00 12:00 13:00 14:00 15:00
16:00 17:00 18:00 13:00 20:00 21:00
22:00

| Popularity rank | Gamble element | Game element | Time type | Non-member | Total | Total score |
|---|---|---|---|---|---|---|
| 1位 | A | B | C | D | A | 88 |
| 2位 | B | D | D | A | B | 70 |
| 3位 | C | A | B | C | C | 66 |
| 4位 | D | C | A | B | D | 62 |
| 5位 | E | G | H | E | E | 61 |
| 6位 | F | H | I | F | F | 60 |
| 7位 | G | I | E | G | G | 48 |
| 8位 | H | J | J | H | H | 40 |
| 9位 | I | E | F | I | I | 35 |
| 10位 | J | F | G | J | J | 30 |

FIG. 30
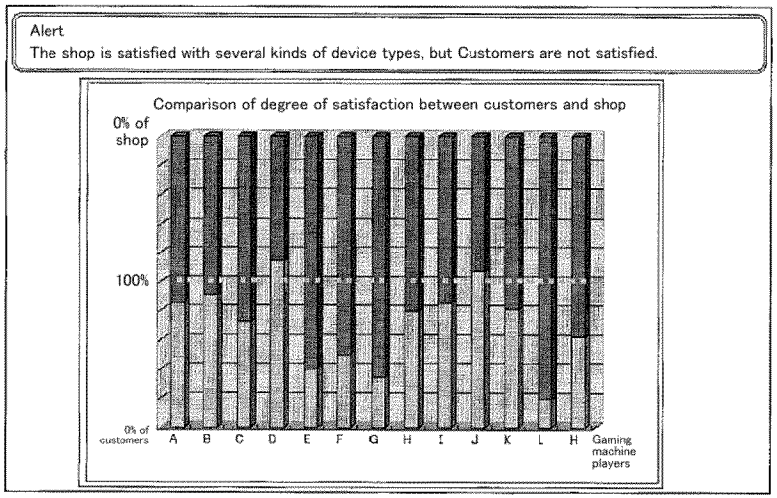
① By device type
( a )
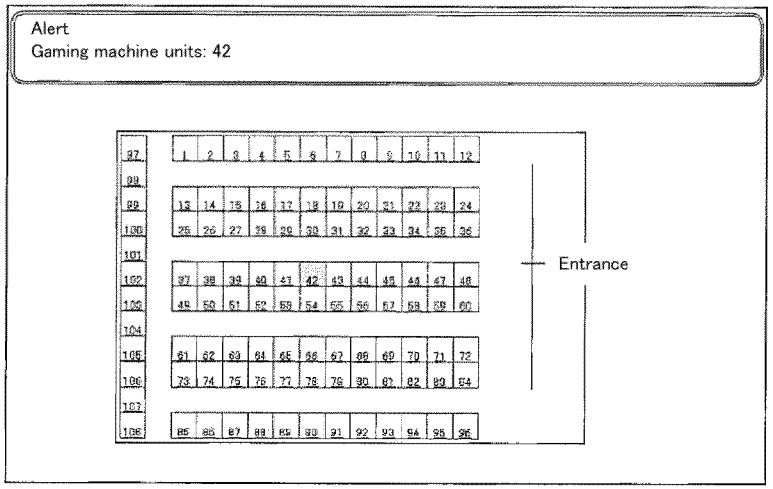
② By gaming machine
( b )

| Name of device type of altered event | Original event | Current event | Cumulative sales | Cumulative gross profit | Amount of investment recovered | Number of days of operation |
|---|---|---|---|---|---|---|
| AAA | Stable device type | Unpopular device type | 1,300,000 | 450,000 | −110,000 | 165 |

GAME-INFORMATION-INTEGRATING SYSTEM

TECHNICAL FIELD

The present invention relates to a game playing information integration system which integrally manages game information including the operation states of a variety of gaming machines installed in a gaming facility, the information of a player playing on a gaming machine and other information, and provides such game information as the information to be reflected on management.

BACKGROUND ART

Conventionally, there have been systems which compute the number of times of big hit and number of games played or the payout quantity of gaming machines with an elapse of time and manage and analyze the state of each gaming machine. Summing of the data indicating the state of each one of those gaming machines has been performed to analyze the states including sales by the type of the gaming machine, or by gaming facility.

However, as important elements in management of a gaming facility, the timing for replacing old gaming machines by new gaming machines and arrangement and layout of the gaming machines, and further which gaming machines to be replaced by which new gaming machines have been generally determined by the experience of humans based on the results of the analysis mentioned above. Moreover, in order to promote replacement with new gaming machines, manufacturers who conduct changes in designs and sell the gaming machines need to design popular device types. However, designing these popular device types has been also dependent on the rule of thumb and intuitions of the planners of gaming machines.

(1) Difficulties for manufacturers who design, manufacture, and sell gaming machines in designing popular device types to design First, a method of designing the above-mentioned known popular device type is as follows: that is, it has been conventionally a proposition to design gaming machines which sell well for manufacturers to design, manufacture, and sell gaming machines. As approaches for achieving this object, it has been a routine practice to introduce new functions or stage effects to induce a sense of expectation or to promote famous copyrights in contents that are used in gaming machines while paying a large amount of license fees. However, manufacturers themselves have intuitively or experientially determined as to whether or not the device is an excellent gaming machine; and therefore, even if these approaches are employed, the popularity of gaming machines has often superseded the manufacturers' predictions.

(2) Difficulties in selecting the type of the gaming machine seen from the local area characteristics of the gaming facility and the player playing the game Second, a conventional method regarding the selection of game elements of gaming machines installed in the gaming facility and the determination of the timing to replace gaming machines performed by the manager of the above-mentioned gaming facility is as follows:

That is, for example, there are a variety of players' preferences for gaming machines such as differences in players' preferences depending on geographical conditions such as local area characteristics such as Las Vegas or Macao or whether or not the condition of location is near resort hotels, differences in preferences of customer categories depending on time intervals such as differences in visit time of housewives or businessmen, or differences in preferences of fixed customers (manias), unfixed customers (browsing customers), or novices (beginners), and such preferences are different depending on players. In addition, in respect of the management side of gaming facilities, requests for gaming machines that they desire to install in the gaming facilities are also different depending on the gaming facilities. For example, one gaming facility of the adjacent two gaming facilities desires to install gaming machines of such device type to stimulate gambling mind of players, whereas the other gaming facility desires to install gaming machines of such device type to enjoy the play of game over a long period of time without exerting such gambling mind. Namely, even within a same local area, the requests from the gaming facilities as to gaming machines may be different depending on management policy. Therefore, on the manufacturers' side, it is impossible to satisfy the requests of all players and gaming machines, and it is also unavoidable to design gaming machines while taking the greatest common preferences of all.

In such a present situation, in order for a gaming facility to obtain the maximal profit, the gaming facility itself must continuously install gaming machines of which device type and number is assigned in accordance with the request of that gaming facility and the preferences of players visiting the gaming facility.

However, timing of replacement with gaming machines of new device type has been conventionally determined on the basis of rule of thumb; and therefore, a difference takes place with economic efficiency related to the replacement, depending on persons who determine such replacement, and as a result, there has been apprehension that the gaming facility loses profit.

In addition, while, in a gaming machine, settings which are able to change a winning probability in a predetermined range are provided at a plurality of stages in general, these settings are often adjusted on the basis of rule of thumb; and therefore, a balance between improvement of ability to attract customers by setting a current mode to a high probability mode, the profit of the gaming facility lowers, and as a result, there has been apprehension that the gaming facility loses profit.

Further, there has been a problem that the manager in gaming facility takes preference to only improvement of one's own immediate profit against the manager's thought, highly sets a dividing number, and causes fixed customer to lose interest in shop in a long run.

Furthermore, players visiting a gaming facility vary depending on the time slot in a day, the season, the temperature, the game elements of the gaming machine installed and other factors. A management method for coping with such variation in real time as much as possible is desired.

Meanwhile, there are currently such systems that allows network connection between a gaming machine and an external game program download server, suitably selecting and downloading one game program to download from a plurality of game programs from the external game program download server, and executing a plurality of games on a single machine, not only changes in game programs, but also downloads for modifying their game contents in detail even in the same game program, for example, performing changes in denomination rates and other detailed changes in game elements have been also enabled. It has been also important how to link such a known system for changing software on a gaming machine by downloading with a method for managing gaming machines depending on the varying states mentioned above.

In Patent Document 1, there is disclosure of a management apparatus for gaming facility to sum and manage work data on pachinko gaming machines.

PRIOR ART DOCUMENT

Patent Document

[Patent Document 1] Japanese Patent Publication No. H11-207001

SUMMARY OF THE INVENTION

Problems to be Solved by the Invention

With respect to a game playing information integration system, in the management apparatus for gaming facility, described in Patent Document 1, it is possible to perform summing and management of operability data, and then, based on the data, perform determination of whether or not settings or the like in service time are appropriate; and therefore, it may be possible to normalize the settings or the like in service time. However, it is impossible to perform analysis as to customer category; and therefore, with respect to timing of replacement with gaming machines of new device type or adjustment of settings, it is difficult to continuously perform selections or settings according to the preferences of players, in particular, fixed customers, over a long period of time.

Conventionally, the method for the manager of the gaming facility to grasp the operation states of the gaming machines installed in the gaming facility more precisely, and to provide information to cope with the state of the gaming facility changing every moment based on the grasped information in real time have been provided only in the form of numerical indication established for each gaming facility and manager. Therefore, it has been difficult to determine such information in real time. Moreover, years of experience have been required to grasp the states with such numerical data.

It is an object of the present invention to provide a game playing information integration system for quantitatively obtaining data related to shop management of a gaming facility to be thereby able to objectively perform selection or settings according to the preferences of players, in particular, fixed customers, and to be thereby able to effectively introduce a gaming machine to invoke demands of players as users and managers of gaming facilities in a well-balanced manner from a result obtained by logically analyzing the gaming machine.

Another object of the present invention is to provide a game playing information integration system which is connected with all gaming machines in the gaming facility via a network, and is capable of displaying the operation state of each gaming machine in every predetermined time on a display screen (display screen of a personal computer and a portable terminal) for the manager.

Means for Solving the Problems

Namely, as mentioned above, gaming machine-based analysis systems have been present conventionally. However, no conventional system which analyzes the life cycle of the gaming machine the life cycle of the player has been present. In order to achieve the objects mentioned above, the present invention employs, as a main structure thereof, a constitution for comparing and analyzing the life cycle of the gaming machine and the life cycle of the player, and outputting advice (alert and indication of state change, etc.) to keep the balance of the two.

Accordingly, employing the present invention allows adjustment of installation of the gaming machines in the gaming facility depending on characteristics of visiting players in consideration of characteristics of a variety of gaming machines.

For example, when there are many high rollers, the rate of installation of high-denomination gaming machines is increased in the gaming facility. When the life cycle of the high rollers is becoming to have the tendency of "dissatisfied customers", the rate of installation of high-denomination gaming machines is increased in the gaming facility as mentioned above.

On the contrary, when there are few high rollers and many players who likes low-denomination gaming machines, the number of low-denomination gaming machines for high rollers is increased and the rate of installation of high-denomination gaming machines in the gaming facility is lowered. When the life cycle of the players who like low-denomination gaming machines, not that of the high rollers who like high-denomination gaming machines, is becoming to have the tendency of "dissatisfied customers", the rate of installation of the low-denomination gaming machines in the gaming facility is increased as mentioned above.

More specifically, the present invention employs the following constitution to achieve the objects mentioned above.

(1) A game playing information integration system comprising:

a plurality of gaming machine units; and a server connected to enable communication with each of the gaming machine units, wherein the gaming machine unit includes: the gaming machine unit game initiation or completion data output device which outputs a game initiation or completion data for cumulatively monitoring the number of times of games executed by the server for each game by the execution of the game, the server includes:

data storage device which stores the game initiation or completion data outputted by the game initiation or completion data output device and reception time data indicating a reception time of the data in association with each other, and, stores, in advance, map layout indication image data of the gaming facility, location information of said each gaming machine unit indicated in the map layout indication image, and when data is received from the gaming machine unit, and lookup data with identification information for each gaming machine unit included in the data, analysis processing device for performing analysis of data received from the gaming machine unit and then stored in the data storage device;

an output device produces image data depending on the results analyzed by this analysis device and outputs the data to an external portion, wherein the analysis processing device produces a cumulative value of game initiation or completion data for each gaming machine unit based on data stored in the data storage device, and the output device executes a processing of outputting an image of the location information of each gaming machine unit in the outputted map layout indication image as an image data changed depending on the cumulative value.

(2) Further to the constitution of the above (1), the analysis device grasps the number of all players from player identification information transmitted from each gaming machine unit, produces an average rate of game execution of players by time unit, and produces a rate of operation of all game units by time unit, the output device produces graph image data from the rate of game execution and operability and outputs the graph image data to an external portion.

(3) A game playing information integration system including:

a plurality of gaming machine units; and a server connected to enable communication with each of the gaming machine units, wherein the gaming machine unit includes:

a player identification information reading device which is capable of reading player identification information, and outputs the read player identification information;

the gaming machine unit includes game execution data output device which outputs to the server outputting predetermined data by the execution of the game (the game execution data output device is the data generated by executing the game, and for example, any of a game initiation or completion data output device which outputs game initiation or completion data for cumulatively monitoring the times of game executed for every execution of the game, a number-of-consumptions data related to the number of consumptions of gaming media, and a number-of-payouts data output device for outputting number-of-payouts data related to the number of payouts of game playing media are included in the concept of the game execution data output device), wherein the gaming machine unit identification information is individually assigned to each of the gaming machine units, the server includes:

data storage device which stores the player identification information, the predetermined data outputted by the game execution data output device, and reception time data indicating reception time of the predetermined data (not the time range of receipt, but, for example, log indicating the time of receipt) in association with each other;

analysis processing device for performing analysis of data received from the gaming machine unit and then stored in the data storage device; and output device which produces image data depending on the results analyzed by this analysis device and outputs the data to an external portion, the analysis processing device executes, based on data stored in the data storage device, a processing which produces data relating to at least (a) to (b), (a) a value of the predetermined data of each player at the gaming machine unit (for example, game initiation or completion data), (b) a cumulative value of cumulative number of visitors by the type of players classified into player identification information of each player at the gaming machine unit, and further the output device executes:

by the analysis device, based on the two cumulative value produced by the processings (a) and (b), a processing of editing a map layout indication image showing a state that the gaming machine units are disposed in the gaming facility to change based on a cumulative value of the predetermined data, outputting the edited map layout information to indicate, and a processing of generating and outputting a graph image based on the cumulative value of the number of visitors by the type of players classified in the player identification information in advance.

(4) Further to the constitution of (1, a processing of producing and outputting a graph image based on the cumulative value obtained in the (a) by the analysis device is executed.

The analysis device is constituted as to produce the two cumulative values, but when the performance of the gaming machines is generally evaluated, it may be evaluated based on the game information mentioned below. The game information will be described here.

(Game playing information)

Hereinafter, terms related to game playing information will be described.

An "operability" (%) is computed by means of "(OUT number/(Absolute Out number per hour×business time))×100". The absolute Out number in pachinko gaming machine is 83, for example, the absolute Out number in pachinko/slot gaming machine is 33, for example.

A "safe" is referred to as game pachinko ball or coin paid out by a gaming machine. A "safe" pachinko ball is referred as game pachinko ball paid out by a gaming machine.

A "good pachinko ball" is computed by means of "number of Outs-number of Safes". In addition, "difference number" is also computed by means of "Number of outs-Number of safes", and is employed regardless of type of gaming medium.

A "winning pachinko ball rate" (%) is computed by means of "(number of safes"/number of outs)×100".

A "prize dividing number" is computed by means of "prize money (Yen)/amount of sales (Yen)".

A "machine dividing number" is computed by means of "(sales amount (Yen)-amount of money for good pachinko ball (Yen))/amount of sales (Yen) or "(sales pachinko ball-good pachinko ball)/sales pachinko ball".

An "incorrect difference pachinko ball" or "prize error" is computed by means of "(sales pachinko ball-good pachinko ball)-prize pachinko ball".

A "pachinko ball unit prize" is computed by means of "machine sales/number of outs".

A "pachinko ball gross profit" is computed by means of "machine gross profit/number of outs".

A "total amount of sales" is computed by means of "machine operability×number of machines×number of days×pachinko ball unit prize".

A "machine sales" is computed by means of "number of outs"×pachinko ball unit price" or "total amount of sales/number of machines".

A "gross profit" is computed by means of "amount of sales-purchase amount of prize" or "amount of sales-(prize money×cost)".

A "gross profit by machine" is computed by means of "machine sales×profitability".

A "total gross profit" is computed by means of "machine operability×number of machines×number of days×gross profit by pachinko ball".

A "cost rate" is computed by means of "number of pachinko balls lent (per 100 pachinko balls)×number of pachinko balls exchanged (per 100 Yen)".

A "balance dividing number" is computed by means of "number of pachinko balls exchanged (per 100 Yen)/number of pachinko balls exchanged (per 100 Yen)" or "1/cost rate".

A "profitability" is computed by means of "gross profit/amount of sales" or "(balance dividing number-dividing number)/balance dividing number)×100".

A "Base (B)" is computed by means of "(number of safes in normal game/number of outs in normal game)×100".

A "B %" is computed by means of "100-base".

A "BY" is computed by means of "base-start×start number-of-payouts"

A "customer stay rate" is computed by "(cumulative B-service time/amount of sales"×100%.

A "TS" is computed by means of "cumulative start number/special prize number".

A "BO" (minutes) is computed by means of "TS/start number (one minute), BO (real number)/100".

A "TO" has a relationship of "TO (real number)/100=special prize time (minutes).

A "T10" has a relationship of "T10 (total)/100=minutes (TO).

A "TY" is computed by means of "number of safes in special prize-number of outs in special prize".

A "T1Y" is computed by means of "number of safes in big hit-number of outs in big hit (T10)".

A "BA" is computed by means of "number of safes in changed probability/number of outs in changed probability".

A "BOA" is computed by means of "TSA/start A".

Effects of the Invention

According to the game playing information integration system of the present invention, the operational state of the gaming facility can be visually grasped in real time even by a manager or an operator with little experience. Therefore, it is not necessary to analyze the management state from numerical values as in a conventional method, and measures to take after grasping the state can be quickly taken.

BRIEF DESCRIPTION OF THE DRAWINGS

FIG. 7 is an explanatory view depicting one example of the game playing status database stored in the hall conserver shown in FIG. 1.

FIG. 8 is an explanatory view depicting one example of a correlation database stored in the hall conserver shown in FIG. 1.

FIG. 9 is an explanatory view depicting one example of a determination result database stored in the hall conserver shown in FIG. 1.

FIG. 26 is a view indicated when "real time analytics" is selected as in FIG. 23.

FIG. 30(*a*) shows "degree of satisfaction of gaming apparatus", and FIG. 30(*b*) shows "degree of satisfaction of gaming machine".

MODE FOR CARRYING OUT THE INVENTION

Figure 1:
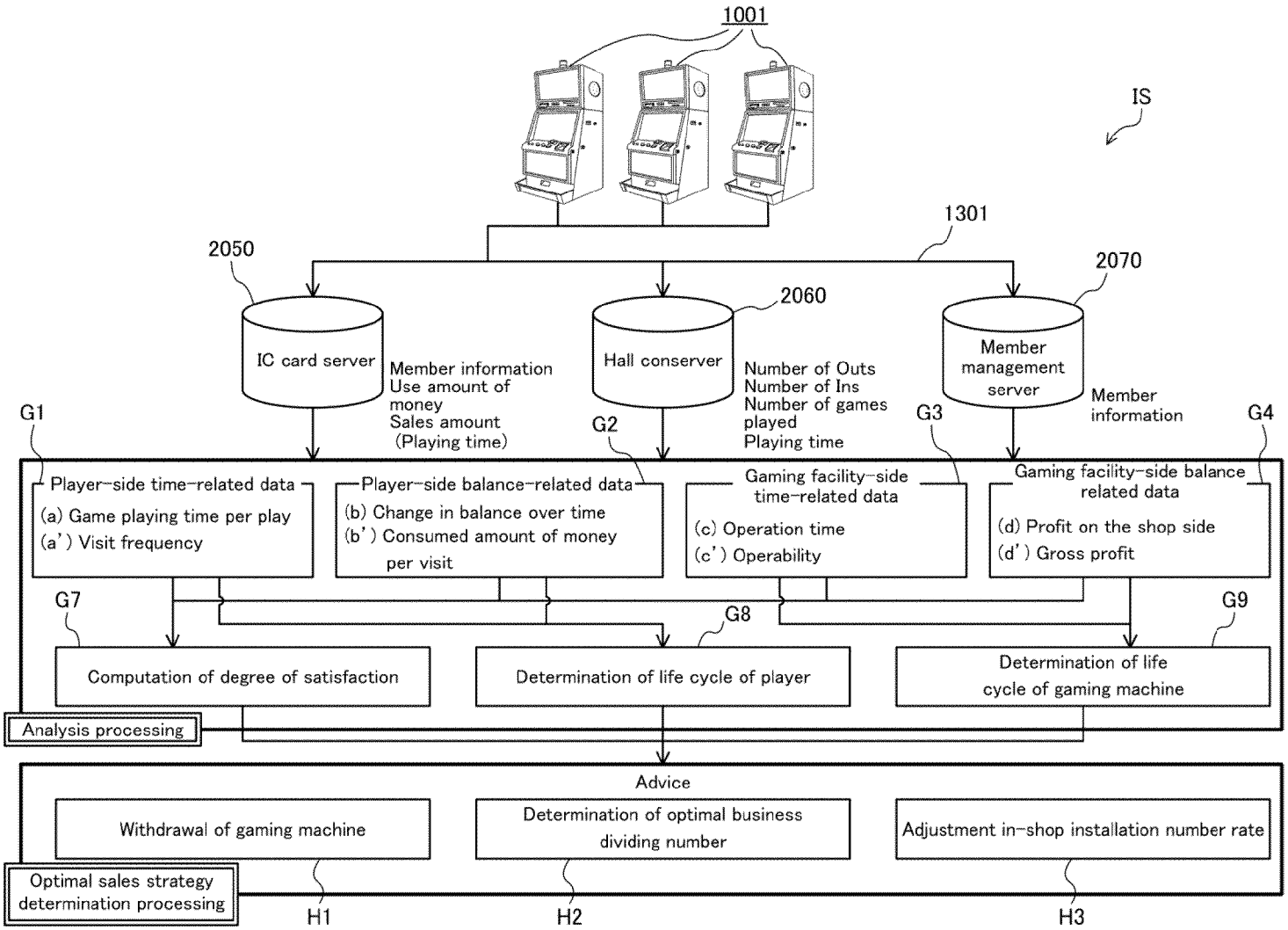
FIG. 1 is a functional flowchart depicting an outline of a game playing information integration system.

FIGS. 21 to 33 show an example indicating a state that data obtained by the game playing information integration system shown in FIGS. 1 to 20 below is outputted from the servers or gaming machine units to external portions via cable or wireless communication lines, and the outputted data is displayed on a display screen. For example, it is an explanatory view showing display screen data generated based on the data obtained from the block of the analysis processing as analysis processing device shown in FIG. 1, and the data being displayed on the display screens of personal computers installed in the gaming facility and cellular phones connected via the internet and other communication lines (not shown).

FIGS. 21 to 33 (excluding FIGS. 25, 27, 28 and 30) show four types of tabs: "home" "real time analytics" "past analytics" "prediction analytics". Outputted data shown below can be displayed as an image by selecting the four tabs with a pointer. This displayed image can be visually confirmed by the manager operator of the gaming facility in a state which allows visual confirmation of the state of the gaming facility. Therefore, the management and business states of the gaming facility can be grasped by even a manager or an operator with little experience who is not able to grasp the state of the gaming facility correctly from numerical value and the like.

The outputted data is provided from the game playing information integration system stated below.

This is, the game playing information integration system has a plurality of gaming machine units, and servers connected in communication with the gaming machine units as its basic components.

The game playing information integration system is provided with game initiation or completion data output device which outputs a game initiation or completion data for cumulatively monitoring the number of times of games executed by the server for each game by the execution of the game by the execution of games in the gaming machine unit.

The server is provided with data storage device which stores a communication interface for communicating with the gaming machine unit, the game initiation or completion data outputted by the game initiation or completion data output device, and receipt time data indicating the time of receipt of the data in association with each other, and stores in advance map layout display image data of the gaming facility, location information of the gaming machine units displayed in the map layout display image, and when data is received from the gaming machine unit, lookup data with identification information for each gaming machine unit included in the data, analysis processing device which performs analysis of data received from the gaming machine unit and stored in the data storage device, and output device which generates image data depending on the results analyzed by this analysis device and outputs the data to an external portion.

The analysis processing device generates the cumulative value the game initiation or completion data for each gaming machine unit based on data stored in the data storage device. The output device executes a processing for outputting the image of the mark corresponding to the location information of each gaming machine unit of the outputted map layout display image as an image data which is varied depending on the cumulative value. For example, the slot machine is indicated by the symbol □ in FIG. 21, and with reference to table data having color data which is changed at every unit time unit associated therewith, the color within the symbol □ is changed depending on the operational state calculated in real time.

Figure 21:
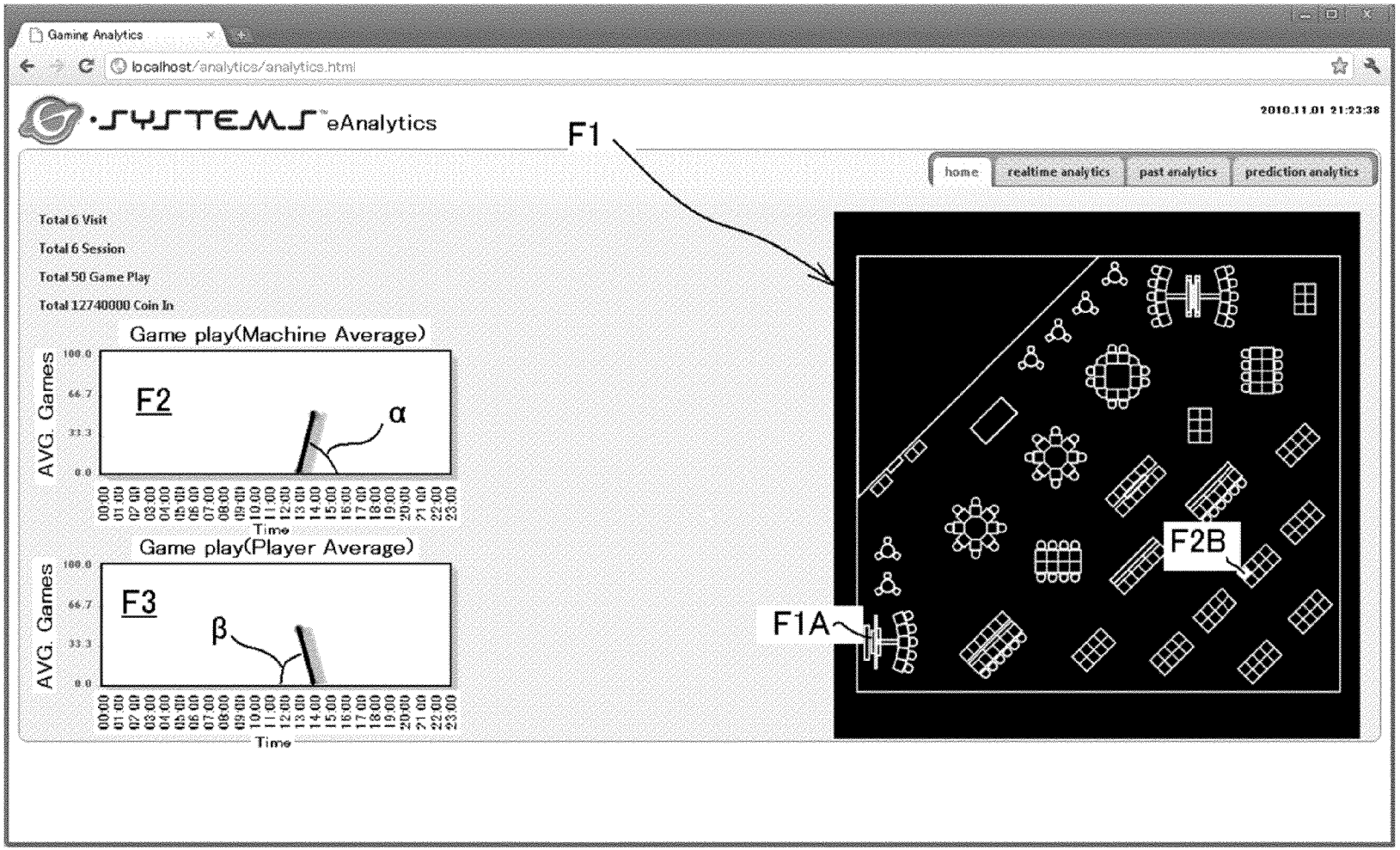
FIG. 21 is an explanatory view indicated on display screens of personal computers which produce display screen data based on the data obtained from the analysis processing as the analysis processing device of FIG. 1 and are installed in the gaming facility (not shown) and of cellular phones connected via the internet and the like. This explanatory view is a view indicated when "home" is selected among "home", "real time analytics", "past analytics", and "prediction analytics" indicated on the display screen.

FIG. 21 shows the state that the cumulative value of such game initiation or completion data for the gaming machine units is generated, and the output device executes a processing of outputting an image of the location information of each gaming machine unit in the outputted map layout indication image as an image data changed depending on the cumulative value.

Specifically, the area surrounded by a white frame of reference numeral F1 indicates the installation area of the gaming machine units indicating the entire gaming facility, and reference numeral F2 represents a line graph of the operability of the game units of the entire gaming facility by time unit. In addition, reference numeral F3 indicates the rate of game execution by time unit of a player visiting the gaming facility. In order to reflect the operability and rate of execution by time unit on the image data, communication for transmitting information is performed once every few seconds between the game unit and server. In this case, the amount of information transmitted is minimized by transmitting only the difference of information from the information transmitted previously to the server, along with the identification information of the game unit only.

In addition, the communication time may be so constituted to be set individually for each game unit to perform the game. In such a case, the set time can be set to be shorter than the shortest game playing time when the game is executed in each game unit, whereby the risk of erroneously summing the gaming information across two games as the gaming information for one game can be decreased.

It should be noted that, in this embodiment, the gaming machine unit corresponds to a slot machine and a gaming machine, and the gaming machine includes devices for executing games which uses Baccarat, cards, or dices.

In the installation area F1 of the gaming machine units, slot machines and gaming machines other than slot machines are indicated, and are indicated by using mark images having similar shapes recognized when seeing from the information gaming machines including slot machines installed in the gaming facility. For example, reference numeral F1A is a gaming machine unit for executing a roulette game and a card game. Reference numeral F2B is a mark indicating a single slot machine, and eight slot machines are disposed in a single slot machine disposition mount.

The operability of the overall gaming machine units can be checked with F2, while the colors of the mark image displayed on the map layout display image of the gaming facility of F1 are made different so that by different colors for game units with high operability and those with low operability. This allows the manager and the operator who visually check the display screen to grasp the operational state of the entire gaming facility in the graph of F2, and also grasp the operational states of the respective game units while visually checking the colors of the mark images of the game units. For example, in FIG. 141, when the slot machine as the game unit corresponding only to the mark of reference numeral F2B is operated, the color of the portion of the mark (□) only changes to a that different from those of the marks of other gaming units.

In addition, changes in the state can be grasped while visually checking the angle α of the increase trend of F2 and the angle β of the decrease trend of F3.

The game playing information integration system of this embodiment has a display screen which displays an image data generated by changing the image of the location information of the gaming machine units depending on the cumulative value in the map layout display image outputted by the above-described output device, and displays the installation area F1 of the above-described game unit on this display screen.

In addition, the game playing integration system of this embodiment grasps the number of all players from the player identification information transmitted from the gaming machine units by the analysis device, generates an average rate of game execution of the players by time unit, generates the operabilities of all game units by time unit, and generates a graph image data from the rates of game execution and operabilities by the output device and outputs the data to an external portion, whereby the graphs of F2 and F3 mentioned above are displayed on the display screen.

Figure 22:
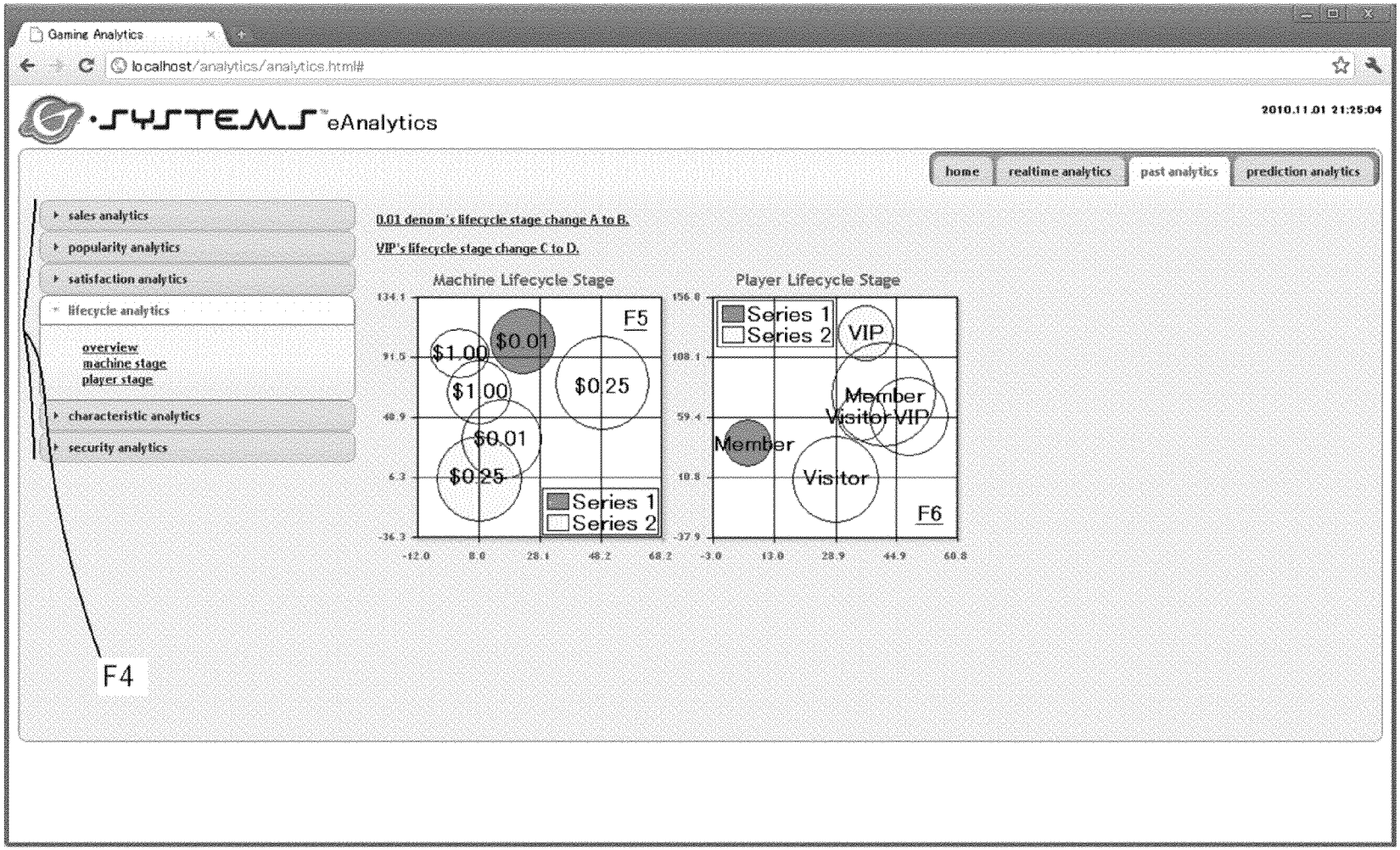
FIG. 22 is an explanatory view indicated on display screens of personal computers which produce display screen data based on the data obtained from the analysis processing as the analysis processing device of FIG. 1 and are installed in the gaming facility (not shown) and of cellular phones connected via the internet and the like. This explanatory view is a view indicated when "past analytics" is selected among "home", "real time analytics", "past analytics", and "prediction analytics" indicated on the display screen.

While FIG. 21 is a display screen displayed when "home" is selected, FIG. 22 is displayed when "past analytics" is selected among "home", "real time analytics", "past analytics", and "prediction analytics".

At reference numeral F4 to the left in the layout of FIG. 22, six menus are indicated: "sales analytic", "popularity analytics", "satisfaction analytics", "lifecycle analytics", "characteristic analytics", and "security analytics", and which allow display of a display image in the selected analytic form by selecting any one of them. The menu indicated here is "life cycle analytics".

F5 is a figure corresponding to FIG. 14 described later, in which players are grouped and indicated by denomination (unit game playing value). The types of the denominations are three: "$0.01", "$1.00", and "$0.25", which are further indicated in different colors of circles depending on the type of the gaming machines. In the figure, no difference is found as the indication is in monochrome, but one of indications of the same denomination is a circle of Series1 type gaming machine, while the other is a circle of Series2 gaming machine. Any circle of gaming machine is not excluded from being a slot machine. In F5, the groups of circles disposed more upper right can be determined to have higher degree of satisfaction.

In addition, F6 is a figure corresponding to FIG. 12 described later. Based on the game playing information obtained from the game units along with the player identification information, a graph is generated by the vertical axis indicating the visit frequency of player, and the horizontal axis indicating the consumed amount of money by a player. In addition, the groups "VIP" "MEMBER", and "VISITOR" determined in advance on the game playing information integration system side for each of the two series are indicated as single groups, respectively.

F5 and F6 show that the area of a group indicated by a circle indicates the numbers of applicable game units and players.

Figure 23:
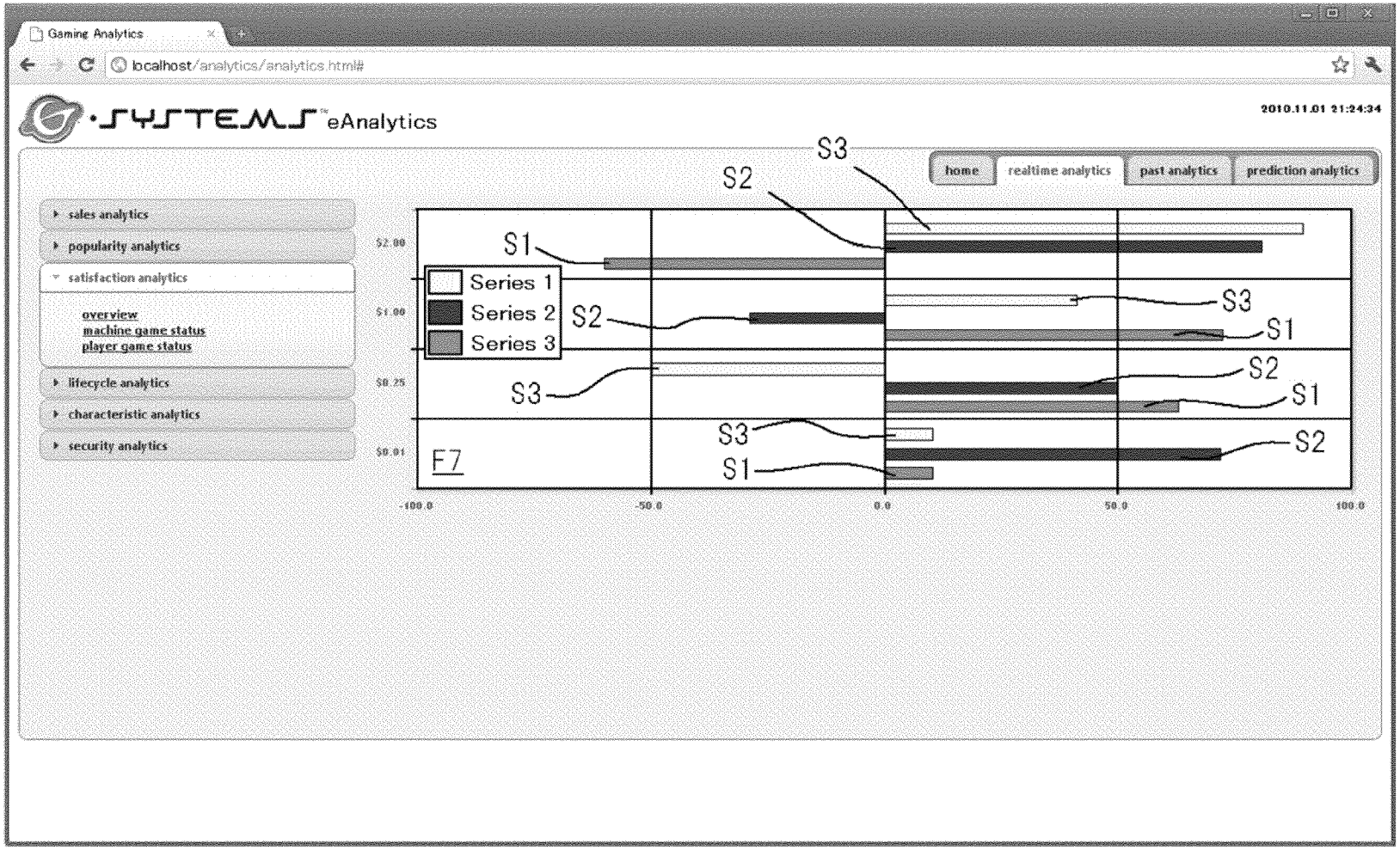
FIG. 23 is an explanatory view indicated on display screens of personal computers which produce display screen data based on the data obtained from the analysis processing as the analysis processing device of FIG. 1 and are installed in the gaming facility (not shown) and of cellular phones connected via the internet and the like. This explanatory view is a view indicated when "real time analytics" is selected among "home", "real time analytics", "past analytics", and "prediction analytics" indicated on the display screen.

FIG. 21 is a display screen displayed when "home" is selected, while this FIG. 23 is a figure displayed when "real time analytics" is selected among "home", "real time analytics", "past analytics", and "prediction analytics".

At F7 of FIG. 23, six menus are displayed on the left side of the layout. These six menus are: "sales analytic" "popularity analytics" "satisfaction analytics" "lifecycle analytics" "characteristic analytics", and "security analytics". FIG. 111 show a state that "satisfaction analytics", among these, is displayed.

In addition, the bar graph at F7 has denominations shown on the vertical axis, and is indicated in three series. No difference in display is found between the three series as the figure is in monochrome, but reference numeral S1 indicates series1; reference numeral S2 indicates series2; and reference numeral S3 indicates series3.

Figure 24:
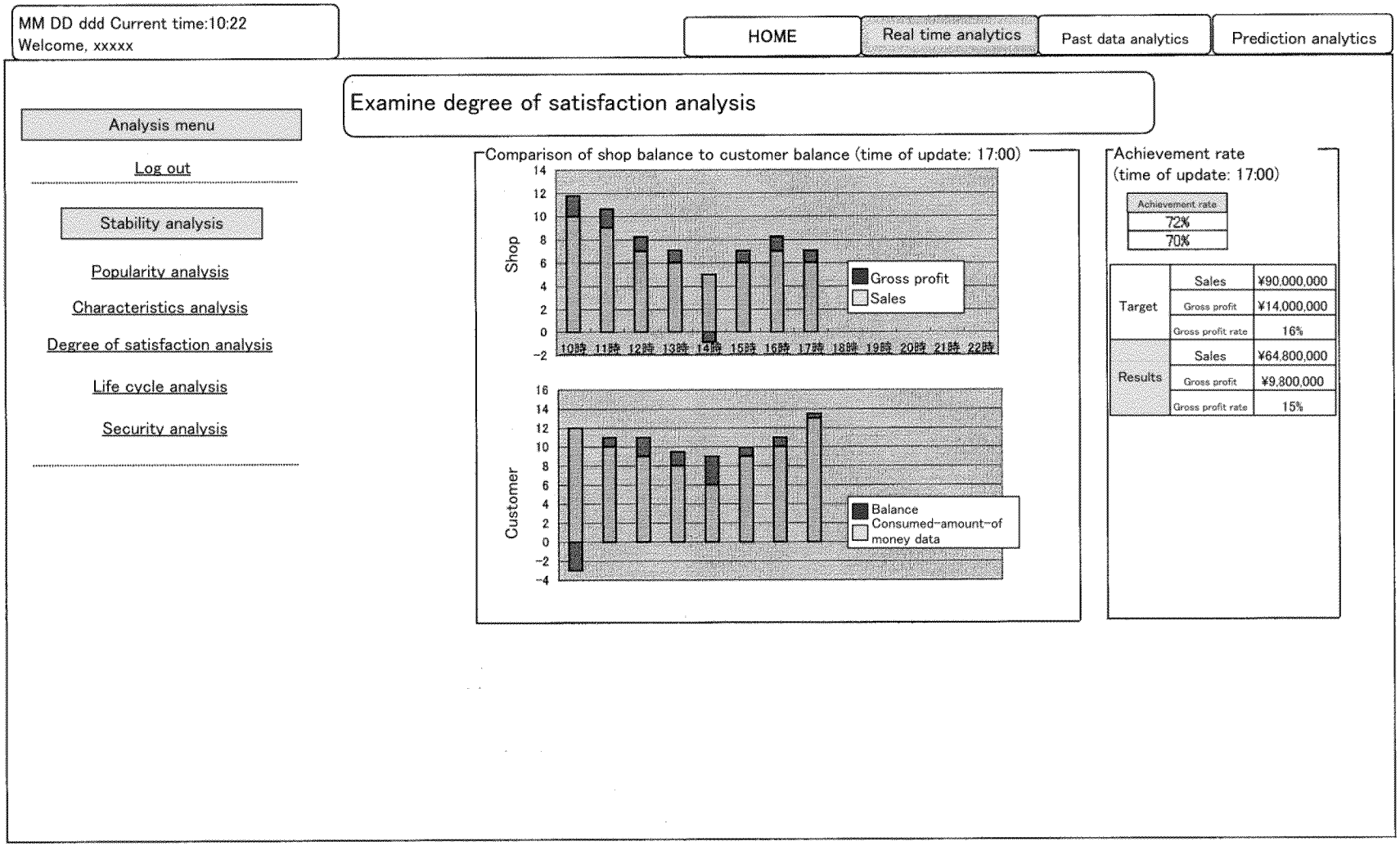
FIG. 24 is a view indicated when "real time analytics" is selected as in FIG. 23.

FIG. 24 is a figure displayed when "real time analytics" is selected as FIG. 23. This FIG. 24 is a figure which shows "sales analytic" (stability analytics), among "sales analytic", "popularity analytics", "satisfaction analytics", "lifecycle analytics", "characteristic analytics", and "security analytics".

Figure 25:
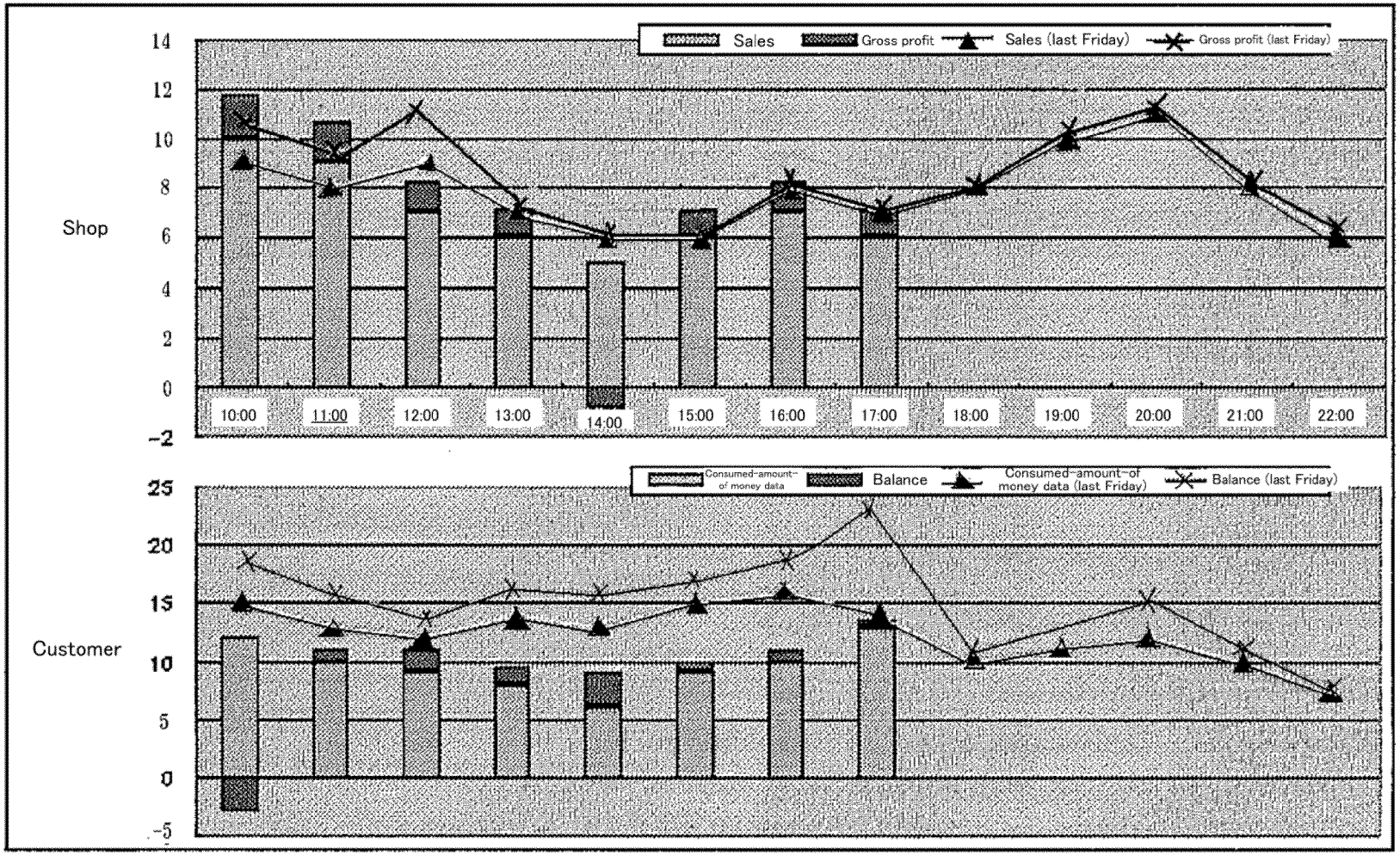
FIG. 25 shows a graph of the results of comparison between today and yesterday.

FIG. 25 shows a graph of the results of comparison between today and yesterday. The feature in this graph lies in that today's results and yesterday's results, which are in the past, are indicated by a bar graph and a line graph, respectively and the comparison between today and yesterday is indicated by graphs in the different forms. By indicating in different graph forms the results from the present and the past to be compared in such a manner, discrimination of the graphs of the present and the past displayed on the display screen can be improved.

Data are summed in such a manner that the results in the shop correspond to the sales and gross profit, while the results of the customer as the player correspond to the consumed amount of money and balance.

FIG. 26 is a figure displayed when "real time analytics" is selected as FIG. 23. This FIG. 26 is a figure which indicates "popularity analytics" (popularity analysis), among "sales analytic", "popularity analytics", "satisfaction analytics", "lifecycle analytics", "characteristic analytics", and "security analytics".

The popularity analysis, as displayed on the left side of the layout of the display screen, is programmed to switch display by designating "ranking of gaming machines by customer", "proportion of customers by device type", and "proportion of customers by device type group" with a pointer (not shown). FIG. 26 shows the state that "ranking of gaming machines by customer" is displayed. Image data of tables linking to the times of updates are generated and stored in a storage area (not shown) so that the ranking of gaming machines by customer can be displayed at the times of update 10 o'clock, 11 o'clock, 12 o'clock, 13 o'clock, 14 o'clock, 15 o'clock, 16 o'clock, 17 o'clock, 18 o'clock, 19 o'clock, 20 o'clock, 21 o'clock, and 22 o'clock. FIG. 26 shows the image data of the table of the ranking of gaming machines by customer updated at 17 o'clock.

Figure 27:
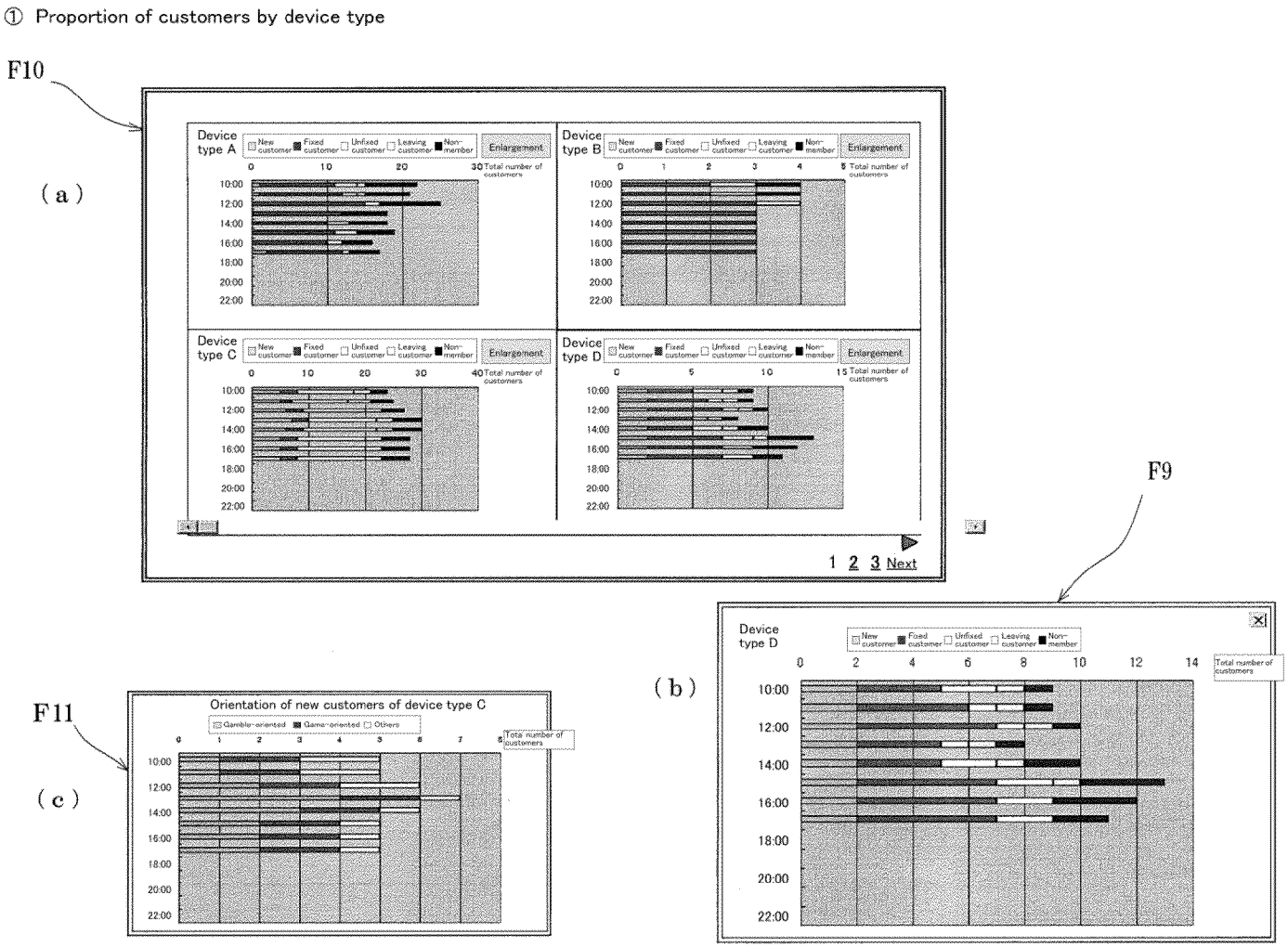
FIG. 27 is a view indicated when "real time analytics" is selected as in FIG. 23.

FIG. 27(*a*) shows the case where "ranking of gaming machines by customer" is selected among the three options: "ranking of gaming machines by customer", "proportion of customers by device type", and "proportion of customers by device type group" of FIG. 26. In addition, FIG. 27(*b*) shows, in a state that the image data as F10 is displayed, a state that display of device type D is selected by designating the enlarge button of device type D with a pointer, among the enlarge buttons on an upper right portion device type A, device type B, device type C, and device type D. The image data of the table of F9 is displayed on the display screen at this time. FIG. 27(*c*) show a table F11 which indicates the orientation of new customers of device type C (for example, "gambling elements" involving pursuing large sums by winning big or losing big; "gaming elements" involving pursuing fun of the game itself rather than winning or losing; and "others" involving pursuing beautiful appearance, preference of characters and other factors).

Figure 28:
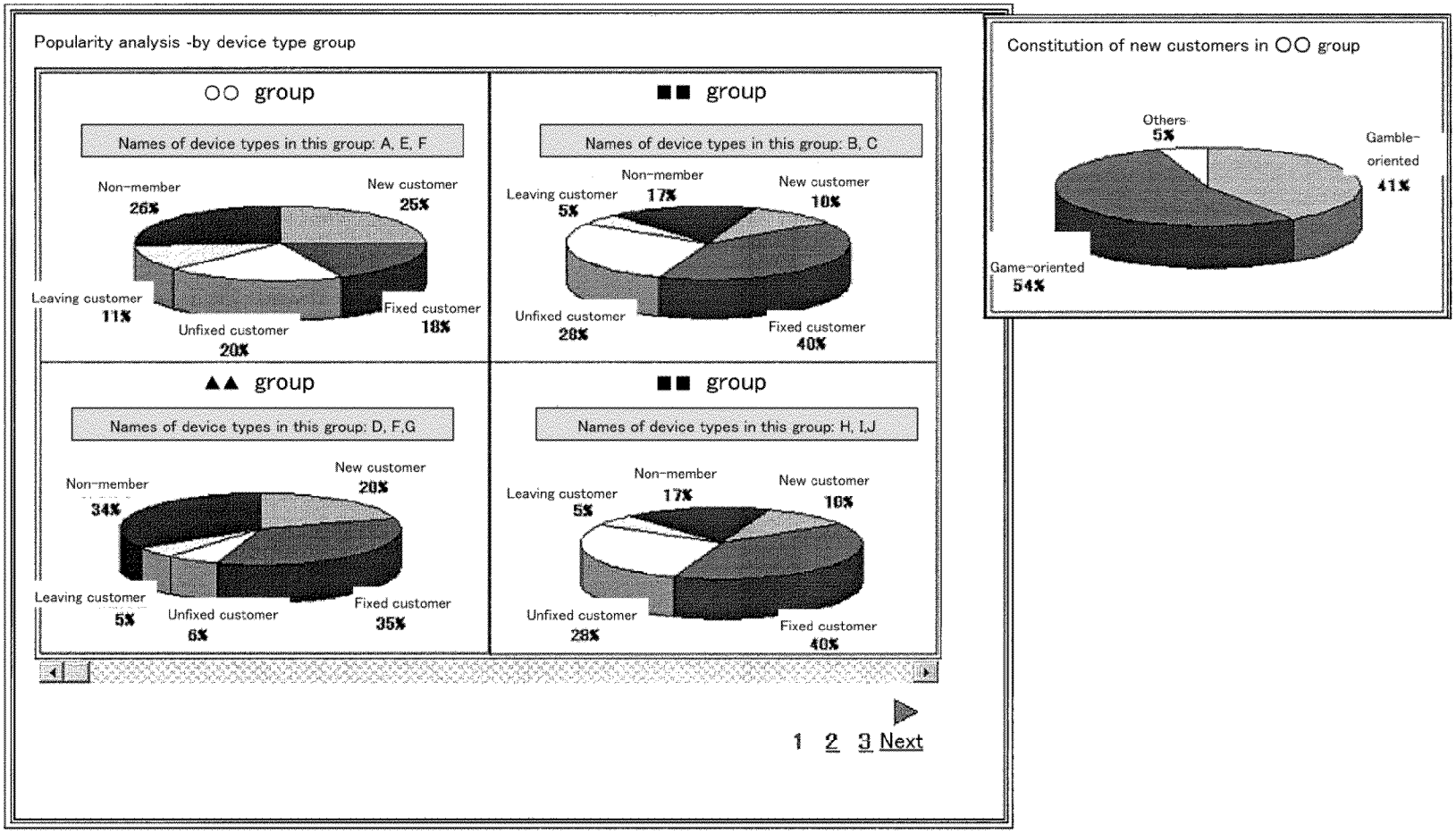
FIG. 28 is a view indicated when "real time analytics" is selected as in FIG. 23.

FIG. 28 is a figure displayed when "real time analytics" is selected as FIG. 23. It also shows the case where "proportion of customers by device type" is selected, among the three options: "ranking of gaming machines by customer", "proportion of customers by device type", and "proportion of customers by device type group" of FIG. 26 displayed after designating the popularity analysis. Described in more detail, device types A to J are grouped by their characteristics, and the proportions of customers in the respective groups is displayed on the display screen in the image of a pie graph.

Figure 29:
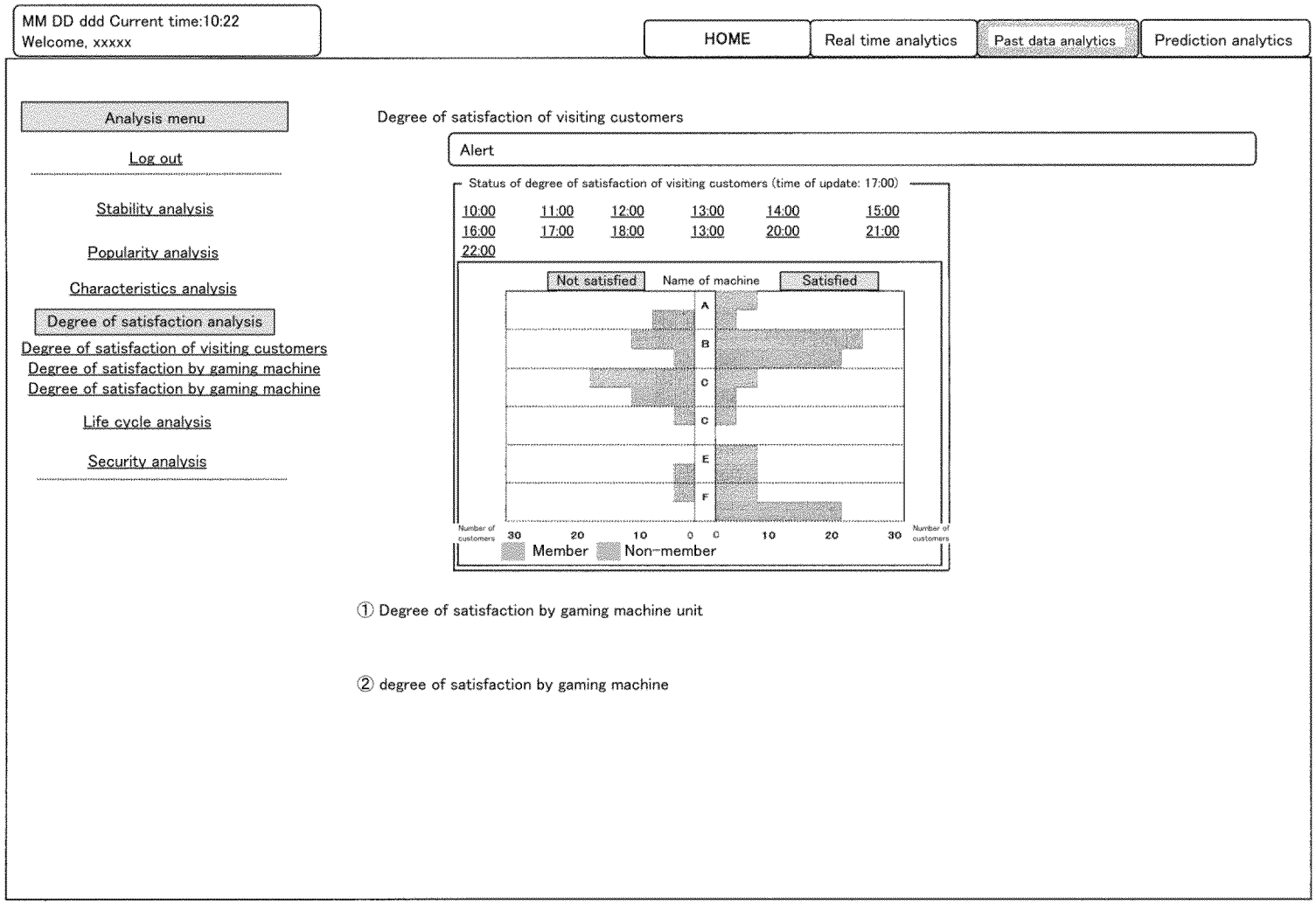
FIG. 29 is an explanatory view indicated on display screens of personal computers which produce display screen data based on the data obtained from the analysis processing as the analysis processing device of FIG. 1 and are installed in the gaming facility (not shown) and of cellular phones connected via the internet and the like. This explanatory view is a view indicated when "past analytics" is selected among "home", "real time analytics", "past analytics", and "prediction analytics" indicated on the display screen.

FIG. 29 is an explanatory view showing display screen data generated based on the data obtained from the analysis processing as analysis processing device shown in FIG. 1, and the data being displayed on the display screens of personal computers installed in the gaming facility and cellular phones connected via the internet and the like (not shown). This explanatory view is a figure displayed when "past analytics" is selected among "home", "real time analytics", and "past analytics" "prediction analytics" displayed on the display screen.

In addition, FIG. 29 shows a screen when, after "past analytics" is selected, "stability analytics", "popularity analysis", "satisfaction analytics", "life cycle analysis", and "security analytics" in the analytics menus are displayed, "satisfaction analytics" in these options is designated, and further "degree of satisfaction of visitors" is selected the options among "degree of satisfaction of visiting customers", "gaming apparatus the degree of satisfaction", and "degree of satisfaction of gaming machine". FIG. 29 indicates the degree of satisfaction by the non-member and member for each gaming apparatus (device type of machine) as a game unit in a bar graph. FIG. 29 displays the degree of satisfaction updated at 17 o'clock. The degrees of satisfaction of visiting customers at the times of update at 10 o'clock, 11 o'clock, 12 o'clock, 13 o'clock, 14 o'clock, 15 o'clock, 16 o'clock, 18 o'clock, 19 o'clock, 20 o'clock, 21 o'clock, and 22 o'clock can be displayed.

As for FIG. 30, while FIG. 29 shows a screen displayed when "the degree of satisfaction of visitors" is selected, FIG. 30(*a*) in this FIG. 30 shows "the degree of satisfaction of gaming apparatus", and FIG. 30(*b*) shows "the degree of satisfaction of gaming machine". The degree of satisfaction of gaming apparatus of FIG. 30(*a*) is the proportion of the degrees of satisfaction of the shop and the customers for each device type of the gaming machine included in the game unit, and is indicated in the form of a bar graph in the figure. In the degree of satisfaction by gaming machine of FIG. 30(*b*), as shown in the figure, a mark for each gaming machine is indicated on the layout of the gaming facility, and marks are indicated in varied modes for different degrees of satisfaction for each of the gaming machines.

Figure 31:
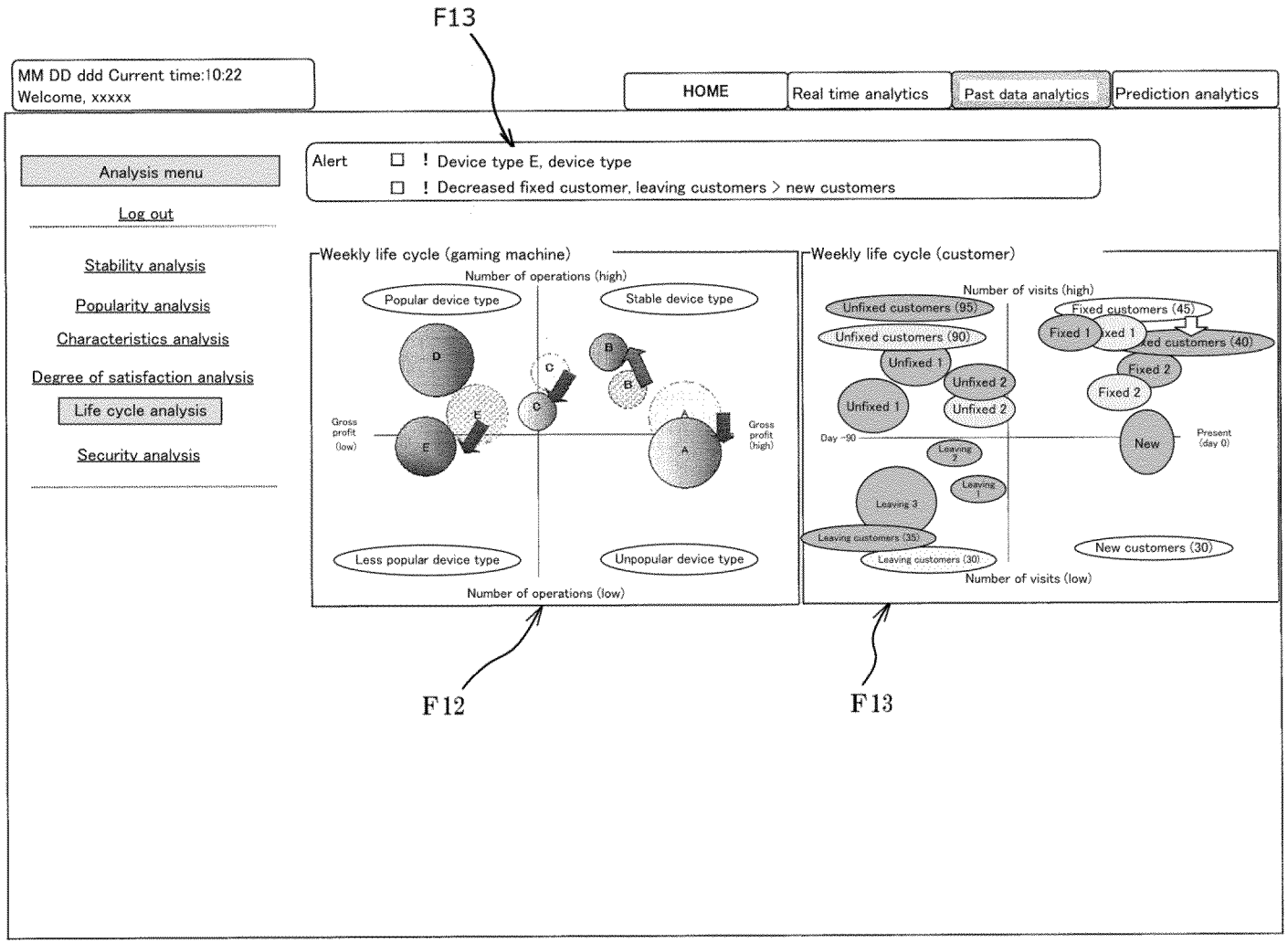
FIG. 31 is a view indicated when "past analytics" is selected as in FIG. 29.

FIG. 31 is a figure displayed when "past analytics" is selected as FIG. 29. In addition, in the case of FIG. 29, "stability analytics", "popularity analysis", "satisfaction analytics", "life cycle analysis", and "security analytics" in the analytics menus are displayed, and "satisfaction analytics" is designated in these options, but FIG. 119 shows the case where "life cycle analysis" is selected. The image of the table of F12 corresponds to FIG. 14 described later, while the image of the table of F13 corresponds to FIG. 12 described later.

Figure 32:
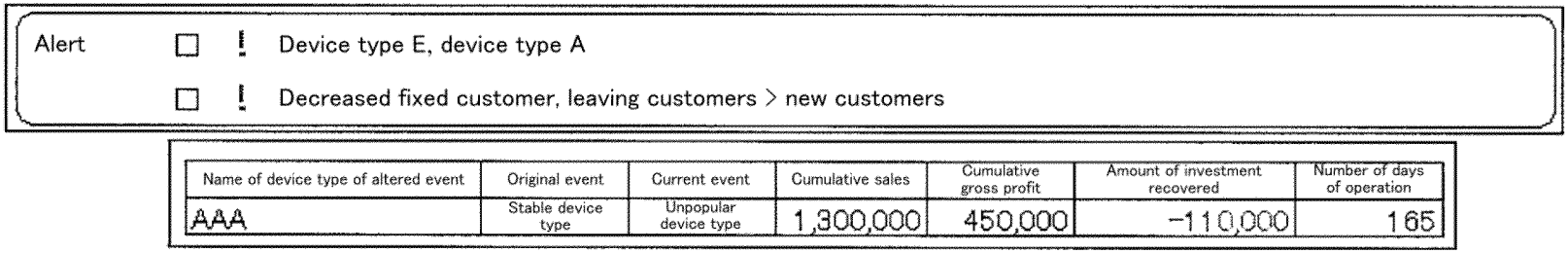
FIG. 32 is a view depicting a display image indicated by specifying the site of "Device type E Device type A" of an alert display portion of F13 in FIG. 31 with a pointer.

FIG. 32 is a figure which shows a display image displayed by designating the portion of "device type E device type A" of an alert indication portion of F13 of FIG. 31 with a pointer. When the portion of "device type E device type A" of the alert indication portion of the display screen which has been displayed in FIG. 31 is designated with the pointer, the details of the alert is displayed as in FIG. 32.

Figure 33:
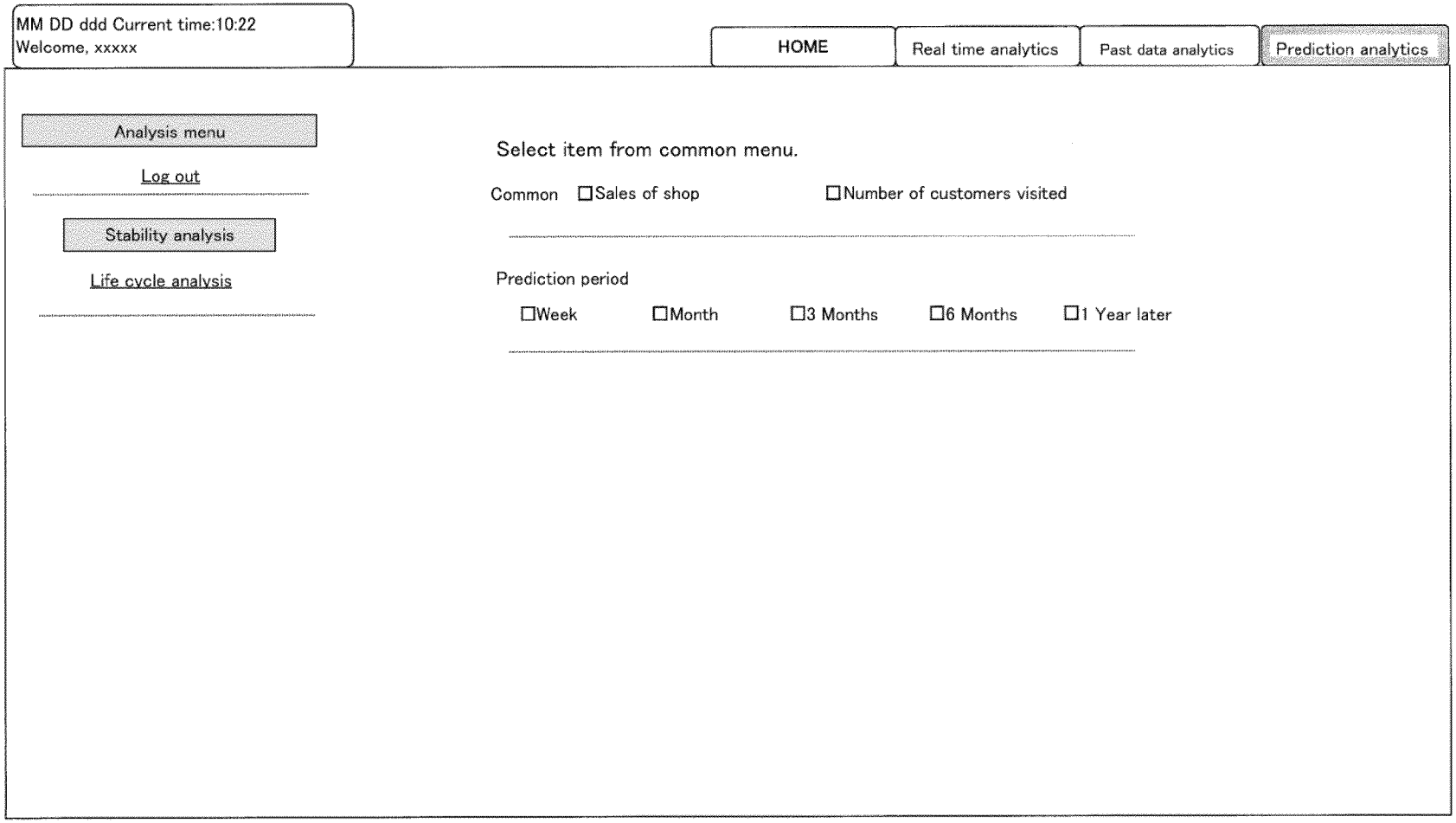
FIG. 33 is an explanatory view indicated on display screens of personal computers which produce display screen data based on the data obtained from the analysis processing as the analysis processing device of FIG. 1 and are installed in the gaming facility (not shown) and of cellular phones connected via the internet and the like. This explanatory view is a view indicated when "prediction analytics" is selected among "home", "real time analytics", "past analytics", and "prediction analytics" indicated on the display screen.

FIG. 33 is an explanatory view showing display screen data generated based on the data obtained from the analysis processing as analysis processing device shown in FIG. 1, and the data being displayed on the display screens of personal computers installed in the gaming facility and cellular phones connected via the internet and the like (not shown). This explanatory view is a figure displayed when "prediction analytics" is selected among "home", "real time analytics", and "past analytics", and "prediction analytics" displayed on the display screen. Predicted information in the future is displayed on this display screen. The displayed graph is so constituted that, depending on whether the user is authorized to see the graph identified by the ID and password inputted before opening the display screen, the controller of the server determines whether or not to indicate a designation button image of the graph to be displayed.

FIGS. 21 to 33 show explanation relating to the display screens outputted in the game playing information integration system of the present invention. In the present invention, visually unskilled managers or operators can make business judgment more accurately and easily by devising the forms of display of these display screens. More specifically, in a conventional manner, business judgments have been made based on the experience in the past while looking at a plurality of tables and the like represented by numerical values, but information can be indicated not by numerical values but by visual indication so that denominations can be changed in real time as described above. Such methods of changing the denominations of the game in real time allow easily changes of denominations in these days that game programs for the game units are changeable by downloading in most gaming facilities. Conversely, it can be thus said that the orientation of visitors, past data, and real-time information whether there are many high rollers have increased the possibility of performing controls to suitably change game programs executed on all gaming machine unit in the gaming facility and increase the operational state.

Figure 34:
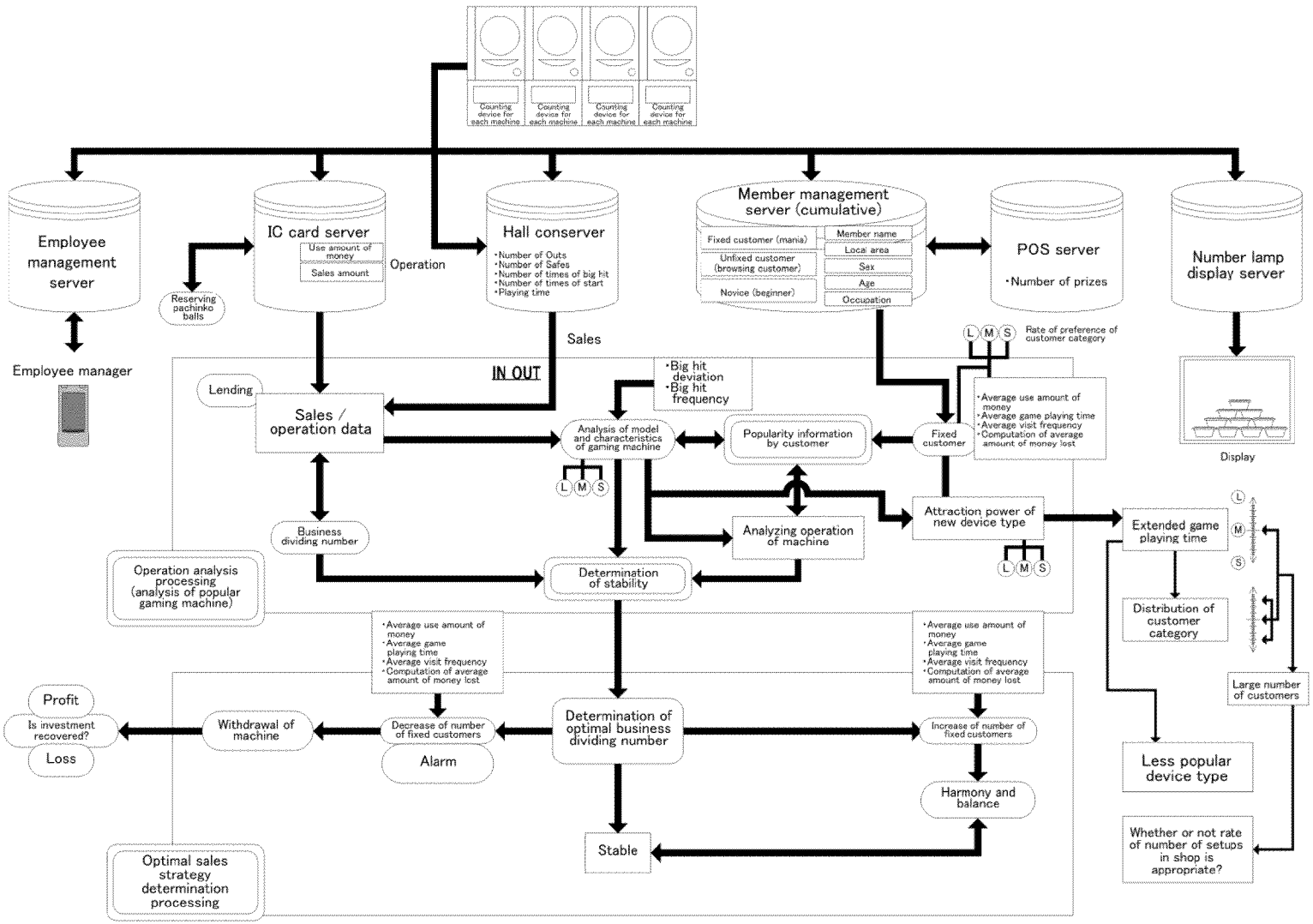
FIG. 34 is a configuration view conceptually showing the game information integration system in a case where the gaming unit is a pachinko gaming machine.

In addition, FIG. 34 is a configuration view conceptually showing the game information integration system in a case where the gaming unit is a pachinko gaming machine.

FIG. 1 is a functional flowchart showing an outline of a game playing information system in a casino.

A game playing information integration system IS includes: a plurality of gaming machine units 1001; an IC card server 2050; a hall conserver 2060; and a member management server 2070. The gaming machine 1001 corresponds to the gaming machine unit of the present invention. The IC card server 2050, the hall conserver 2060, and the member management server 2070 are equivalent to "servers" in the present invention. The servers in the present invention may be made of a plurality of devices, or alternatively, may be made of a single device. Therefore, the servers of the invention may be constituted by the hall conserver 2060 only in the present invention.

Data read from the gaming machine 1001 or the data inputted into the gaming machine 1001 are transmitted to any one of the IC card server 2050, hall conserver 2060 and member management server 2070. Examples of data transmitted include consumed-amount-of money data or sales amount data, reception time data, player identification information, the gaming machine unit identification information, number-of-consumptions data, number of payouts, number of games played data, number-of-prize-winning-time data, among others.

In the hall conserver 2060 based on data transmitted to the IC card server 2050, the hall conserver 2060 or the member management server 2070, (a) the game playing time per play in the gaming machine 1001, and (a') the visit frequency are computed (G1).

Moreover, in the hall conserver 2060 based on the data transmitted to the IC card server 2050, the hall conserver 2060 or the member management server 2070, (b) change in balance over time and (b') consumed amount of money per visit are calculated (G2).

Moreover, in the hall conserver 2060 based on data transmitted to the IC card server 2050, the hall conserver 2060 or the member management server 2070, (c) the operation time of the gaming machine 1001, and (c') the operability of the gaming machine 1001 are calculated (G3).

Furthermore, in the hall conserver 2060 based on data transmitted to the IC card server 2050, the hall conserver 2060 or the member management server 2070, (d) the profit of a shop side by the gaming machine 1001, and (d') the gross profit of the gaming machine 1001 are calculated (G4).

In the hall conserver 2060 based on (a) the game playing time per play, and (b) the change in balance over time, the degree of satisfaction of player for the gaming machine 1001 is computed, and (c) the operation time of the gaming machine 1001, and (d) based on the profit of a shop side by the gaming machine 1001, the degree of satisfaction of a shop side for the gaming machine 1001 is computed (G7). The computation of the degree of satisfaction will be described later.

In the hall conserver 2060, based on (a') visit frequency and (b') consumed amount of money per visit, the life cycle of the player is determined (G8). The determination of the life cycle of the player will be described later.

In the hall conserver 2060 based on (c') the operability of the gaming machine 1001, (d') the gross profit of the gaming machine 1001, the life cycle of the gaming machine 1001 is determined (G9). The life cycle of the gaming machine 1001 determination will be described later. The processings of G1 to G9 corresponds to the analysis processing.

The hall conserver 2060 performs, based on the degree of satisfaction for the gaming machine 1001 of the gaming facility and of the player, and the life cycle of the player, the life cycle of the gaming machine, a processing to indicate advice (H1 to H3). Examples of the processing to indicate advice include the withdrawal of machine (H1), the determination of optimal business dividing number (H2), and the adjustment of the in-shop installation number rate (H3).

Figure 2:
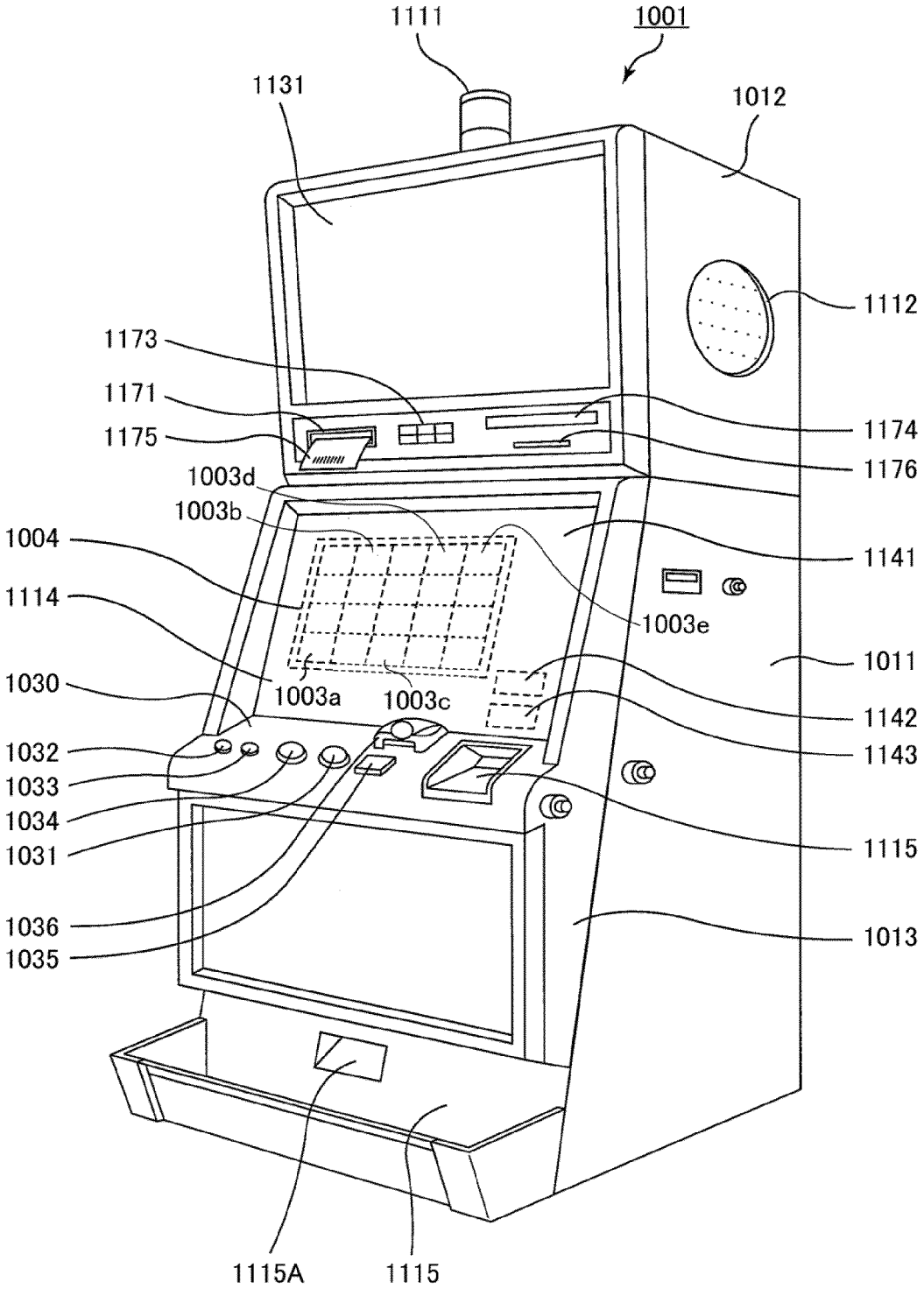
FIG. 2 is a network configuration view depicting one example of a game playing information integration system according to the embodiment.

FIG. 2 is a perspective view schematically showing an example of the slot machine shown in FIG. 1.

In the gaming machine 1001, as the game medium, coins, bills or electronic valuable information equivalent to these are used. Moreover, in this embodiment, tickets with bar codes described later are also used. It should be noted that the gaming media are not limited to these, and may be medals, tokens, or electronic moneys, for example.

The gaming machine 1001 includes a cabinet 1011, a top box 1012 placed on top of the cabinet 1011, and a main door 1013 provided on the front face of the cabinet 1011.

In the center of the main door 1013, a lower image display panel 1141 is provided. The lower image display panel 1141 is composed of a liquid crystal panel, constituting a display. The lower image display panel 1141 has a symbol display area 1004. In the symbol display area 1004, 1005 video reels 1003 (1003*a*, 1003*b*, 1003*c*, 1003*d*, 1003*e*) are indicated.

In this embodiment, the term "video reel" used here designates the representation of the operations of the rotation and stopping of a mechanical reel having the plurality of symbols drawn on its periphery by means of images. A symbol line including a plurality of (in this embodiment, 22) symbols determined in advance is assigned to each one of the video reels 1003.

In the symbol display area 1004, the symbol line assigned to each one of the video reels 1003 is scrolled respectively, and stops after a predetermined time has elapsed. As a result, a portion (in this embodiment, continuous 4 symbols) of each symbol line is indicated to the player.

In the symbol display area 1004, one symbol is indicated in each of four areas: upper row, central upper row, central lower row and lower row with correspondence to each one of the video reels 1003. That is, in the symbol display area 1004, 5 rows×4=20 symbols are indicated.

In this embodiment, any one of the above four areas is selected with correspondence to each one of the video reels 1003, and the lines formed by connecting the areas are used as paylines.

It should be noted that specific modes of the paylines can be optionally employed, and for example, straight lines, V-shaped, curved lines or the like formed by connecting the areas of the central upper row with correspondence to each one of the video reels 1003 can be employed. Moreover, the number of paylines employed can be also optional, for example, 30.

Moreover, the lower image display panel 1141 has a number-of-credits display area 1142 and a number-of-payouts display area 1143. In the number-of-credits display area 1142 the number of coins which are owned by the player and deposited within the gaming machine 1001 (hereinafter referred to as the number of credits) is indicated. Moreover, in the number-of-payouts display area 1143, the number of coins paid out to the player when an award is achieved (hereinafter referred to as number of payouts) is indicated.

Moreover, in the lower image display panel 1141 a touch panel 1114 is built in. The player can input various instructions by touching the lower image display panel 1141.

Below the lower image display panel 1141, various devices which are the targets of operations performed by the player, are disposed, including various buttons disposed on a control panel 1030.

A spin button 1031 is used in initiating scrolling of the symbol line of each of the video reels 1003. A change button 1032 is used for requesting exchange to an attendant of the gaming facility. A CASH OUT button 1033 is used to pay out coins deposited within the gaming machine 1001 onto a coin tray 1015.

A 1-BET button 1034 and a maximum BET button 1035 are for determining the number of coins used for the game from coins deposited within the gaming machine 1001 (hereinafter referred to as BET number). The 1-BET button 1034 is used in determining the above BET number by the unit of 1.

The maximum BET button 1035 is used in setting the above BET number to a specified upper limit number.

A coin slot 1036 is provided to receive coins. A bill identifier 1115 is provided to receive bills. The bill identifier 1115 selects whether a bill is valid, and receives valid bills into the cabinet 1011. It should be noted that the bill identifier 1115 may be constituted to allow reading of a ticket 1175 with a bar code described later.

On the front face of the top box 1012, an upper image display panel 1131 is provided. The upper image display panel 1131 is composed of a liquid crystal panel, and constituting a display. Images concerning stage effects, images showing introduction of the contents of the game and descriptions of rules are indicated on the upper image display panel 1131. Moreover, on the top box 1012, a speaker 1112 and a lamp 1111 are provided. In the gaming machine 1001, stage effects are performed by means of indication of images, output of sounds and output of light.

Below the upper image display panel 1131, a ticket printer 1171, a card slot 1176, a data display device 1174, and a key pad 1173 are provided.

The ticket printer 1171 prints a bar code encoding the number of credits, date, the identification number of the gaming machine 1001 and other data on a ticket, and outputs the ticket as the ticket 1175 with a bar code. The player has the gaming machine read the ticket 1175 with a bar code to perform the game, and can exchange the ticket 1175 with a bar code to bills at a predetermined place in the gaming facility (for example, a cashier in a casino).

The card slot 1176 is for inserting a card in which predetermined data are stored. For example, data for identifying the player (player identification information) and data relating to the history of the game played by the player are stored on the card.

Data are read from and written in the card inserted into the card slot 1176 by a card reader 1172 described later. It should be noted that data equivalent to coins, bills or credits may be stored on the card.

The data display device 1174 includes a fluorescent display, light-emitting diode and the like, and is for indicating, for example, the data read by the card reader 1172 and the data inputted by the player via the key pad 1173. The key pad 1173 is for inputting instructions and data relating to issuing tickets and the like.

Figure 3:
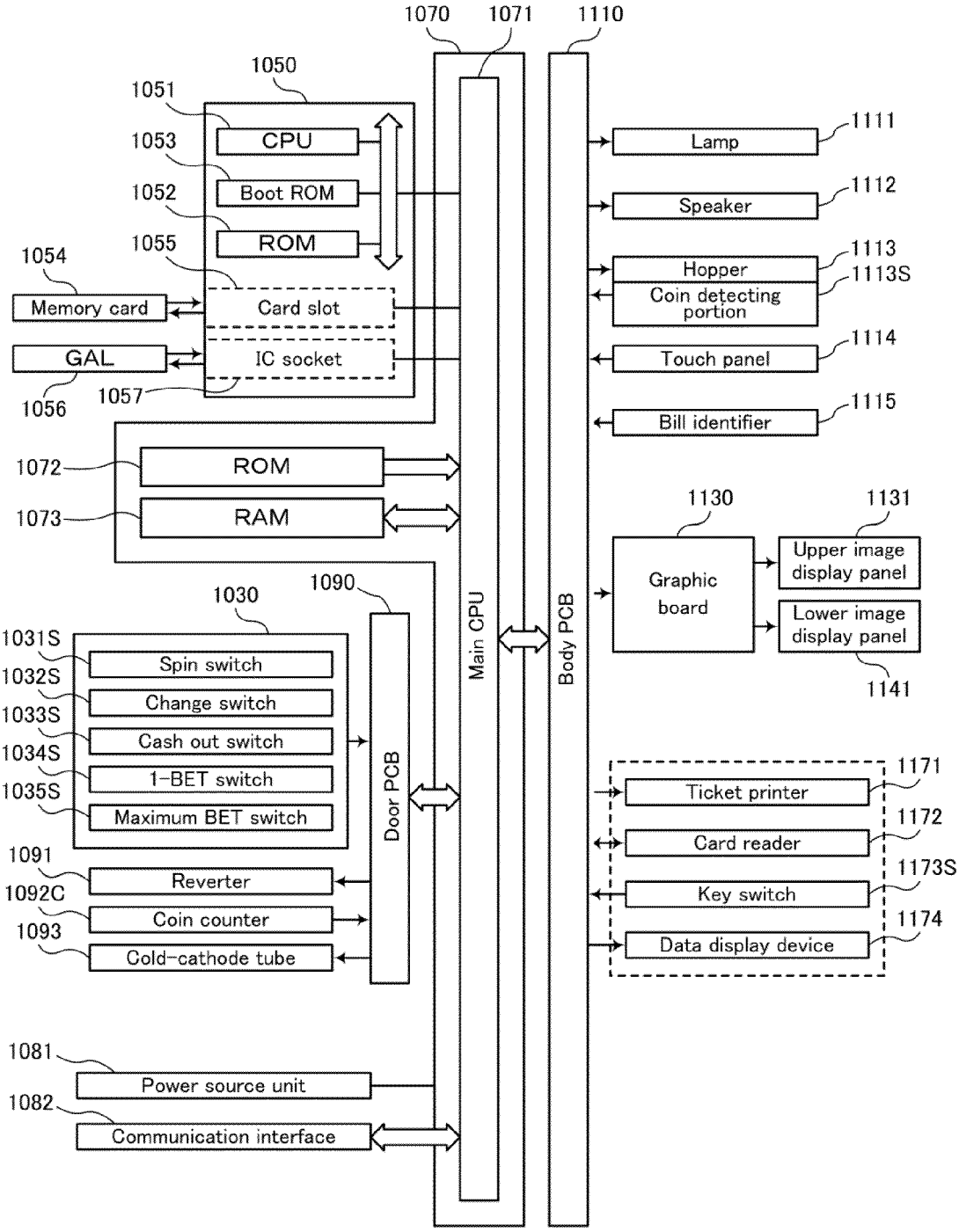
FIG. 3 is a block diagram depicting an internal structure of a slot machine shown in FIG. 1.

FIG. 3 is a block diagram depicting an internal structure of a slot machine shown in FIG. 1.

Next, with reference to FIG. 3, the constitution of circuits provided in the gaming machine 1 will be described.

FIG. 3 is a block diagram depicting an internal structure of a gaming machine according to an embodiment of the present invention.

A gaming board 1050 is provided with the CPU 1051, the ROM 1052 and the boot ROM 1053 connected to each other via the internal bus, a card slot 1055 corresponding to a memory card 1054, and an IC socket 1057 corresponding to a (Generic Array Logic) 1056.

The memory card 1054 includes a non-volatile memory, and stores game programs and game system programs. The game programs contain the lottery program, and programs for performing stage effects produced by means of images and sound programs relating to the progress of the game. Moreover, the above game programs contain the data for defining the constitution of a symbol line assigned to each of the video reels 1003.

The lottery program is a program to determine a stop planning symbol of each of the video reels 1003 by a lottery. The stop planning symbol is the data to determine four symbols indicated by the symbol display area 1004 in the twenty two symbols constituting the symbol line. In the gaming machine 1001 of this embodiment, the symbol indicated in a predetermined area (for example, upper row area) in four areas corresponding to each of the video reels 1003 of the symbol display area 1004 is determined as the stop planning symbol.

Symbol determination data is contained in the above the lottery program. The symbol determination data is the data for defining random number values so that each of the twenty two symbols (code number "00" to "21") constituting the symbol line is determined depending on each video reel 1003 with an equal probability (i.e., 1/22).

The probability that each of the twenty two symbols is determined is basically equal. However, the numbers of various symbols contained in the twenty two symbols are different, and therefore the probabilities that various symbols are determined respectively are different (i.e., weights occur). For example, one piece of the symbol "JACKPOT7" is contained in the symbol line of a first video reel 1003*a*, while seven pieces of the symbol "ORANGE" is contained therein. Therefore, the former is determined with the probability of "1/22", while the latter is determined with the probability of "7/22".

It should be noted that in this embodiment data is defined so that the numbers of symbols constituting the symbol lines of the video reels 1003 are the same, but the numbers of symbols constituting the symbol lines may be different, depending on the video reels 1003. For example, the symbol line of the first video reel 1003*a* may be constituted by twenty two symbols, while the symbol line of a second video reel 1003*b* may be constituted by thirty symbols. Accordingly, the degree of freedom in setting the probabilities that various symbols are determined depending on each of the video reels 1003 is increased.

Moreover, the card slot 1055 is constituted in such a manner that the memory card 1054 can be inserted and removed, and is connected to the motherboard 1070 by an IDE bus.

A GAL 1056 is a type of a PLD (Programmable Logic Device) having an OR fixed array structure. The GAL 1056 has input ports and output ports. When an input port receives a predetermined input, corresponding data is outputted through an output port. The GAL 1056 has input ports and output ports. When an input port receives a predetermined input, corresponding data is outputted through an output port.

Further, the IC socket 1057 is structured to allow insertion/removal of the GAL 1056. The IC socket 1057 is connected to the motherboard 1070 through a PCI bus. The content of a game to be run at the gaming machine 1001 can be changed by replacing a memory card 1054 with another one with another program written thereon, or replacing the program written onto the memory card 1054 with another program.

A CPU 1051, a ROM 1052 and a boot ROM 1053 connected each other to via an internal bus are connected to a motherboard 1070 via a PCI bus. The PCI bus performs signal transfer between the motherboard 1070 and the gaming board 1050, and supplies power from the motherboard 1070 to the gaming board 1050.

An authentication program is stored in the ROM 1052. An auxiliary program, a program (boot code) for the CPU 1051 to start the auxiliary program and the like are stored in the boot ROM 1053.

The authentication program is a program for authenticating game programs and game system programs (alteration check program). The auxiliary authentication program is a program for authenticating the above authentication program. The authentication program and auxiliary authentication program are described according to a procedure for performing authentication that target programs are not altered (authentication procedure).

The motherboard 1070 is provided with a main CPU 1071, a ROM 1072, a RAM 1073, and a communication interface 1082.

The ROM 1072 includes memory devices of flash memory and the like, BIOS and the like executed by the main CPU 1071 programs and permanent data are stored. When BIOS is executed by the main CPU 1071, the initialization processing of predetermined peripheral units is performed. Moreover, an inclusion processing of the game program and game system program stored in the memory card 1054 via the gaming board 1050 is initiated. The gaming machine unit identification information assigned individually for each gaming machine 1001 is stored in the ROM 1072.

The RAM 1073 stores data and programs utilized when the main CPU 1071 operates. For example, when the capturing processing of the game program, the game system program, and the authentication program mentioned above is performed, these can be stored in the RAM 1073. Further, the RAM 1073 is provided with an operation region for executing the above programs. Examples of the operation region is a region for storing number-of-games-played, bet number, credit number, and a region for storing a symbol determined by a lottery (code number).

The main CPU 1071 performs data communication through the communication interface 1082 with the IC card server 2050, hall conserver 2060, and member management server 2070. The main CPU 1071 outputs the player identification information read by the card reader 1172. The main CPU 1071 and the card reader 1172 function as player identification information reading device of the present invention. Moreover, the main CPU 1071 function as number-of-consumptions data output device and number-of-payouts output device. Furthermore, the main CPU 1071 outputs the gaming machine unit identification information to the IC card server 2050, the hall conserver 2060 and the member management server 2070 in performing data communication with the IC card server 2050, the hall conserver 2060 and the member management server 2070. Moreover, the motherboard 1070 is connected to a later-described door PCB (Printed Circuit Board) 1090 and a main body PCB 1110 via USBs. Further, the motherboard 1070 is connected to a power supply unit 1081.

When power is supplied from the power supply unit 1081 to the motherboard 1070, the main CPU 1071 of the motherboard 1070 is booted, and power is supplied to the gaming board 1050 via the PCI bus and the CPU 1051 is booted.

The door PCB 1090 and the main body PCB 1110 are connected to an input device such as a switch and a sensor, and peripheral devices whose operations are controlled by the main CPU 1071.

The door PCB 1090 is connected to the control panel 1030, a reverter 1091, a coin counter 1092C and a cold cathode tube 1093.

The control panel 1030 is provided with a spin switch 10315, a change switch 1032S, a CASHOUT switch 1033S, a 1-bet switch 1034S, and a maximum bet switch 10355, respectively corresponding to the buttons described above. Each switch detects that it is pushed by a player, and outputs a signal to the main CPU 1071.

The coin counter 1092C sorts whether a coin inserted into the coin slot 1036 is valid in terms of materials, shapes and other factors, and when it detects a valid coin, outputs a signal to the main CPU 1071. Moreover, an invalid coin is discharged from a coin payout exit 1015A.

The reverter 1091 operates based on a control signal outputted from the main CPU 1071, and distributes valid coins determined by the coin counter 1092C into a hopper 1113 or a not-shown cash box. When the hopper 1113 is not full of coins, a valid coin is distributed there. On the other hand, when the hopper 1113 is filled with coins, a valid coin is distributed into the cash box.

The cold cathode tube 1093 functions as a backlight provided at a back of an upper image display panel 1131 and a lower image display panel 1141. The cold cathode tube 1093 lights based on a control signal from the main CPU 1071.

The main body PCB 1110 is connected to the lamp 1111, the speaker 1112, hopper 1113, a coin detecting portion 1113S, the touch panel 1114, the bill identifier 1115, a graphic board 1130, the ticket printer 1171, the card reader 1172, a key switch 1173S and the data display device 1174.

A lamp 1111 lights up based on a control signal outputted from a main CPU 1071. The speaker 1112 outputs a sound such as BGM based on the control signal outputted from the main CPU 1071.

The hopper 1113 operates based on a control signal outputted from the main CPU 1071, and pays out the number of coins determined to be paid out to a coin tray 1015 through the coin payout exit 1015A. The coin detection unit 1113S detects a coin to be paid out from the hopper 1113, and outputs a signal to the main CPU 1071.

The touch panel 1114 detects a position touched on the lower image display panel by a player with a finger, and outputs a signal corresponding to the position detected to the main CPU 1071. The bill identifier 1115 outputs, when it accepts a valise bill, a signal depending to the main CPU 1071 on the amount of the bill.

The graphic board 1130 controls display of an image to be displayed on the upper image display panel 1131, and the lower image display panel 1141, based on a control signal outputted from the main CPU 1071. Five pieces of the video reels 1003 are indicated in the symbol display area 1004 of the lower image display panel 1141, the operations of scroll of the symbol line on each of the video reels 1003 and the stopping of the same are indicated. The graphic board 1130 has a VDP which generates image data, a video RAM which stores the image data generated by the VDP, and the like. The number of credits stored in the RAM 1073 is indicated in the number-of-credits display area 1142 of the lower image display panel 1141. The number of coins paid out is indicated in the number-of-payouts display area 1143 of the lower image display panel 1141.

Moreover, the graphic board 1130 has a VDP (Video Display Processor) which generates image data, a video RAM which stores the image data generated by the VDP, and the like. Note that the image data utilized when image data is generated by the VDP is included in a game program read out from the memory card 1054 and stored in the RAM 1073.

The ticket printer 1171 prints on a ticket a bar code representative of coded data such as credit number, date, identification number of the gaming machine 1001, etc., based on a control signal outputted from the main CPU 1071, and outputs it as a bar coded ticket 1175.

The card reader 1172 reads data stored in a card inserted into the card slot 1176 and transmits the data to the main CPU 1071, and writes data based on a control signal from the main CPU 1071. Player identification information is contained in the data stored in the card.

The key switch 1173S is provided on the key pad 1173. When the key pad 1173 is operated by the player, the key switch 1173S outputs a predetermined signal to the main CPU 1071.

The data display device 1174 indicates the data read by the card reader 1172 and the data inputted by the player via the key pad 1173, based on a control signal outputted from the main CPU 1071.

Figure 4:
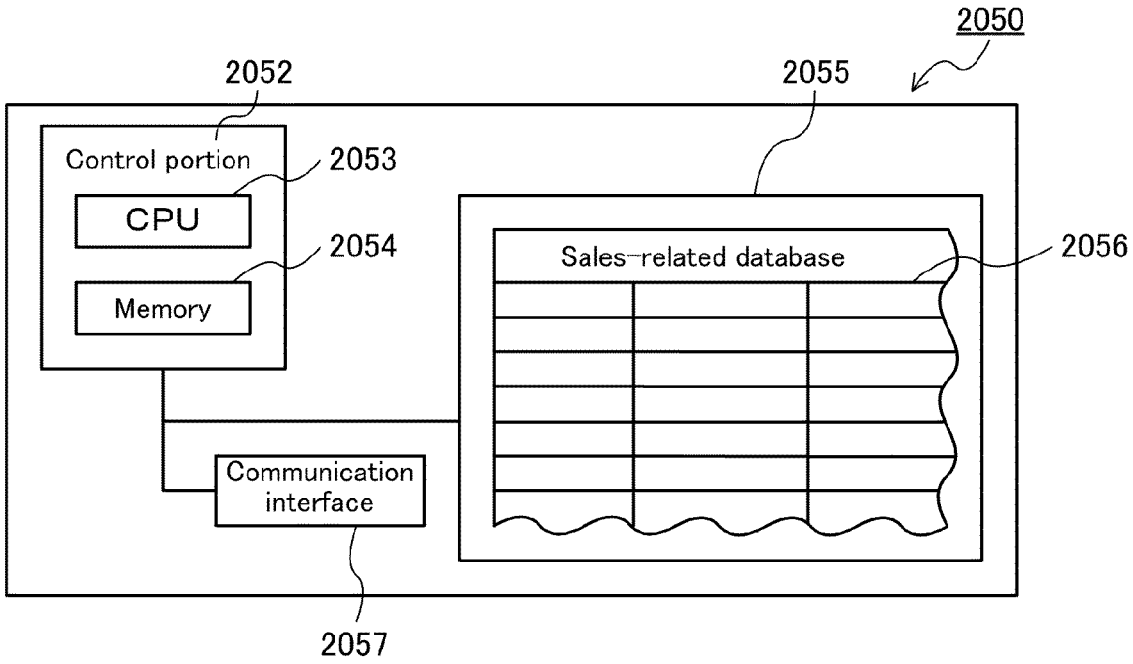
FIG. 4 is a block diagram depicting an internal structure of the IC card server shown in FIG. 1.

FIG. 4 is a block diagram depicting an internal structure of the IC card server shown in FIG. 1.

The IC card server 2050 is provided with a control portion 2052, a hard disk 2055, a communication interface 2057, and the control portion 2052 is provided with a CPU 2053 and a memory 2054. The hard disk 2055 stores various programs and data, while the control portion 2052 reads and executes these programs, and performs various processings. The hard disk 2055 stores a sales-related database 2056.

In the sales-related database 2056, for example, consumed-amount-of money data or sales amount data, reception time data, player identification information, gaming machine unit identification information, flag indicating play of game in progress and the like are contained in association with each other. Further in the hard disk 2055 of the IC card server 2050, data relating to credits to the casino or data relating to member point may be stored in association with player identification information.

Data storage device further stores use amount data outputted from use-amount-of-money data output device in association with reception time data relating to the time of receipt of data, player identification information, and gaming machine unit identification information.

Figure 5:
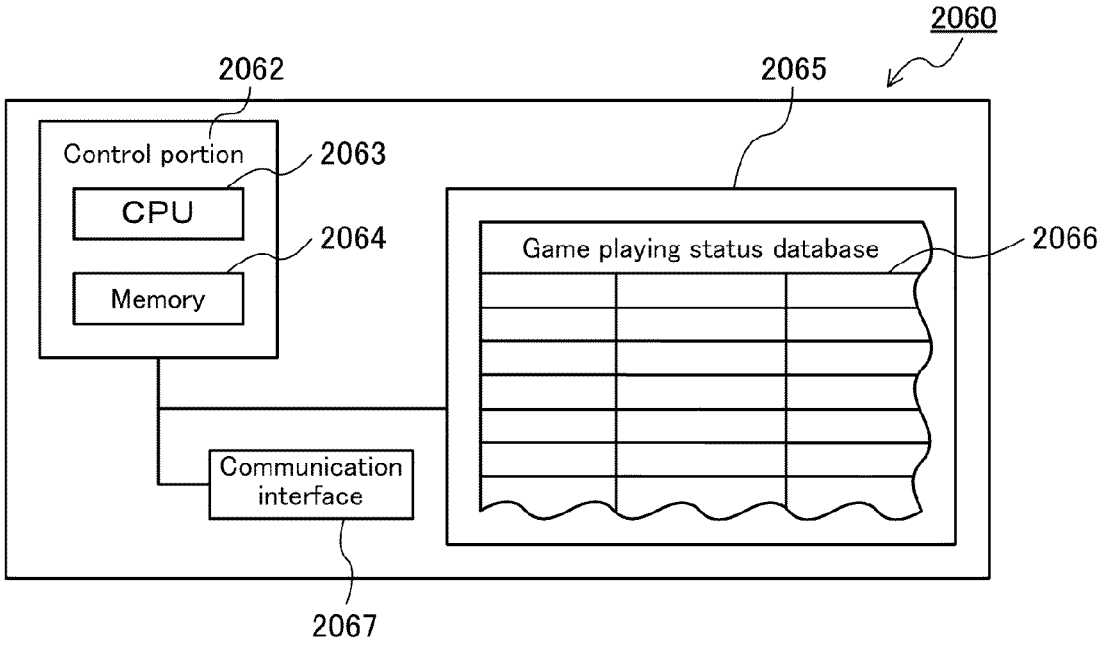
FIG. 5 is a block diagram depicting an internal structure of the hall conserver shown in FIG. 1.

FIG. 5 is a block diagram depicting an internal structure of the hall conserver shown in FIG. 1.

The hall conserver 2060 is provided with a control portion 2062, a hard disk 2065, and a communication interface 2067, and the control portion 2062 is provided with a CPU 2063 and a memory 2064. The hard disk 2065 stores various programs and data. The control portion 2062 reads and executes these programs, and performs various processings.

The hard disk 2065 stores the game playing status database 2066. In the game playing status database 2066 for example, number-of-consumptions data, number of payouts, number of games played data, number-of-prize-winning-time data, game information data and other data outputted from the gaming machine 1001 or data produced by processing the data, reception time data, player identification information, gaming machine unit identification information, flag indicating play of game in progress and event flag are contained in association with each other. Furthermore, in the game playing status database in association with the gaming machine unit identification information, for example, device type data, model data, mount identification information, new device type flag, event flag and the like are contained.

Furthermore, the hard disk 2065 stores data for determination of degree of satisfaction, data for determination of customer life cycle, data for determination of life cycle of gaming machine.

Data storage device stores each of the number-of-consumptions data outputted from number-of-consumptions data output device and the number of payouts outputted from number-of-payouts output device in association with reception time data relating to the time of receipt of data, player identification information, and the gaming machine unit identification information.

Moreover, the hard disk 2065 stores a correlation database. In the correlation database, as player-side time-related data, (a) game playing time on the gaming machine per play (per player), and (a') visit frequency of player are stored; and as player-side balance-related data, (b) change in balance over time, and (b') consumed amount of money per visit are store; as gaming facility-side time-related data, (c) operation time of gaming machine; and (c') operability of gaming machine are store; as gaming facility-side balance related data, (d) profit on the shop side by gaming machine, (d') gross profit by gaming machine are stored. These data are stored in association with the gaming machine unit identification information.

Further, the hard disk 2065 stores a determination result database. In the determination result database, data indicating the degree of satisfaction of the player and of gaming facility relative to the gaming machine, data relating to the life cycle of player, data relating to the life cycle of the gaming machine are stored. These data are stored in association with the gaming machine unit identification information.

Moreover, by the optimal sales strategy determination processing described later, for example, when advice such as withdrawal of machine, determination of optimal business dividing number, adjustment of in-shop installation number rate is indicated, data relating to the advice are stored. The data is also stored in association with the gaming machine unit identification information. The hard disk 2065 functions as data storage device. The control portion 2062 functions as analysis processing device.

Figure 6:
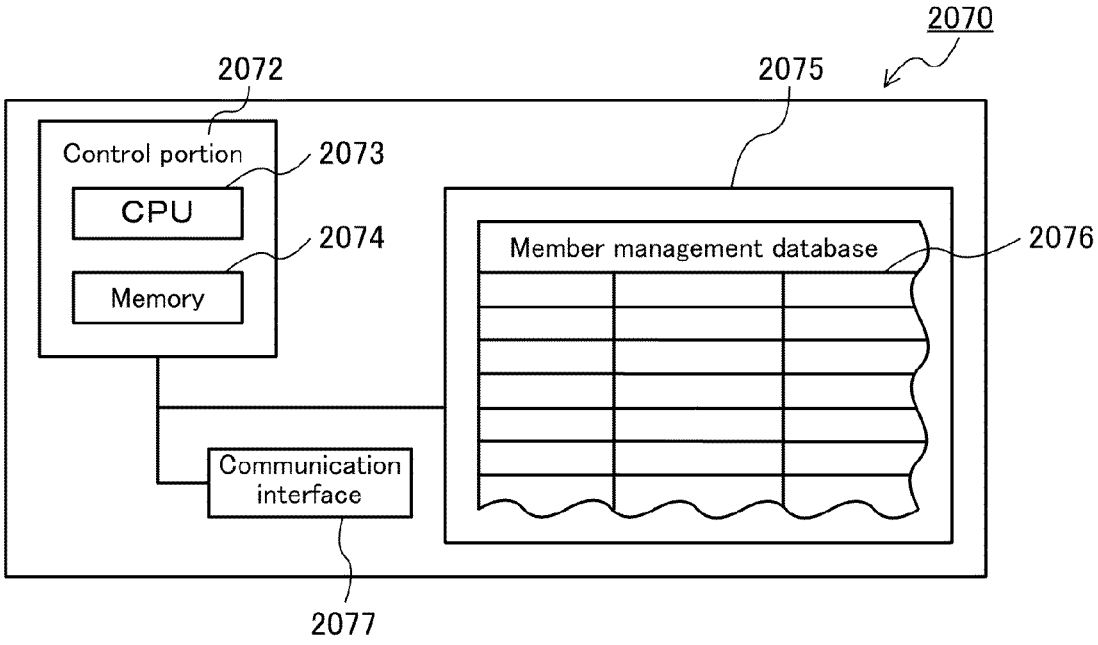
FIG. 6 is a block diagram depicting an internal structure of a member management server shown in FIG. 1.

FIG. 6 is a block diagram depicting an internal structure of the member management server shown in FIG. 1.

The member management server 2070 is provided with a control portion 2072, a hard disk 2075, and a communication interface 2077, and the control portion 2072 is provided with a CPU 2073 and a memory 2074. The hard disk 2075 stores various programs and data, the control portion 2072 reads and executes these programs, and performs various processings.

The hard disk 2075 stores a member management database 2076. In the member management database 2076, for example, player identification information, customer category data, member name, local area, sex, age, occupation and other data of the player are stored in association with each other. Moreover, the member management database 2076, in association with player identification information, stores average use time, average game playing time, average visit frequency, and average amount of money lost or the like to which the player identification information is assigned.

Data storage device, further, in association with player identification information, stores player data related to a player to which the player identification information is assigned. In addition, the data storage device stores customer category data indicating which one of the customer categories classified in plurality the player to which the player identification information is assigned falls under, in association with player identification information.

FIG. 7 is an explanatory view depicting one example of a game playing status database stored in the hall conserver shown in FIG. 1.

In the game playing status database for example, number-of-consumptions data, number of payouts, game initiation data, liquidation data, reception time data, player identification information, the gaming machine unit identification information, flag indicating play of game in progress, game playing time data and the like are contained in association with each other. Various data transmitted from the gaming machine 1001 to the hall conserver 2060 are stored in the game playing status database.

FIG. 8 is an explanatory view depicting one example of a correlation database stored in the hall conserver shown in FIG. 1.

The data produced by processing data contained in the game playing status database is stored in the correlation database. The game playing status database contains a database for computation of the degree of satisfaction, a database for evaluation of the life cycle of player, and a database for evaluation of the life cycle of gaming machine.

FIG. 8(*a*) is a database for computation of the degree of satisfaction. The database for computation of the degree of satisfaction stores, in association with the gaming machine unit identification information, by date, (a) a game playing period per one time of visit of each player; (b) a change with an elapse of time of a balance of the player per visit; (c) operation time of the gaming machine; and (d) profit of a shop side by the gaming machine. That is, based on the data stored in the game playing status database shown in FIG. 7, the control portion 2062 generates data related to items (a) to (d), and stored in the database for computation of the degree of satisfaction. This processing corresponds to the processing (A).

FIG. 8(*b*) is a database for evaluation of the life cycle of player. The database for evaluation of the life cycle of player stores, in association with the player identification information, (a') visit frequency, and (b') consumed amount of money per visit. That is, based on the data stored in the game playing status database shown in FIG. 7, the control portion 2062 generates data relating to (a') and (b'), and stores the data in the database for evaluation of the life cycle of player. This processing corresponds to the processing (D).

FIG. 8(*c*) is a database for evaluation of the life cycle of gaming machine. The database for evaluation of the life cycle of gaming machine stores in association with the gaming machine unit identification information, (c') operability, and (d') gross profit. That is, based on the data stored in the game playing status database shown in FIG. 7, the control portion 2062 generates data relating to (c') and (d'), and stores in the database for evaluation of the life cycle of gaming machine. This process corresponds to the processing (I).

FIG. 9 is an explanatory view depicting an example of the determination result database stored in the hall conserver shown in FIG. 1.

Data produced by processing data contained in the correlation database is stored in the determination result database. The determination result database contains a database relating to the degree of satisfaction, a database relating to evaluation dots of the life cycle of player, and a database relating to evaluation dots of the life cycle of gaming machine.

FIG. 9(*a*) is a database relating to the degree of satisfaction. A database relating to the degree of satisfaction stores in association with the gaming machine unit identification information, by date, the degree of satisfaction of player and degree of satisfaction of gaming facility.

FIG. 9(*b*) is a database relating to evaluation dots of the life cycle of player. The database relating to evaluation dots of the life cycle of player stores in association with the player identification information, by date, visit frequency and consumed-amount-of money data, which serve as coordinates of the evaluation dots of life cycle of player.

FIG. 9(*c*) is a database relating to evaluation dots of the life cycle of gaming machine. The database relating to evaluation dots of the life cycle of gaming machine stores in association with the gaming machine unit identification information, by date, the operability and gross profit, which serve as coordinates of evaluation dots of life cycle of gaming machine.

Next, the degree of satisfaction, life cycle of player, and the life cycle of the gaming machine will be described.

Figure 10:
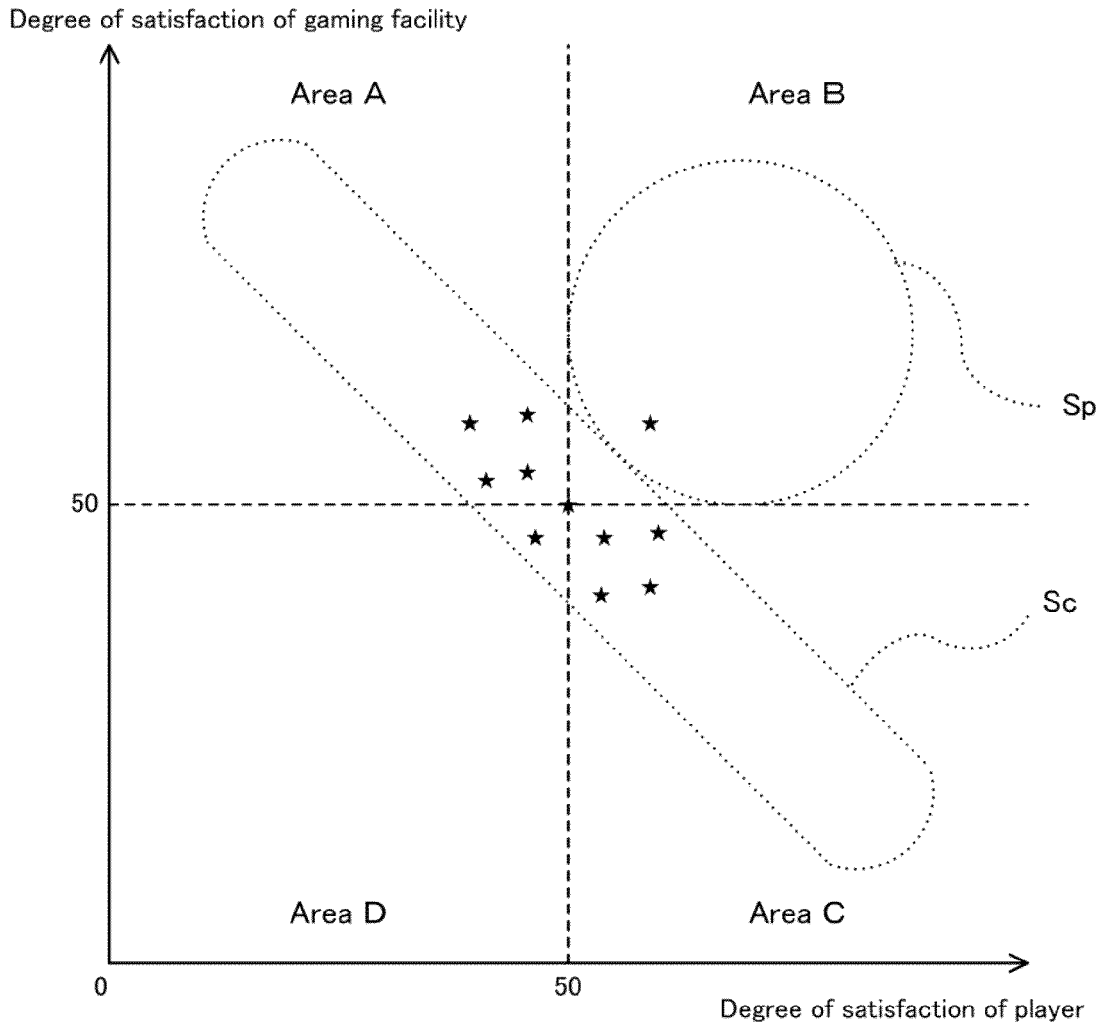
FIG. 10 is a view for explaining a relationship between a degree of satisfaction of a player and a degree of satisfaction of gaming facility.

FIG. 10 is a view depicting a relationship between a degree of satisfaction of a player and a degree of satisfaction of gaming facility.

In the figure, the vertical axis indicates the degree of satisfaction of gaming facility, and the horizontal axis indicates the degree of satisfaction of player. In FIG. 10, the degree of the player's satisfaction and the degree of satisfaction of gaming machine are expressed by means of deviation values. An average value of the degrees of satisfaction of player and gaming machines is 50.

In this plane, dots are plotted on a coordinate system defining the degrees of satisfaction of gaming facility and player relative to the gaming machine (hereinafter, evaluation dots of the degrees of satisfaction). A star mark indicates the evaluation dots of degrees of satisfaction as to one gaming machine. Therefore, in FIG. 10, the evaluation dots of degrees of satisfaction as to 11 gaming machines are plotted.

The plane shown in FIG. 10 is classified into four areas while the average value is defined as a reference.

Area A is an area in which the degree of satisfaction of gaming machine is high and the degree of player's satisfaction is low.

Area B is an area in which the degree of satisfaction of gaming machine is high and the degree of player's satisfaction is also high.

Area C is an area in which the degree of satisfaction of gaming machine is low and the degree of player's satisfaction is high.

Area D is an area in which the degree of satisfaction of gaming machine is low and the degree of player's satisfaction is low.

As described above, according to a relationship between the degree of player's satisfaction and the degree of satisfaction on the shop side, which conventionally has been thought to be present in common knowledge, the degrees of satisfaction of player and gaming machine are determined depending on balance, and a tradeoff relationship is established.

On the other hand, in the present invention, more realistic analysis is performed as the degrees of satisfaction of player and gaming machine. The elements employed for analysis of the degrees of satisfaction in the present invention are at least four elements that follow.

(a) Game playing period of time per one time of each player in gaming machine unit;

(b) change with an elapse of time as to balance of the player in game playing period of time;

(c) operation time of game machine unit; and (d) profit on the shop side by gaming machine unit.

The items (a) and (b) are employed for analysis of the degree of the player's satisfaction. The items (c) and (d) are employed for analysis of the degree of satisfaction of gaming machine.

(a) Game Playing Period at One Time of Each Player in Gaming Machine Unit

In a case where the game playing time at the gaming machine unit is long, there is a high possibility that a player enjoys the play of game at that gaming machine. This is because, if the player does not have interest therein, there is a high possibility that game will be played at another gaming machine. Namely, even if a slight loss takes place with a player, the player does not move to another gaming machine, and thus, it is thought that the player satisfies a current gaming machine. Therefore, in the present invention, the data related to the item (a) is employed for computation of the degree of the player's satisfaction.

(b) Change with Elapse of Time in Balance of the Player in Game Playing Period of Time The amount of balance itself influences the degree of the player's satisfaction, as indicated by the abovementioned tradeoff relationship. It is to be noted that in the present invention, weighting is performed for the amount of balances so that the balance in the latter half of game playing period has greater influence relative to the degree of the player's satisfaction than that in the first half of gaming machine period, and then, computation of the degree of the player satisfaction is performed.

The present invention focuses on timing with which a player stops the play of game. That is, the timing for the player to stop the play of game corresponds to any one of three patterns of 1. No money to play, 2. Big hit (Bonus is won), and 3. Interest in gaming machine is lost.

1. No money to play means that there is a high possibility that a loss takes place at least in the latter half of game playing period, and there is also a possibility that the player is not satisfied with the gaming machine. Of course, if the game playing time is long, even if no money to play arises, there is also a possibility that the player is satisfied with the gaming machine. Therefore, in the present invention, computation of the degree of the player's satisfaction is performed by employing the item (a) as well as the item (b).

2. Big hit means that there is a high possibility that profit takes place at least in the latter half of game playing period, and there is a possibility that the player is satisfied with the gaming machine.

3. Losing interest in gaming machine means that there is a high possibility that profit does not occur in the latter half of game playing machine, and there is a possibility that the player does not satisfied with the gaming machine.

The weighting method mentioned above is not limited in particular, and for example, the following methods can be employed.

(Weighting Method 1)

Among the variation trend continuation periods included in the game playing period, the later a balance in a variation trend continuation period takes place, the greater an influence is imparted to a degree of satisfaction of the player.

In general, even if an absolute value between the balance of the last variable trend continuation period in game playing period and the balance of the second last variation trend continuation period is the same, a player is prone to feel a loss in balance if the balance of the second last variation trend continuation period is positive and the balance of the last variation trend continuation period is negative. Conversely, a player is prone to feel a profit (no loss) if the balance of the second last variation trend continuation period is negative and the balance of the last variation trend continuation period is positive.

Therefore, it is defined that, among the variation trend continuation periods included in the game playing period, the later a balance in a variation trend continuation period takes place, the greater an influence is imparted to a degree of satisfaction of the player, and data weighting is performed to be thereby able to compute the degree of the player's satisfaction in a more realistic manner.

(Weighting Method 2)

The greater the number of continuous occurrences of variation trend continuation period is, the period having the same variation trend as the variation trend continuation period that occur lastly, the greater the influence on the degree of the player's satisfaction is.

If the balance of variation trend continuation period is positive or negative at a probability of ½, the probability at which the variation trend continuation period of which balance is positive or negative continuously takes place N times is obtained as $(1/2)^N$. The occurrence of the variation trend continuation period having the same variation trend is rare. Therefore, the greater the number of continuous occurrences is, the greater the mental impact is imparted to a player.

Therefore, it is defined that the greater the number of continuous occurrences in variation trend continuation period is, the period having the same variation trend as the variation trend continuation period that takes place lastly, the greater the influence is imparted to the degree of the player's satisfaction, and data weighting is performed to be thereby able to compute the degree of the player's satisfaction in a more realistic manner.

(Weighting Method 3)

The greater the absolute value of balance of the last variation trend continuation period in game playing period is, the greater the influence is imparted to the degree of the player's satisfaction.

A player occasionally stops the play of game intentionally. That is, there is a high possibility that the last variation trend continuation period renders the player make a decision to stop the play of game, and the balance of the last variation trend continuation period has great impact on the player's mentality.

Therefore, it is defined that the greater the absolute value of balance of the last variation trend continuation period in game playing period is, the greater the influence is imparted to the degree of the player's satisfaction, and data weighting is performed to be thereby able to compute the degree of the player's satisfaction in a more realistic manner. In a case where the balance is positive, a positive influence is imparted to the degree of the player's satisfaction. If a case where the balance is negative, a negative influence is imparted to the degree of the player's satisfaction.

(c) Operation Time of Gaming Machine Unit

In a case where the operation time of gaming machine unit is long, there is a high possibility that the gaming machine unit contributes to attracting players' interest irrespective of whether or not profit is large or small. Therefore, the data related to the item (c) is employed for computation of the degree of satisfaction of gaming facility.

(d) Profit on the Shop Side by Gaming Machine Unit

The profit on the shop side itself has influence on the degree of satisfaction of gaming facility as shown in the abovementioned tradeoff relationship, and therefore, in the present invention, the data related to the item (d) is employed for computation of the degree of satisfaction of gaming facility.

FIG. 10 shows one example of a result obtained by computing degrees of satisfaction between player and gaming facility by employing the data related to the items (a) to (d). Many evaluations of the degrees of satisfaction sparsely exist in area A and area C. Area Sc is a region in which the evaluation dots of the degree of satisfaction of gaming machine unit are easily positioned which follow the abovementioned tradeoff relationship. However, the evaluation dots of degree of satisfaction of one gaming machine unit are not positioned in area Sc, but are positioned in area Sp. Area Sp is a region in which the degrees of satisfaction between player and gaming machine are high.

In this manner, according to the present invention, computation of the degrees of satisfaction between player and gaming facility is performed based on the data related to the items (a) to (d), whereby the abovementioned tradeoff relationship is eliminated so as to be able to extract a gaming machine unit with its high degrees of satisfaction between player and gaming facility.

According to the present invention, for example, in a manner described below, it is possible to improve a setup balance of the gaming machine units in the gaming facility.

Figure 11:
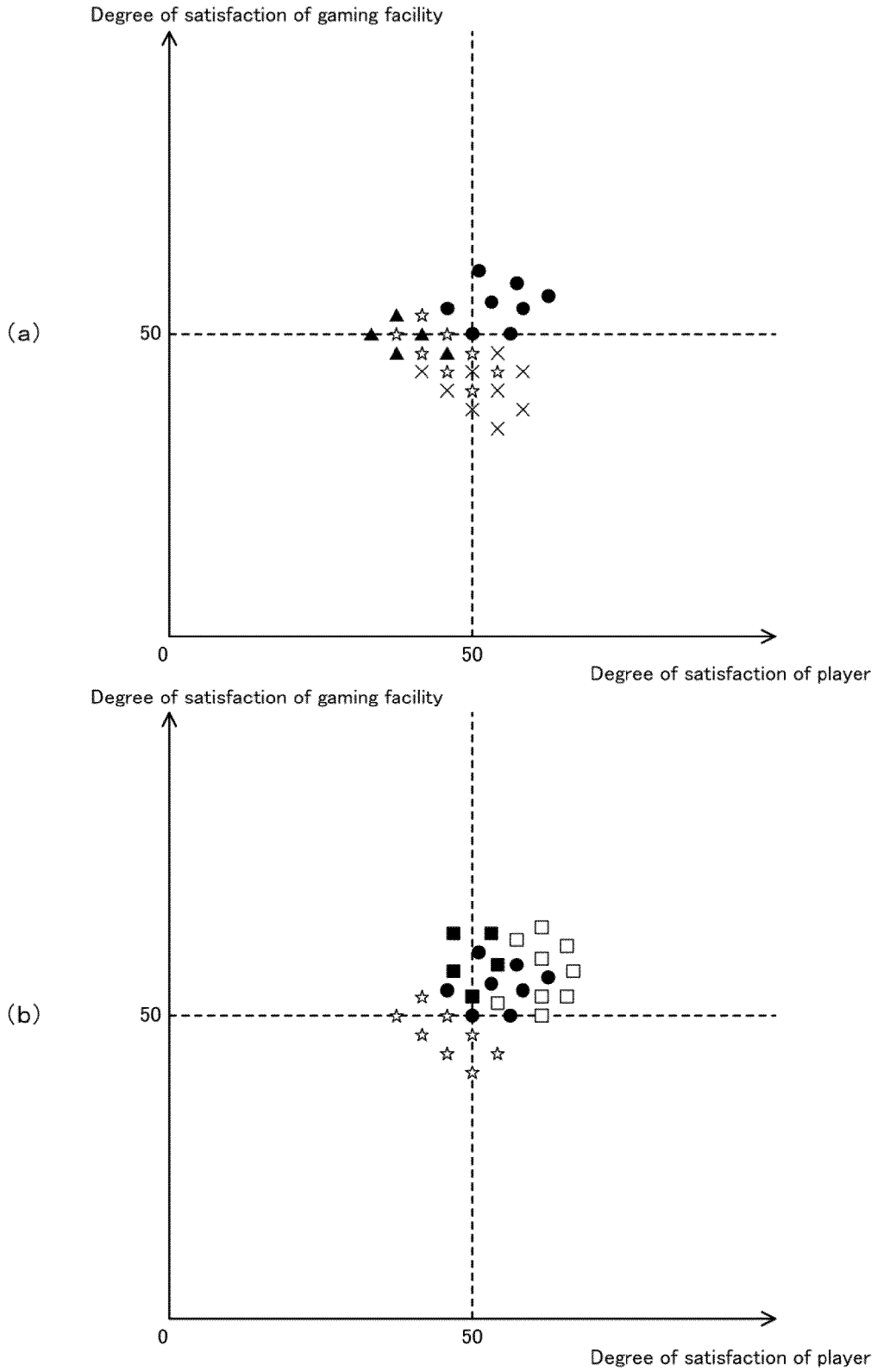
FIGS. 11(*a*) and (*b*) are views depicting a relationship between a degree of satisfaction of a player and a degree of satisfaction of gaming facility.

FIG. 11(*a*) shows distribution of evaluation dots of the degrees of satisfaction before improvement in gaming machine.

The black circle mark, the x-mark, the black triangle mark, and the star mark indicate device types of gaming machine units, respectively. According to FIG. 11(*a*), the gaming machine unit with the black circle mark is relatively high in degrees of satisfaction of player and gaming machine. The gaming machine unit with the x-mark is low in degree of satisfaction of gaming facility. The gaming machine with the black triangle mark is low in degree of player's satisfaction.

Since there is a room for improvement as to the gaming machines with the x-mark and black triangle mark, these units were withdrawn from the gaming facility. In place of these gaming machine units, the gaming machine units with the white square mark and black square mark were introduced.

FIG. 11(*b*) shows evaluation dots of degrees of satisfaction after improvement in gaming facility.

The degrees of satisfaction of player and gaming facility as to the gaming machine units with the white and black square marks, which were new introduced, are higher than that of the gaming machine units that were installed previously. Entirely, the evaluation dots of degrees of satisfaction in FIG. 11(*b*) are positioned more upper right than those in FIG. 11(*a*).

In this manner, in the present invention, for example, the number of gaming machine units with high degrees of satisfaction of player and gaming machine can be increased in the entire shop by replacing the gaming machine units of device type with low degrees of satisfaction with those of other device type. An action for improvement is not limited to this example. Another action for improvement can include change of dividing number or settings and change of the number of setups by device type or the like, for example.

Figure 12:
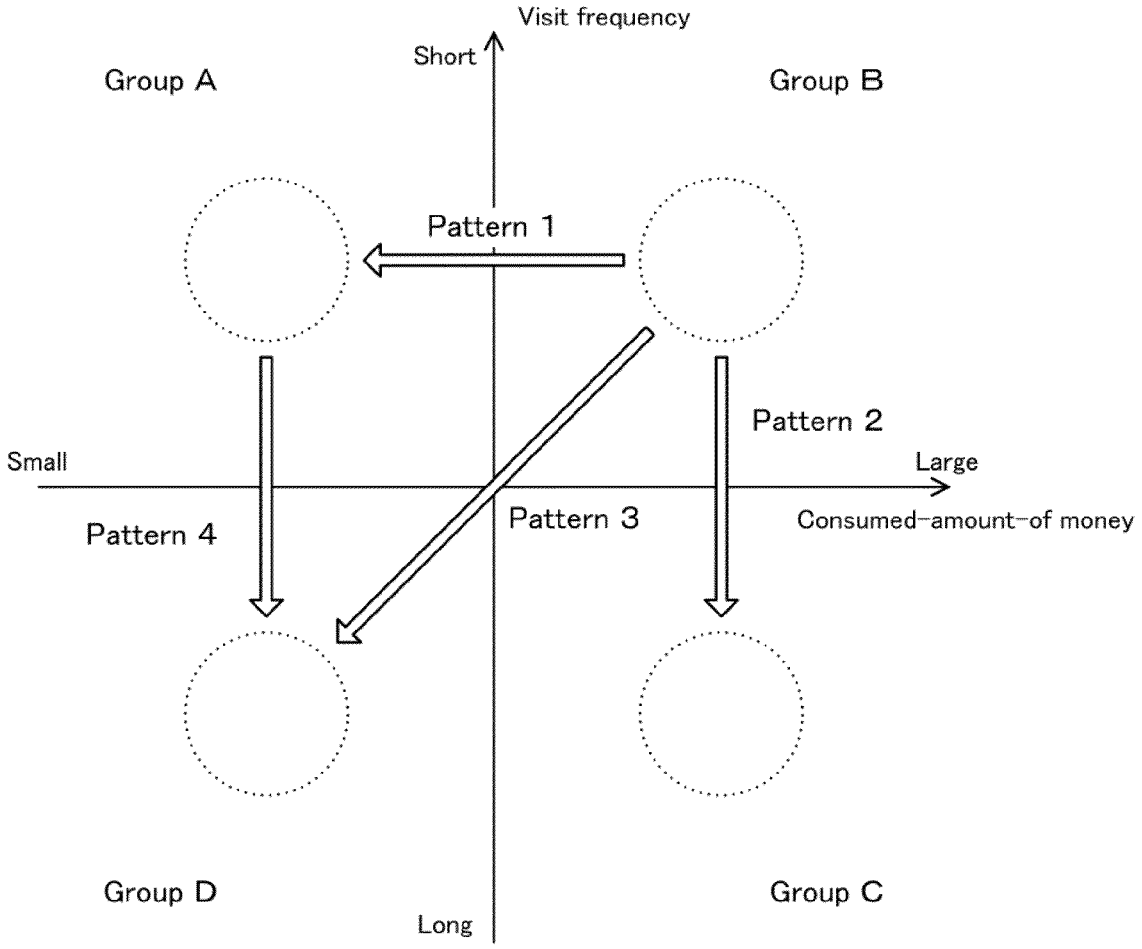
FIG. 12 is a view for explaining a life cycle of a player and its related pattern.

FIG. 12 is a view showing the life cycle of player's interest and its related pattern.

In the figure, the vertical axis indicates the visit frequency of player, and the horizontal axis indicates the consumed amount of money per visit by a player. In FIG. 12, the visit frequency of player and the consumed amount of money per visit of player are expressed by means of deviation values. The average value of the visit frequency of player and the consumed amount of money per visit of player is 50.

In this plane, dots are plotted on a coordinate system defining the degrees of satisfaction of gaming facility and player relative to the gaming machine (hereinafter, evaluation dots of the degrees of satisfaction).

The plane shown in FIG. 12 is classified into four group while the average value is defined as a reference.

Group A indicates a group of new customers. In general, a new customer is prone to be high in visit frequency and small in consumed amount of money.

Group B indicates a group of fixed customers. In general, a fixed customer is prone to be high in visit frequency and large in consumed amount of money.

Group C indicates a group of dissatisfactory customers. In general, a dissatisfactory customer is prone to be low in visit frequency and large in consumed amount of money.

Group D indicates a group of leaving customers. In general, a leaving customer is prone to be low in visit frequency and low in consumed amount of money.

In the embodiment, evaluation dots of life cycle of player are plotted based on data related to (a') visit frequency and (b') consumed amount of money per visit by player, thereby determining a group to which a player belongs. Further, in the embodiment, evaluation dots of life cycle of payer are plotted with an elapse of time, thereby indicating trajectory of evaluation dots of life cycle of player. In this manner, change of a group to which a player belongs is determined.

Patterns of change of group to which player belongs include patterns 1 to 4 shown in FIG. 12 as follows, for example.

Pattern 1 is a pattern in which the visit frequency is high, but the consumed amount of money gradually lowers. In the case of pattern 1, lowered attraction power of device type of gaming machine unit is presupposed as customer's mentality.

Patent 2 is a pattern in which the consumed amount of money is large, but the visit frequency lowers. In the case of pattern 2, the outflow to another gaming machine is presupposed as customer's mentality.

Patent 3 is a pattern in which both of the consumed amount of money and the visit frequency lower. In the case of pattern 3, lowered reliability of gaming facility is presupposed as customer's mentality.

Patent 4 is a pattern in which the consumed amount of money is small, and the visit frequency lowers. In the case of pattern 4, lowered attractive power of gaming facility is presupposed as customer's mentality.

In the present embodiment, data indicating advice is associated with each pattern. A pattern of change of a group to which a player belongs is determined; the advice associate with that pattern is extracted; and based on the extracted data, an image indicating the advice is displayed.

The above advices are exemplified as follows, for instance.

The advice associated with pattern 1 includes replacement of gaming machine unit or change of the number of dispositions for improving the attraction force of device type of gaming machine units.

The advice associated with pattern 2 includes holding of event for strengthening customer's interest in gaming facility or the like.

The advice associated with pattern 3 includes setting change of dividing number for recovering reliability of gaming facility.

The advice associated with pattern 4 includes replacement of gaming machine unit or change of the number of dispositions for enhancing the attraction power of gaming facility and setting change of dividing number or the like.

Figure 13:
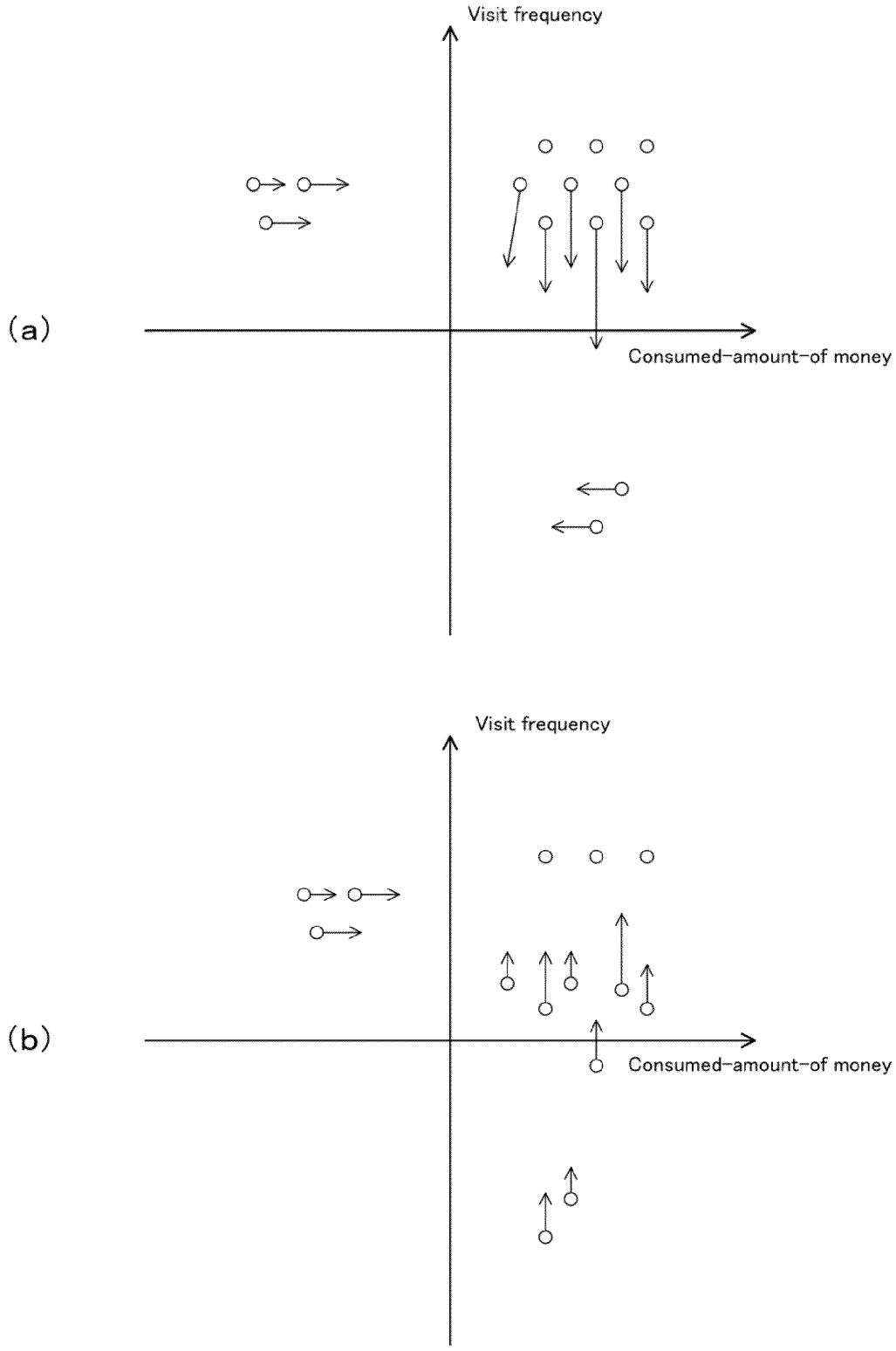
FIGS. 13(*a*) and (*b*) are views depicting transition of the life cycle of the player.

FIGS. 13(*a*) and (*b*) are views showing transition of life cycle of player. In the figure, the arrow mark with white circle indicates transition history of evaluation dots of life cycle of player.

In FIG. 13(*a*), three players belonging to group A move to group B; nine players belonging to group B move to group C; and two players belonging to group C moves to group D. Movement of nine players falls into pattern 2. Therefore, in the embodiment, holding an event for strengthening customer's interest in gaming facility is displayed as the advice.

FIG. 13(*b*) shows transition of life cycle of player after action based on the above advice has been taken. In FIG. 13(*b*), all players move to group B. In view of the fact, it is found that the action based on the advice is successful.

Figure 14:
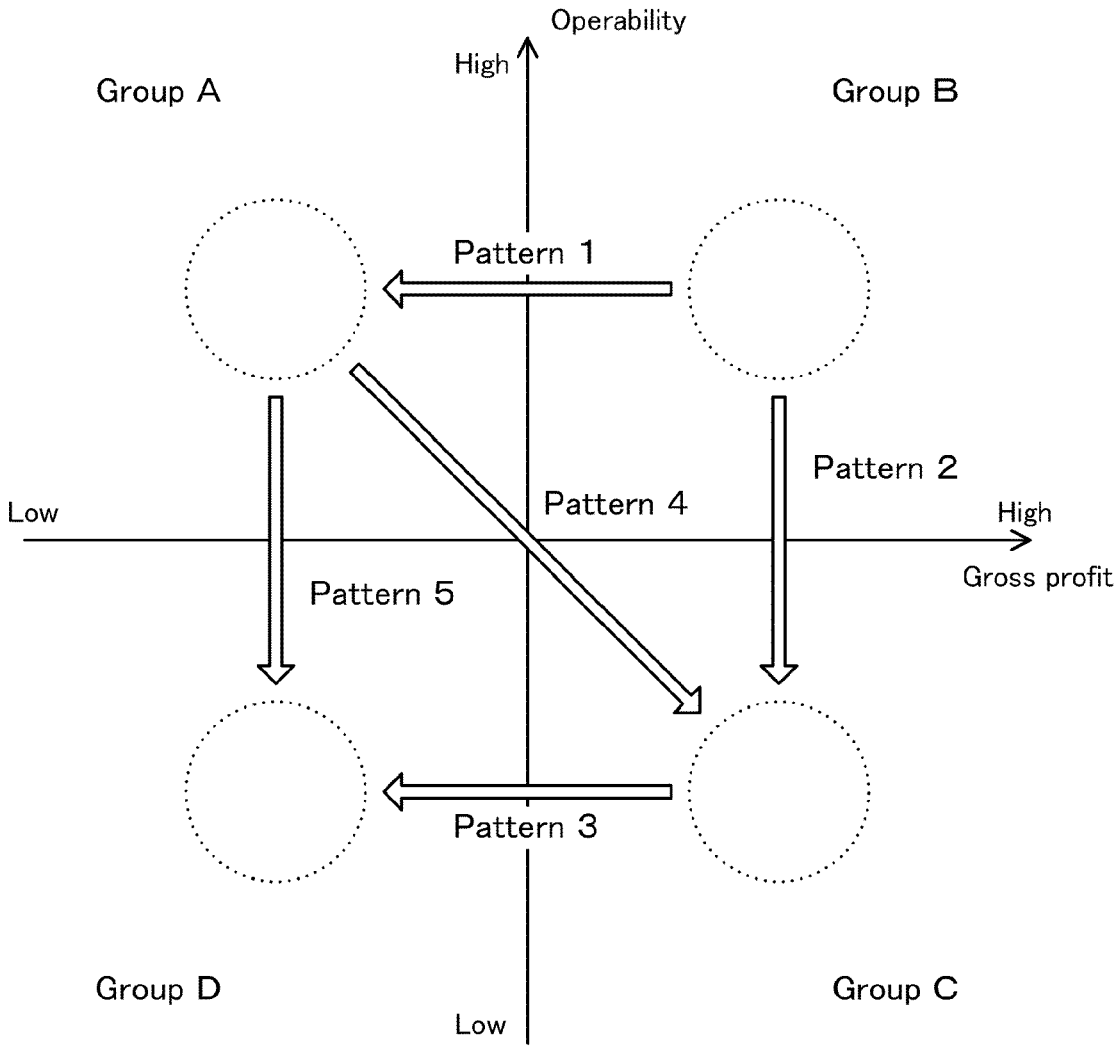
FIG. 14 is a view for explaining a life cycle of gaming machine and its related pattern.

FIG. 14 is a view showing a life cycle of gaming machine and its related pattern.

In the figure, the vertical axis indicates operability of gaming machine, and the horizontal axis indicates gross profit by gaming machine. In FIG. 14, the operability of gaming machine and the gross profit by gaming machine, are expressed by means of deviation values. The average value of the operability of gaming machine and the gross profit by gaming machine is 50.

In this plane, dots (evaluation dots of life cycle of gaming machine) are plotted on a coordinate system between operability and gross profit of gaming machine.

The plane shown in FIG. 14 is classified into four groups as follows while the average value is defined as reference.

Group A indicates a group of new machines. In general, a new machine is probe to be high in operability and low in gross profit.

Group B indicates of group of main device types. In general, a main device type is prone to high in operability and high in gross profit.

Group C indicates of group of less popular device types. In general, a less popular device type is prone to low in operability and high in gross profit.

Group D indicates of group of unpopular device types. In general, an unpopular device type is prone to low in operability and low in gross profit.

In the embodiment, evaluation dots of life cycle of gaming machine are plotted based on data related to (c') operability and (d') gross profit by gaming machine, thereby determining a group to which a gaming machine belongs. For example, in the embodiment, the evaluation dots of life cycle of gaming machine are plotted with an elapsed of time, indicating trajectory of evaluation dots of life cycle of gaming machine. In this manner, change of group to which gaming machine belongs is determined The patterns of change of group to which gaming machine belongs include patterns 1 to 5 shown in FIG. 14 as follows, for example.

Pattern 1 is a pattern in which operability is maintained to be high, but gross profit lowers.

Pattern 2 is a pattern in which gross profit is maintained, but operability lowers.

Pattern 3 is a pattern in which operability changes to be low, but gross profit lowers.

Pattern 4 is a pattern in which operability lowers and gross profit rises.

Pattern 5 is a pattern in which gross profit changes to be low, and operability lowers.

In the present embodiment, data indicating advice is associated with each pattern. A pattern of change of a group to which a player belongs is determined; the advice associate with that pattern is extracted; and based on the extracted data, an image indicating the advice is displayed.

The above advices, for instance, include the following examples.

The advice associated with pattern 1 includes revisal of dividing number or the like.

The advice associated with pattern 2 includes revisal of dividing number or the like.

The advice associated with pattern 3 includes discussion of withdrawal of machine.

The advice associated with pattern 4 includes revisal of dividing number or the like.

The advice associated with pattern 5 includes discussion of withdrawal of machine.

Figure 15:
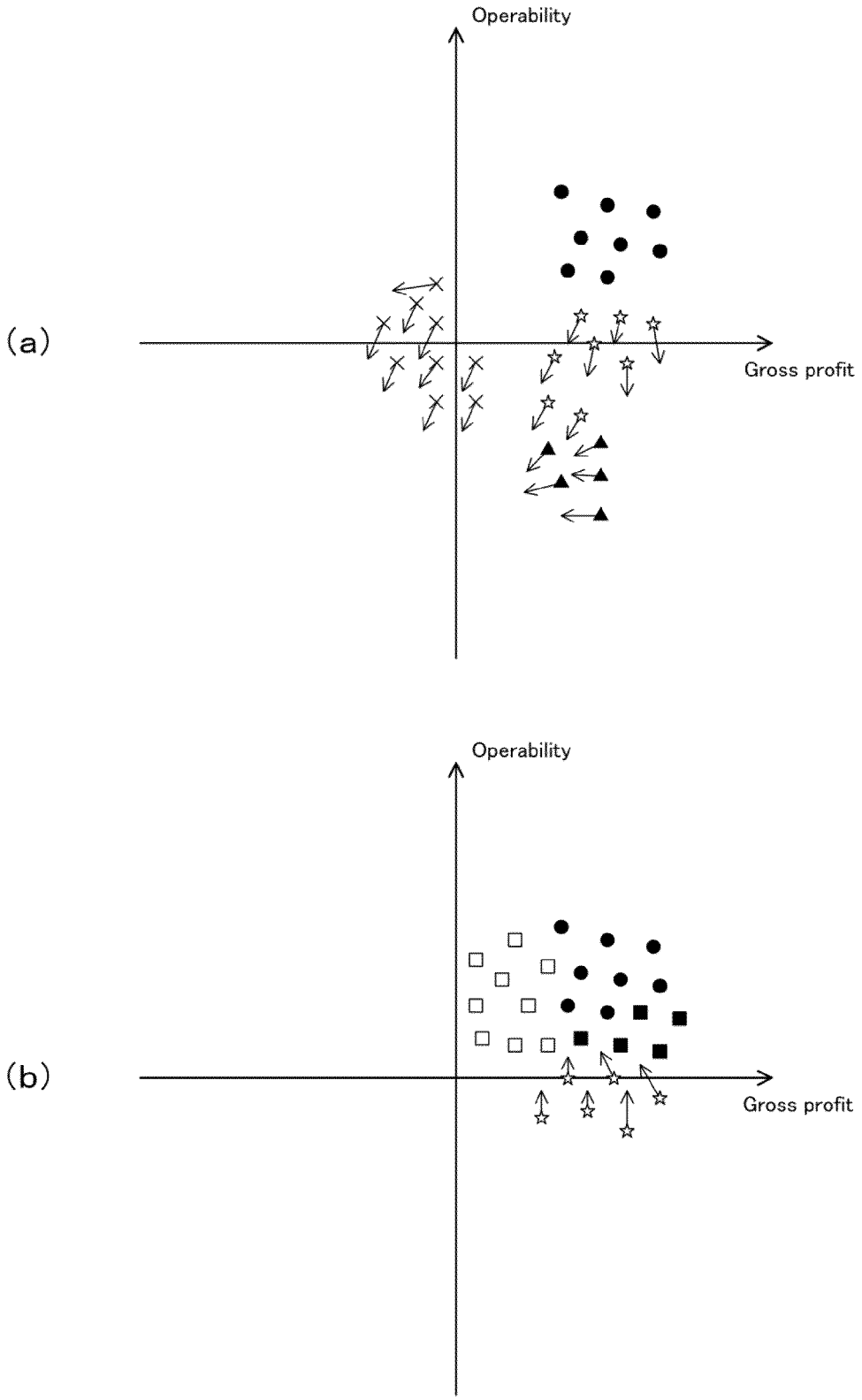
FIGS. 15(*a*) and (*b*) are views depicting transition of the life cycle of the gaming machine.

FIGS. 15(*a*) and (*b*) are views showing transition of life cycle of gaming machine. In the figure, the arrow provided with mark indicates transition history of evaluation dots of life cycle of gaming machine. Types of mark correspond to device types of gaming machine units.

In FIG. 15(*a*), eight evaluation dots of life cycle of gaming machine with black circle mark belong to group B; nine evaluation dots of life cycle of gaming machine with x-mark move from group B to group D; eight evaluation dots of life cycle of gaming machine with star mark move from group B to group C; and five evaluation dots of life cycle of gaming machine with black triangle mark move from group C to group D.

Movement of evaluation dots of life cycle of gaming machine with star mark falls under pattern 2. Movement of evaluation dots of life cycle of gaming machine with black triangle mark falls under pattern 3. Therefore, in the embodiment, revisal of dividing number and discussion of withdrawal of machine are displayed as the advice.

FIG. 15(*b*) shows transition of life cycle of player after the action based on the advice has taken. Withdrawal of gaming machine units with black triangle mark and x-mark is performed, and gaming machine units of white and black square marks are newly introduced. The gaming machine units of white and black square marks are positioned in group B, and the gaming machine with start mark moves to group B. In this manner, it is found that the action based on advice is successful.

Figure 16:
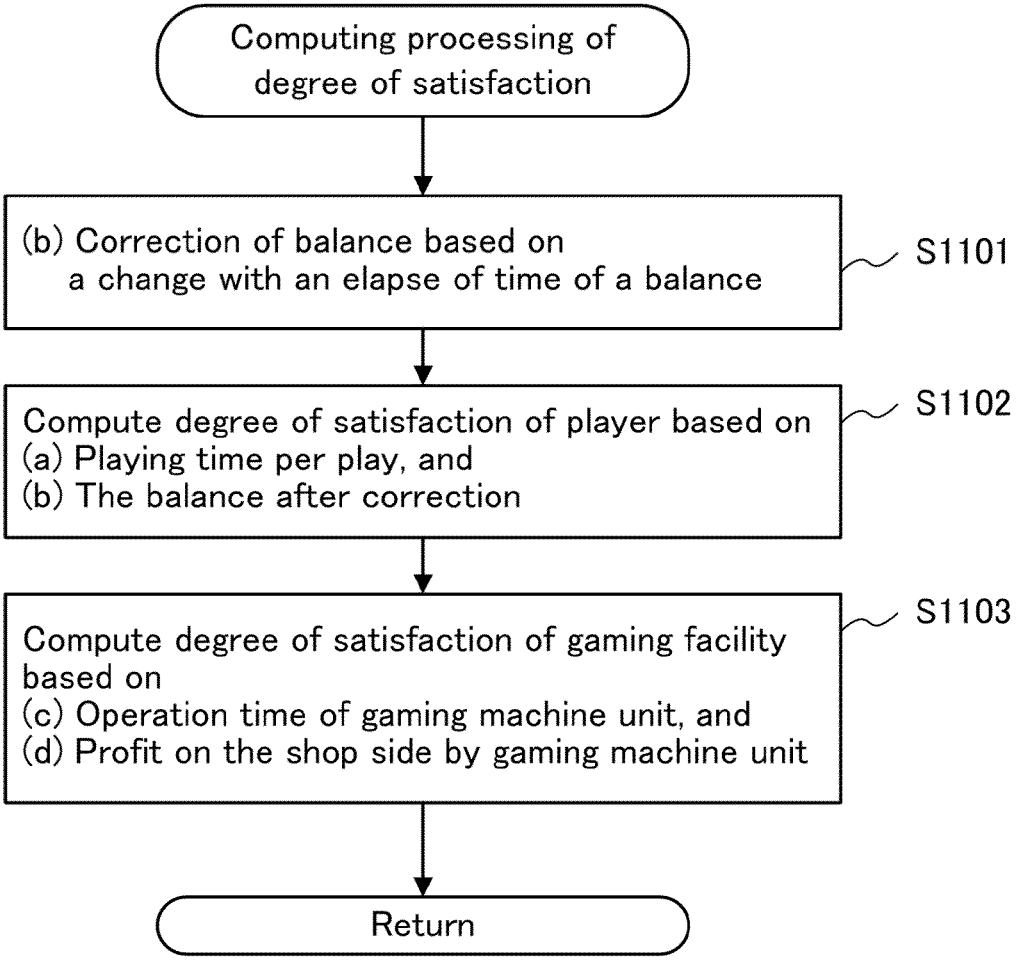
FIG. 16 is an explanatory view depicting one example of a determination result database stored in the hall conserver shown in FIG. 1.

FIG. 16 is an explanatory view depicting one example of a determination result database stored in the hall conserver shown in FIG. 1.

The control portion 2062 of the hall converser 2060 corrects the balance based on a change with elapse of time using the data stored in the game playing status database 2066 stored in the hard disk 2065 (step S1101).

The correction of the balance will be described now.

Figure 17:
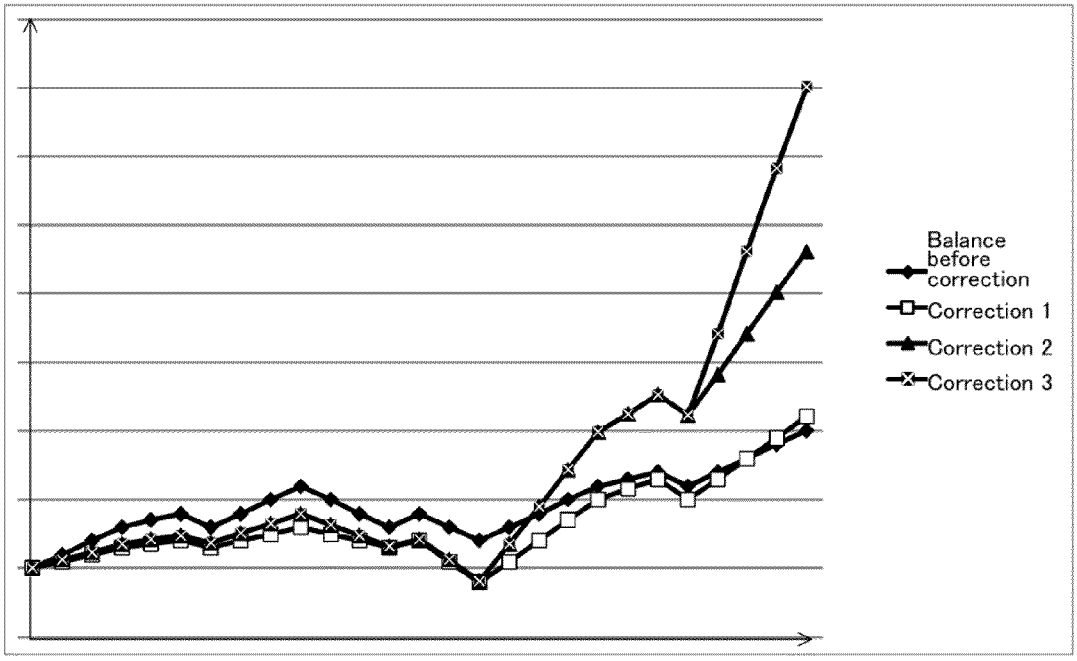
FIG. 17 is a graph depicting weighting in the computing processing of degree of satisfaction.

FIG. 17 is a graph depicting weighting in the computing processing of degree of satisfaction.

The balance before correction shown in FIG. 17 indicates the same trend as in the slump graph SG in FIG. 65(*b*). The variation trend continuation periods $CP_1$ to $CP_5$ included in the slump graph SG of FIG. 65(*b*) are also contained in FIG. 17. The variation trend continuation period $CP_1$ to $CP_5$ are positive, positive, negative, positive, and positive, respectively.

In this embodiment, three type of correction (correction 1 to correction 3) shown in FIG. 17 are performed on the balance before correction.

Correction 1 the weighting to impart a greater influence to relative to the degree of satisfaction of the balance of a latter half in the game playing period than a balance in a first half in the game playing period. In this embodiment, correction of the following equation (1) is performed on the balance in the first half, and correction of the following equation (2) is performed on the balance in the latter half.

$$(\text{Balance in first half})\times(1-\alpha) \quad (1)$$

$$(\text{Balance in latter half})\times(1+\alpha) \quad (2)$$

With the proviso that $\alpha$ is a positive number less than 1.

As a result, the balance becomes as correction 1 shown in FIG. 17 (in the figure, white square marks).

Correction 2 is the weighting to allow, in the variation trend continuation periods contained in the game playing period, the balance occurring later in the variation trend continuation period to have greater influence on the degree of satisfaction of player. In this embodiment, the following equation (3) is performed on the balance of each variation trend continuation period of correction.

$$(\text{Balance of the } nth \text{ variation trend continuation period})\times<1+(n/N)> \quad (3)$$

With the proviso that N is the total number of the variation trend continuation periods included in the game playing period, and n is a natural number equal to or lower than N.

As a result, the balance becomes as correction 2 shown in FIG. 17 (in the figure, black triangle mark).

Correction 3 is weighting to allow such correction that the higher the number of continuous number of occurrence of the variation trend continuation period having the same variation trend the variation trend continuation period which occurs finally, the greater the influence on the degree of satisfaction of player. In this embodiment, among the variation trend continuation periods having the same variation trend the last variation trend continuation period, the correction of the following equation (4) is performed on the balance of the variation trend continuation period occurring continuously with the last variation trend continuation period.

$$(\text{Balance of the } m\text{-}th \text{ variation trend continuation period}) \times m \quad (4)$$

With the proviso that m is a natural number.

As a result, the balance becomes as correction 3 shown in FIG. 17 (in the figure, x-marks).

In such a manner, according to this embodiment, as shown in FIG. 17, performing correction 1 to 3 increases the proportion of the balance of the latter half in the overall balance.

Next, the control portion 2062 of the hall conserver 2060 computes the degree of satisfaction of player based on (a) the game playing period at one time, and (b) the balance after correction (step S1102). The method of computing the degree of satisfaction of player is as described above. The control portion 2062 stores the computed degree of satisfaction of player in the hard disk 2065. Step S1102 corresponds to the processing (B).

Next, the control portion 2062 of the hall conserver 2060 (c) computes the degree of satisfaction of gaming facility based on (a) the operation time of the gaming machine 1001, and (d) the profit of a shop side by the gaming machine 1001 (step S1103). The method of computing of the degree of satisfaction of gaming facility is as described above. The control portion 2062 stores the computed degree of satisfaction of gaming facility in the hard disk 2065, and completes this subroutine. Step S1103 corresponds to the processing (C).

Figure 18:
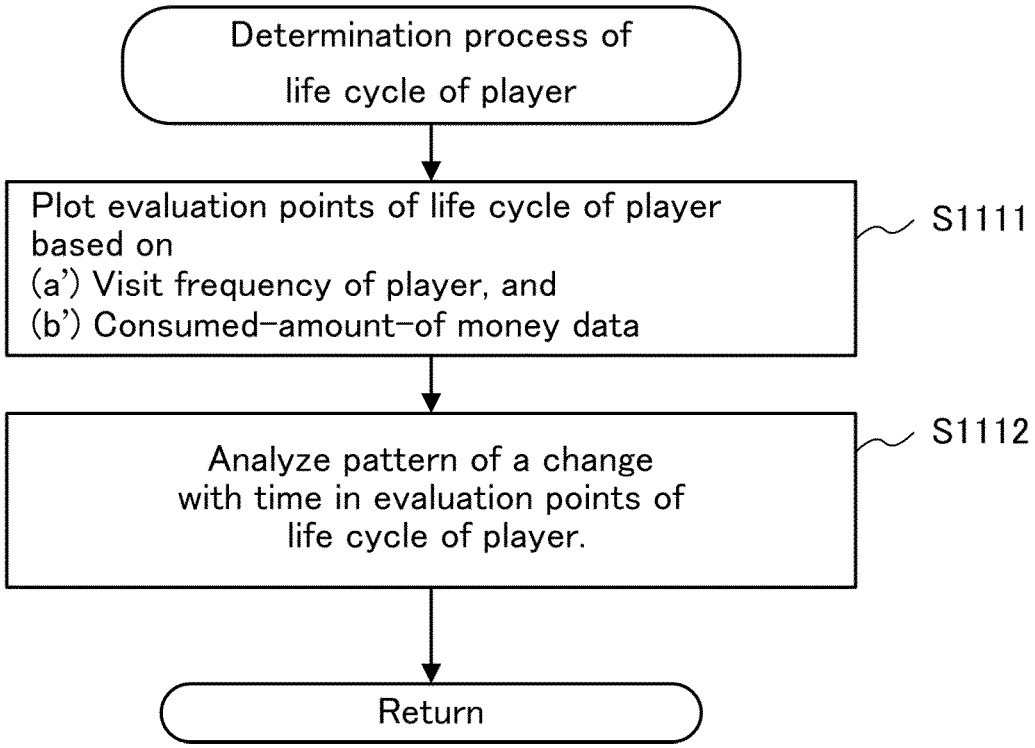
FIG. 18 is a flowchart depicting the player life cycle determination processing executed in the hall conserver shown in FIG. 1.

FIG. 18 is a flowchart showing the player life cycle determination processing executed in the hall conserver shown in FIG. 1.

The control portion 2062 of the hall conserver 2060 plots evaluation dots of life cycle of player based on data related to (a') visit frequency and (b') consumed amount of money per visit by player (step S1111). Accordingly, a group to which a player belongs is determined. In other words, the player is classified into any of the groups: new customers, fixed customers: dissatisfied customers and leaving customers. Step S1111 corresponds to the processing (E). Next, the control portion 2062 analyzes the pattern of change of evaluation dots of life cycle of player (step S1112), and completes this subroutine. Step S1112 corresponds to the processing (F). Evaluation dots of life cycle of player, the group to which the player belongs and its pattern of change are stored in the determination result database (refer to FIG. 9(*b*)).

Figure 19:
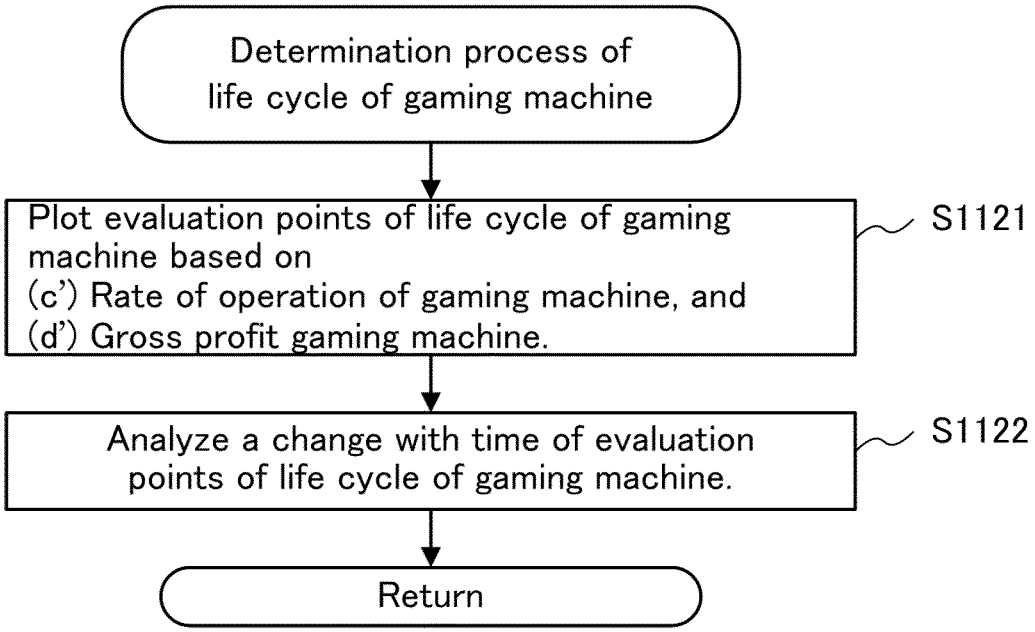
FIG. 19 is a flowchart depicting the gaming machine life cycle determination processing executed in the hall conserver shown in FIG. 1.

FIG. 19 is a flowchart depicting the gaming machine life cycle determination processing executed in the hall conserver shown in FIG. 1.

The control portion 2062 of the hall conserver 2060 plots evaluation dots of life cycle of gaming machine based on (c') the operability of the gaming machine 1001, and (d') the gross profit by the gaming machine 1001 (step S1121). Accordingly, the group to which the gaming machine belongs (refer to FIG. 14) is specified. In other words, gaming machines are classified into any one of groups of new machine, main device type, less popular, and unpopular. Step S1121 corresponds to the processing (J).

Next, the control portion 2062 analyzes the pattern of change of evaluation dots of life cycle of gaming machine (step S1122), and completes this subroutine. Step S1122 corresponds to the processing (K). Evaluation dots of life cycle of gaming machine, the group to which the gaming machine belongs and its pattern of change are stored in the determination result database (refer to FIG. 9(*c*)).

Figure 20:
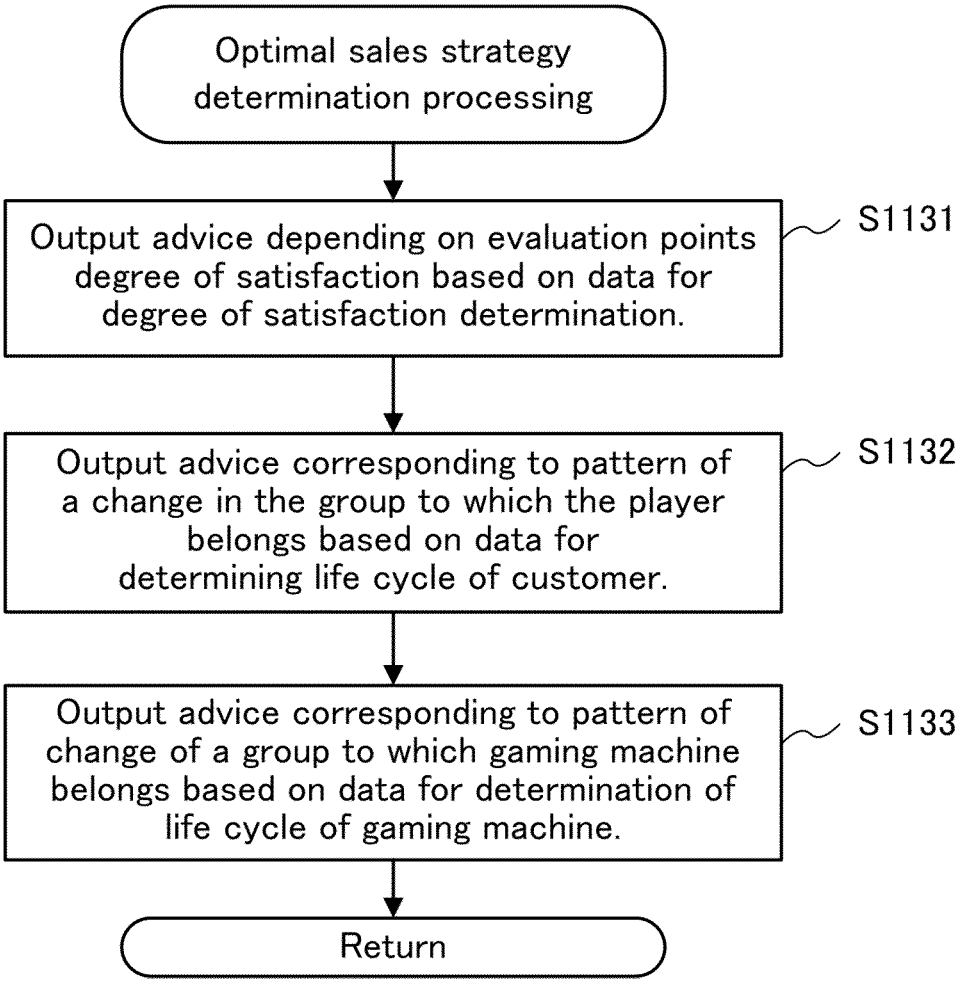
FIG. 20 is a flowchart depicting the optimal sales strategy determination processing executed in the hall conserver shown in FIG. 1.

FIG. 20 is a flowchart depicting the optimal sales strategy determination processing executed in the hall conserver shown in FIG. 1.

The control portion 2062 of the hall conserver 2060 outputs advice depending on the degree of satisfaction evaluation dots based on the data for degree of satisfaction determination stored in the hard disk 2065 (step S1131).

In the data for determination of degree of satisfaction, data indicating advice is associated with the combination of a numerical range of the degree of satisfaction of player the number of value range (for example, 0 or higher but less than 10, 10 or higher but less than 20, etc.) and the numeral range of the degree of satisfaction of gaming facility (for example, 0 or higher but less than 10, 10 or higher but less than 20, etc.). Examples of the contents of advice include withdrawal of machine, changing value settings, changing the number of units installed, and others. It should be noted that the advice may be qualitative contents, or contents including specific numerical values.

Next, the control portion 2062 outputs advice depending on the pattern of change of the group to which the player belongs, based on data for determination of customer life cycle (step S1132).

In the data for determination of customer life cycle the pattern of change of the group to which the player belongs and the data indicating advice are associated with each other. It should be noted that since the description of the advice has been already provided, it will be omitted here. Step S1132 corresponds to the processing (G) and process (H).

Next, the control portion 2062 outputs advice corresponding to the pattern of change of a group to which gaming machine belongs based on the data for determination of life cycle of gaming machine (step S1133), and completes this subroutine. Step S1133 corresponds to the processing (L) and process (M).

In the data for determination of life cycle of gaming machine the pattern of change of a group to which gaming machine belongs and the data indicating advice are associated with each other. Since the description of the advice has been already provided, it will be omitted here.

In the embodiment mentioned above the case where standard deviation (deviation value) is used to evaluate the degree of satisfaction, life cycle of player and life cycle of gaming machine has been described, but the present invention is not limited to this example.

[Modification of the Gaming Machine Unit]

As explained by using FIGS. 1 to 3, the embodiment mentioned above have described the case where the gaming machine 1001 corresponds to the gaming machine unit, and the gaming machine 1001 is configured to directly communicate with the server (the IC card server 2050, the hall conserver 2060; and the member management server 2070). The present invention is, however, not limited to this example. The explanation will be made in this point below.

The present invention relates to a game playing information integration system which integrally manages game information including the operation states of a plurality of gaming machine units installed in a gaming facility such as a casino, the information of a player playing on a gaming machine unit and the like, and provides such game information as the information to be reflected on management.

Therefore, it is desirable to acquire data from all of the gaming machine units installed in a gaming facility.

When a new gaming facility is built, the introduction of the game playing information integration system to the gaming facility can be realized by introducing the gaming machine unit provided with function to communicate with a server.

However, the gaming machine unit which is not provided with the function to communicate with a server may be installed in some of the existing gaming facilities. Furthermore, even if the gaming machine unit which is provided with the function to communicate with a server is installed, the gaming machine unit may not adapt to the game playing information integration system of the present invention.

If all of the existing gaming machine units should be withdrawn and the gaming machine units provided with the function to communicate with a server should be installed when the game playing information integration system is introduced to such kind of gaming facilities, this may impose a great burden on managers of the gaming facilities.

Furthermore, if the gaming machine units provided with the function to communicate with a server are sequentially installed at the time of replacing a part of the gaming machine units, it resultingly takes time to introduce the game playing information integration system.

As a result, the presence of the existing gaming machine units may be an obstacle to introduction of the game playing information integration system of the present invention. Thus, there is a problem for the game playing information integration system of the present invention how the game playing information integration system is installed in such the existing gaming facilities.

In order to solve the above-described problems, the present invention employed the following features.

(5) The data communication terminal device for use in the game playing information integration system according to any one of (1) to (4), wherein:

the data communication terminal device is the device constituting the gaming machine unit along with a gaming machine main body, and the device separate from the gaming machine main body and the server, the data communication terminal device including:

a device adapted to enable wired or wireless communication with the gaming machine main body in response to an instruction and/or operation for connecting the data communication terminal device to the gaming machine main body;

a device adapted to receive data from the gaming machine main body in a state where the communication with the gaming machine main body becomes available;

a device adapted to enable wired or wireless communication with the server in response to an instruction and/or operation for connecting the data communication terminal device to the server; and a device adapted to transmit data to the server in a state where the communication with the server becomes available.

According to the feature of (5), the data communication terminal device is connected to the gaming machine main body installed in the existing gaming facilities, so that the gaming machine main body and the data communication terminal device can be made as a gaming machine unit. As a result, the game playing information integration system can be smoothly introduced to the existing gaming facilities.

The "data communication terminal device" is a device constituting the gaming machine unit along with the gaming machine main body, while the gaming machine unit may include other equipment than the gaming machine main body and the gaming machine unit.

The "gaming machine main body" is provided with an input device to which an instruction is inputted by a player in general, a control device which executes a processing regarding the game based on the instruction inputted to the input device, and an output device which carries out the output based on the result of the processing by the control device. The output device includes, for example, a display device which carries out the display based on the result of the processing by the control device.

Then, the fact that the data communication terminal device is separate from the gaming machine main body and the server will be described.

Figure 35:
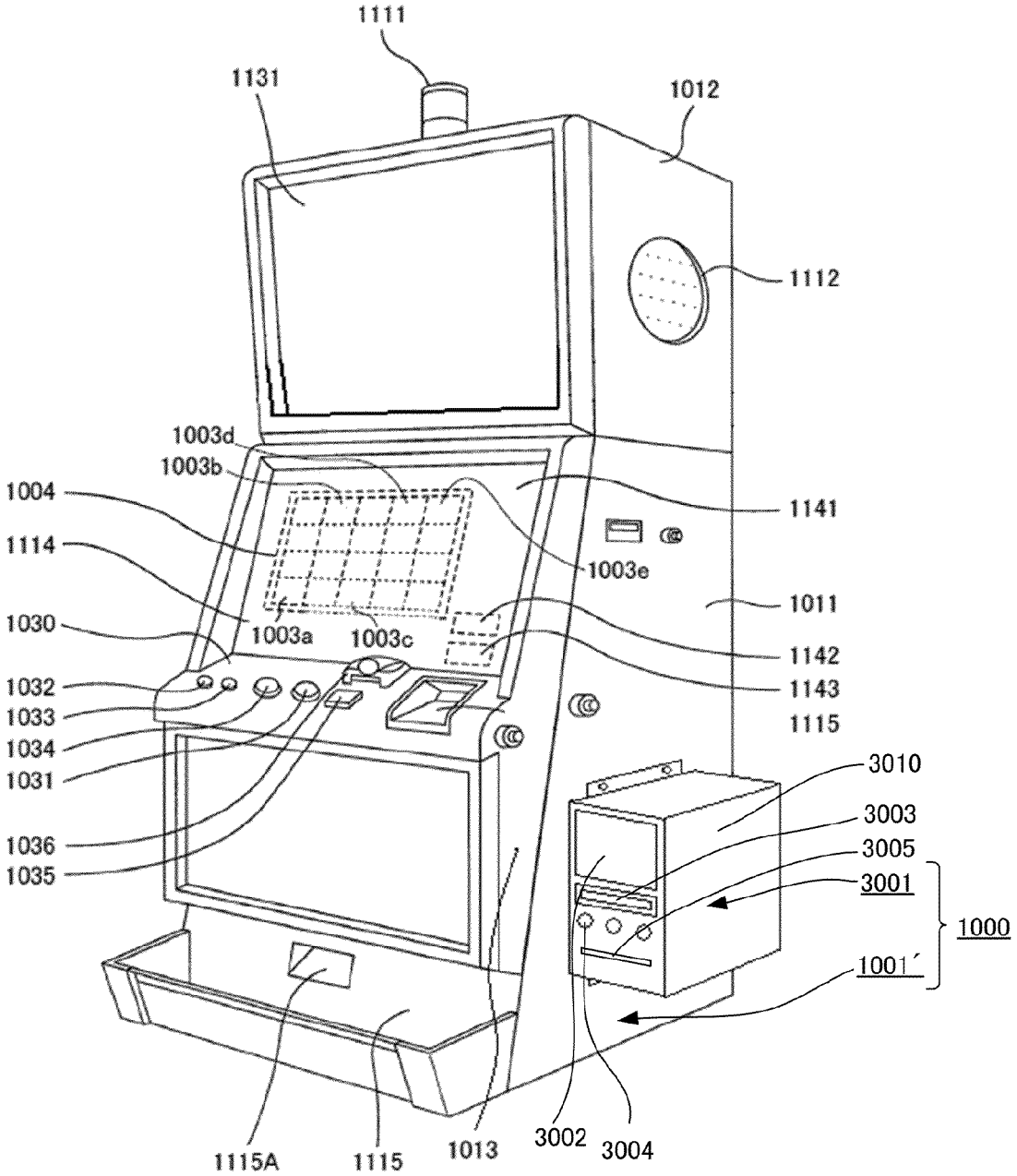
FIG. 35 is a perspective view schematically showing an example of the gaming machine unit composed of the gaming machine main body and the data communication terminal device.

FIG. 35 is a perspective view schematically showing an example of the gaming machine unit composed of the gaming machine main body and the data communication terminal device.

In FIG. 35, same structures as those shown in FIG. 2 are denoted by same reference numerals as those used in FIG. 2. The description regarding same structure as that shown in FIG. 2 will be omitted below.

A gaming machine unit 1000 shown in FIG. 35 is composed of a gaming machine main body 1001' and a player tracking device 3001. The gaming machine main body 1001' has the same appearance as that of the gaming machine 1001 shown in FIG. 2 except for the structure of the upper image display panel 1131. More specifically, the gaming machine main body 1001' shown in FIG. 35 is not provided with the ticket printer 1171, the card slot 1176, the data display device 1174, and the key pad 1173 which are provided in the gaming machine 1001 shown in FIG. 2.

The player tracking device 3001 (the data communication terminal device) is provided on the side surface of the cabinet 1011 of the gaming machine main body 1001'. Specifically, the player tracking device 3001 is fastened on the side surface of the cabinet 1011 by a fastener such as a screw.

The player tracking device 3001 is provided with a rectangular cabinet 3010, and a data display device 3002, a card slot 3003, a key pad 3004, and a ticket printer 3005 are provided on the front face of the cabinet 3010.

The player tracking device 3001 is the device that is externally added to the gaming machine main body 1001', which is connected to enable communication with the gaming machine main body 1001' by means of a cable (not shown). Furthermore, the player tracking device 3001 is connected to enable communication with the IC card server 2050; the hall conserver 2060; and the member management server 2070 by means of a cable.

Although FIG. 35 describes the case where the player tracking device is installed on the outer surface of the gaming machine main body, the present invention is not limited to this example, but the player tracking device may be installed outside of the gaming machine main body so as not to make contact with the gaming machine main body, for example.

Figure 36:
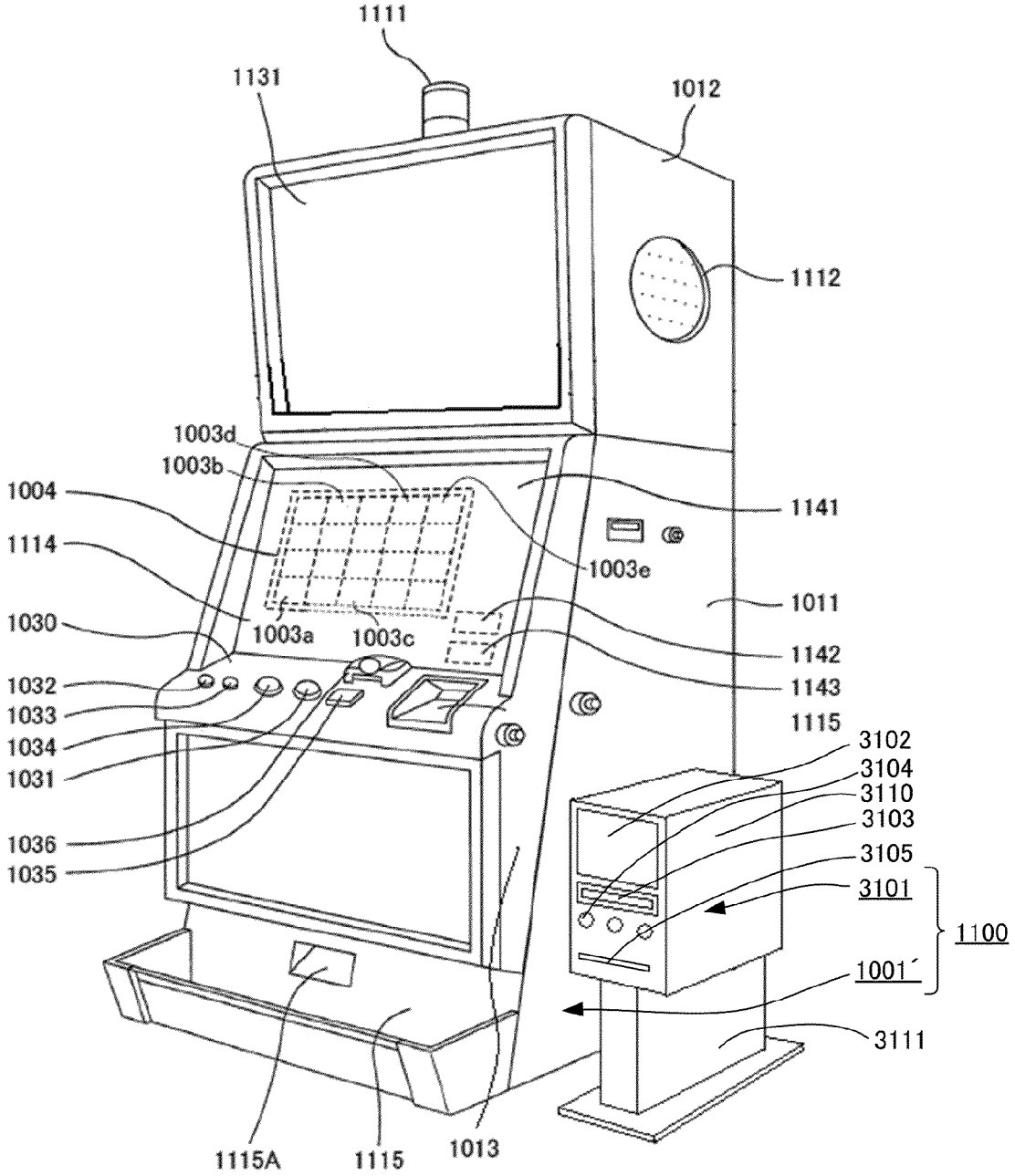
FIG. 36 is a perspective view schematically showing another example of the gaming machine unit composed of the gaming machine main body and the data communication terminal device.

FIG. 36 is a perspective view schematically showing another example of the gaming machine unit composed of the gaming machine main body and the data communication terminal device.

A gaming machine unit 1100 shown in FIG. 36 is composed of a gaming machine main body 1001' and a player tracking device 3101. The gaming machine main body 1001' has the same appearance as that of the gaming machine main body shown in FIG. 35.

The player tracking device 3101 (the data communication terminal device) is provided on the side surface of the cabinet 1011 of the gaming machine main body 1001'.

The player tracking device 3101 is provided with a rectangular cabinet 3110, and a data display device 3102, a card slot 3103, a key pad 3104, and a ticket printer 3105 are provided on the front face of the cabinet 3110. A supporting part 3111 is provided on the underside of the cabinet 3110. The supporting part 3111 supports the cabinet 3110, so that the cabinet 3110 stands upright.

Similar to the player tracking device 3001 shown in FIG. 35, the player tracking device 3101 is the device that is externally added to the gaming machine main body 1001', which is connected to enable communication with the gaming machine main body 1001' by means of a cable (not shown). Furthermore, the player tracking device 3101 is connected to enable communication with the IC card server 2050; the hall conserver 2060; and the member management server 2070 by means of a cable.

Although FIGS. 35 and 36 describes the case where the player tracking device is provided outside of the cabinet of the gaming machine main body, the present invention is not limited to this example, but the player tracking device may be installed to be embedded into the cabinet of the gaming machine main body, for example. In other words, the player tracking device may be installed inside of the cabinet of the gaming machine main body so that the front face of the player tracking device is exposed.

Figure 37:
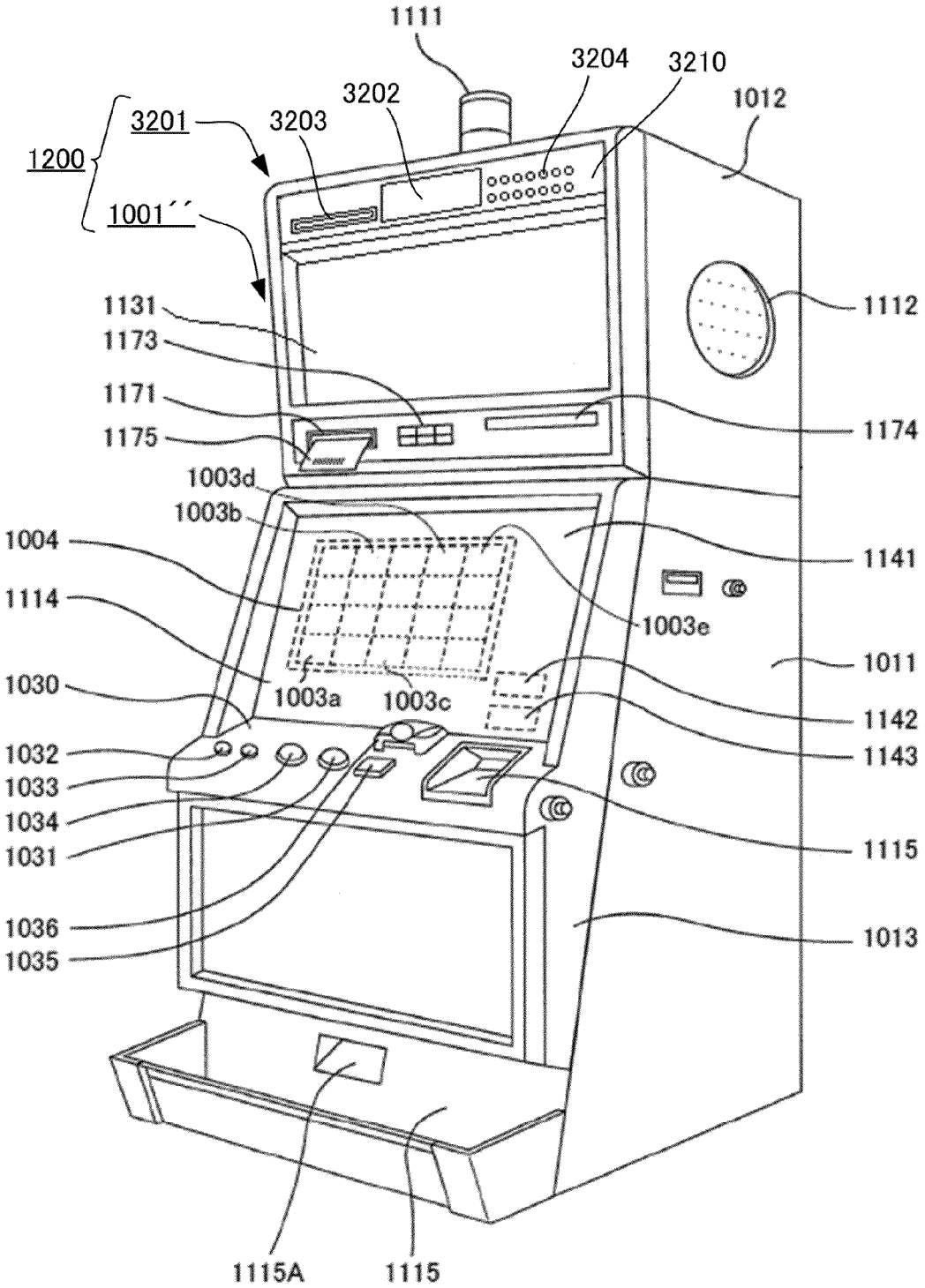
FIG. 37 is a perspective view schematically showing another example of the gaming machine unit composed of the gaming machine main body and the data communication terminal device.

FIG. 37 is a perspective view schematically showing another example of the gaming machine unit composed of the gaming machine main body and the data communication terminal device.

A gaming machine unit 1200 shown in FIG. 37 is composed of a gaming machine main body 1001" and a player tracking device 3201. The gaming machine unit 1001" has the same appearance as that of the gaming machine main body 1001 shown in FIG. 2 except for the structure of the upper image display panel 1131.

The player tracking device 3201 is provided on the upper side of the upper image display panel 1131. The player tracking device 3201 is provided with a front panel 3210 that is exposed on the front side of the gaming machine main body 1001", and a data display device 3202, a card slot 3203, and a key pat 3204 are provided on the front panel 3210. The key pat 3204 is provided with "0" to "9" buttons, "decision" and "delete" buttons, a "telephone" button, and an "information" button. In addition, the aspects of installation of the player tracking devices 3001, 3101, and 3201 are not limited to the examples shown in FIGS. 35 to 37.

Then, an internal structure of the gaming machine unit will be described.

Figure 38:
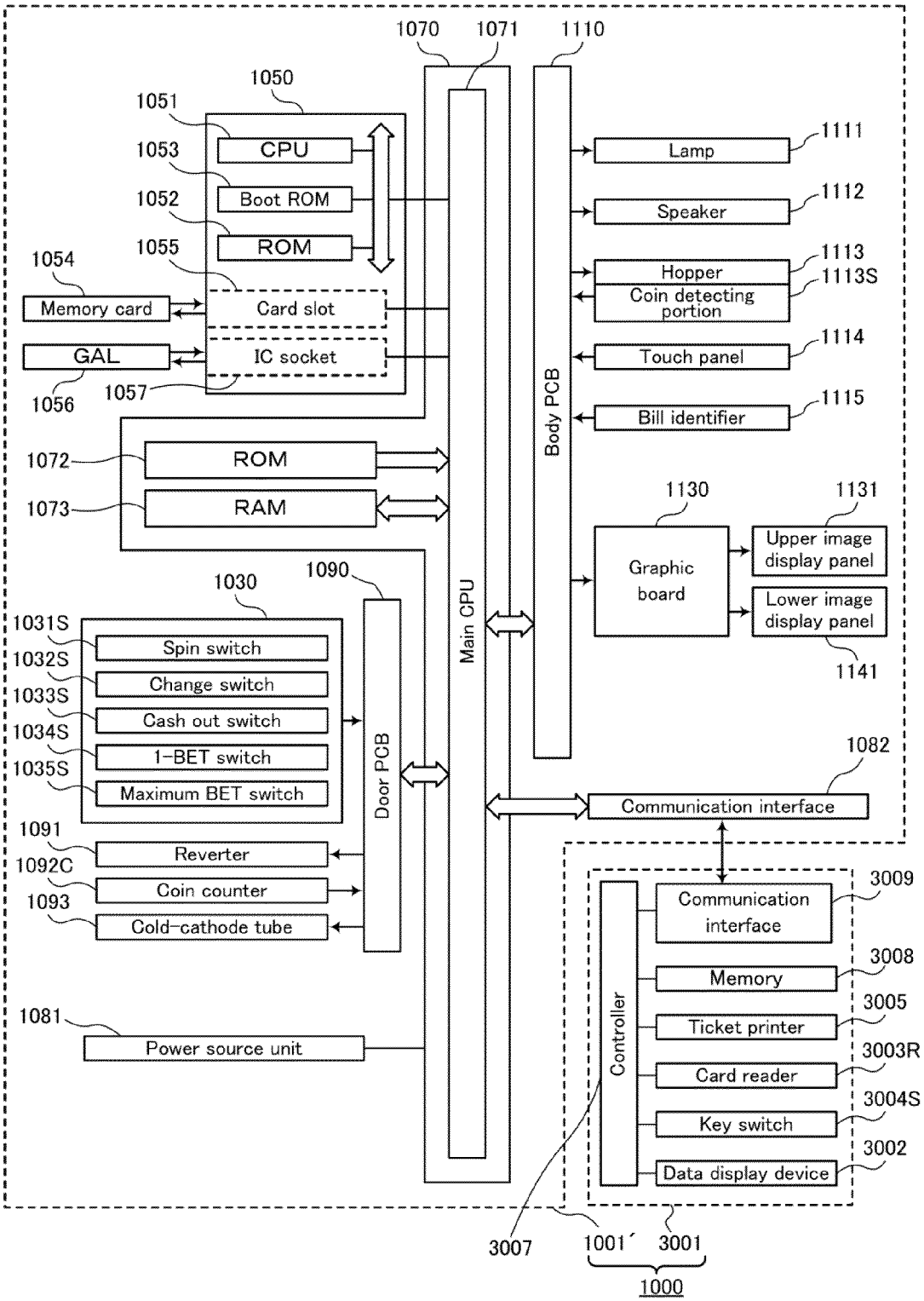
FIG. 38 is a block diagram schematically showing an internal structure of the gaming machine unit shown in FIG. 35.

FIG. 38 is a block diagram schematically showing an internal structure of the gaming machine unit 1000 shown in FIG. 35. In FIG. 38, same structures as those shown in FIG. 3 are denoted by same reference numerals as those used in FIG. 3. The description regarding same structure as that shown in FIG. 3 will be omitted below.

The gaming machine unit 1000 is provided with the gaming machine main body 1001' and the player tracking device 3001. The gaming machine main body 1001' is provided with the communication interface 1082. The main CPU 1071 of the gaming machine main body 1001' is connected to the player tracking device 3001 via the communication interface 1082. In addition, physically, the gaming machine main body 1001' and the data communication terminal device 3001 are provided with their own connectors (not shown), respectively. The gaming machine main body 1001' and the data communication terminal device 3001 are connected to each other by connecting each connector by means of a cable.

The player tracking device 3001 is provided with the ticket printer 3005, a card reader 3003R, a key switch 3004S, and the data display device 3002, as well as a controller 3007, a memory 3008, and a communication interface 3009. The controller 3007 and the memory 3008 constitute a control portion.

The controller 3007 receives a control signal outputted from the main CPU 1071 of the gaming machine main body 1001' via the communication interface 3009 to perform the processing in accordance with the control signal, and then stores data contained in the control signal in the memory 3008. Furthermore, the controller 3007 transmits data to the server and the gaming machine main body 1001'. The data contained in the control signal includes the data such as the number of credits, date, the identification number of the gaming machine main body 1001'.

The memory 3008 temporarily stores the data contained in the control signal that is transmitted from the gaming machine main body 1001'. Furthermore, the memory 3008 stores a program for controlling the player tracking device 3001, and a program for establishing the connection to the gaming machine main body 1001' and to the server. In addition, in FIG. 38, the memory 3008 does not represent a physically single storage device, but refers to the whole storage device which the player tracking device 3001 is provided with.

The ticket printer 3005 is controlled by the controller 3007 to print a bar code encoding the data such as the number of credits, date, the identification number of the gaming machine main body 1001' on a ticket, and to output the ticket as the ticket with a bar code (not shown).

The card reader 3003R reads data stored in a card inserted in the card slot 3003 to transmit the data to the server or the gaming machine main body 1001' and to write the data to the card based on the control signal from the main CPU 1071. Furthermore, the card reader 3003R writes the data stored in the memory 3008 to the card, and writes the data stored in the card to the memory 3008. The data stored in the card includes the player identification information.

The key switch 3004S is provided on the key pad 3004, and outputs a predetermined signal to the controller 3007 when the key pad 3004 is operated by a player.

The data display device 3002 is controlled by the controller 3007 to display the data read by the card reader 3003R and the data inputted by a player via the key pad 3004. In addition, the card reader 3003R and/or the ticket printer 3005 may be installed in the gaming machine main body 1001'.

The internal structure of the gaming machine unit shown in FIG. 36 is similar to that of the gaming machine unit shown in FIG. 35, and thus the description thereof is omitted. Furthermore, in the structure shown in FIG. 37, the gaming machine main body 1001" is provided with the ticket printer 1171, the data display device 1174, and the key pad 1173 (the key switch), and the player tracking device 3201 is provided with the card slot 3203 (the card reader).

In addition, in the present invention, the aspect in which the data communication terminal device is separated from the gaming machine main body and the server is not limited to the example described above. Furthermore, both the data communication terminal device and the gaming machine main body may be provided with the card reader and the ticket printer.

With regard to the communication between the data communication terminal device, and the gaming machine main body and the server in the present invention, the present invention can employ the structure described below, for example.

(5-A) The data communication terminal device is the device constituting the gaming machine unit along with a gaming machine main body, the data communication terminal device including:

a device adapted to establish wired or wireless communication connection with the gaming machine main body in response to an instruction and/or operation for connecting the data communication terminal device to the gaming machine main body;

a device adapted to receive data from the gaming machine main body in a state where the communication connection with the gaming machine main body is established;

a device adapted to establish wired or wireless communication connection with the server in response to an instruction and/or operation for connecting the data communication terminal device to the server; and a device adapted to transmit data to the server in a state where the communication connection with the server is established.

An example in which (5-A) described above is applied to the embodiments shown in FIGS. 35 and 38 will be described.

When the player tracking device 3001 as the data communication terminal device in (5-A) described above is applied to the existing connection oriented communication network of the gaming machine main body 1001' and the server, a program according to the present invention is installed in the server in the first place, thereby making the server act as the server of the present invention. In addition, the existing server may be replaced with the server of the present invention.

Then, the controller 3007 of the player tracking device 3001 executes the processing to be in a standby status while accepting the signal from the gaming machine main body 1001' based on the instruction inputted via the key switch 3004S. The gaming machine main body 1001' is set to communicate with the existing server, and thus "while accepting the signal from the gaming machine main body 1001'" refers to the state where the signal outputted from the gaming machine main body 1001' to the existing server (such as a signal representing data in which a value of the server is set as a destination address a destination port number) is accepted. The gaming machine main body 1001' and the player tracking device 3001 are connected to each other by the cable in this state. In addition, the controller 3007 of the player tracking device 3001 may execute the processing to be in a standby status while accepting the signal from the gaming machine main body 1001' based on the instruction inputted via the key switch 3004S after the gaming machine main body 1001' and the player tracking device 3001 are connected to each other by the cable.

Then, the controller 3007 of the player tracking device 3001 receives a request signal transmitted from the gaming machine main body 1001'. The request signal is transmitted from the gaming machine main body 1001' when the player tracking device 3001 is detected by the communication interface 1082 of the gaming machine main body 1001' or at a predetermined timing.

When receiving the request signal from the gaming machine main body 1001', the controller 3007 of the player tracking device 3001 transmits a response signal to the gaming machine main body 1001'. The response signal is the signal for giving the gaming machine main body 1001' pseudo recognition that the player tracking device 3001 is the server, including a signal representing data in which a value of the server is set as a source address a source port number, for example.

In the existing connection oriented communication network of the gaming machine main body 1001' and the server, the signal is transmitted and received between the gaming machine main body 1001' and the server, thereby establishing the communication connection between the gaming machine main body 1001' and the server. In the present invention, instead of the server, the player tracking device 3001 receives the request signal transmitted from the gaming machine main body 1001' to the server. Then, instead of the server, the player tracking device 3001 transmits the response signal, which is to be transmitted from the server to the gaming machine main body 1001' under normal conditions, to the gaming machine main body 1001'.

Therefore, the player tracking device 3001 can establish the communication connection to the gaming machine main body 1001' even if it is impossible or difficult to change the communication setting of the gaming machine main body 1001'. Then, the data can be transmitted and received between the gaming machine main body 1001' and the player tracking device 3001.

With regard to the connection between the player tracking device 3001 and the server, the connection may be established by getting the player tracking device 3001 recognized as it is by the server. The connection may be established by giving the server pseudo recognition that the player tracking device 3001 is the gaming machine main body 1001'.

In case of giving the server to recognize that the player tracking device 3001 is the gaming machine main body 1001', the player tracking device 3001 receives the request signal transmitted from the server to the gaming machine main body 1001', instead of the gaming machine main body 1001'. Then, instead of the gaming machine main body 1001', the player tracking device 3001 transmits the response signal, which is to be transmitted from the gaming machine main body 1001' to the server under normal conditions, to the server.

Therefore, the player tracking device 3001 can establish the connection to the server. Then, the data can be transmitted and received between the player tracking device 3001 and the server.

The data transmitted from the gaming machine main body 1001' to the player tracking device 3001 contains data regarding a valance during the play of game and the identification information of the gaming machine main body 1001', but does not contain the game initiation or completion data and the player identification information, for example.

The player tracking device 3001 adds the player identification information read from the card by the card reader 3003R and the data regarding insertion and extraction of the card to the data received from the gaming machine main body 1001' (data regarding a valance during the play of game and the identification information of the gaming machine main body 1001'), for example, and then transmits the data to the server.

In the example described above, the case has been described where the communication connection to the gaming machine main body 1001' is established, followed by establishment of the connection to the server. The order of establishment of the communication connection in the present invention is, however, not limited in particular. The communication connection to the server may be established, followed by establishment of the connection to the gaming machine main body 1001'.

Furthermore, in the example described above, the case has been described where the player tracking device 3001 receives the request signal from the gaming machine main body 1001' and then transmits the response signal to the gaming machine main body 1001'. The present invention is, however, not limited to the example described above, but the response signal may be transmitted to the gaming machine main body 1001' based on the instruction inputted via the key switch 3004S after the request signal is received from the gaming machine main body 1001'.

Furthermore, in the example described above, the case has been described where the player tracking device 3001 acts as a pseudo server to establish the communication connection with the gaming machine main body 1001' in order not to change the communication setting of the gaming machine main body 1001'. The present invention is, however, not limited to this example. When the setting of the communication with the player tracking device 3001 can be changed in the gaming machine main body 1001', a target to be communicated with the gaming machine main body 1001' is changed from the server to the player tracking device 3001, so that the communication connection with the gaming machine main body 1001' can be established without using the player tracking device as a pseudo server.

Furthermore, the present invention can employ the structure described below, for example.

(5-B) The data communication terminal device is the device constituting the gaming machine unit along with a gaming machine main body, the data communication terminal device including:

a device adapted to enable data transmitted from the gaming machine main body to the server to be received in response to an instruction and/or operation for connecting the data communication terminal device to the gaming machine main body;

a device adapted to receive data from the gaming machine main body in a state where the data transmitted from the gaming machine main body to the server can be received;

a device adapted to establish wired or wireless communication with the server in response to an instruction and/or operation for connecting the data communication terminal device to the server; and a device adapted to transmit data to the server in a state where the communication connection with the server is established.

An example in which (5-B) described above is applied to the embodiments shown in FIGS. 35 and 38 will be described.

When the player tracking device 3001 as the data communication terminal device in (5-B) described above is applied to the existing connectionless communication network of the gaming machine main body 1001' and the server, a program according to the present invention is installed in the server in the first place, thereby making the server act as the server of the present invention.

Then, the gaming machine main body 1001' and the player tracking device 3001 are connected to each other by the cable. The order of the install of the program and the connection by the cable is not limited in particular. The install of the program and the connection by the cable makes the player tracking device 3001 possible to receive the data transmitted from the gaming machine main body 1001' to the server (such as data in which a value of the server is set as a destination address a destination port number). The player tracking device 3001 receives in this state the data transmitted from the gaming machine main body 1001'. The establishment of the connection between the player tracking device 3001 and the server is similar to that in the above-mentioned (5-A) which is already described, so that the explanation thereof is omitted here.

The descriptions in (5-A) and (5-B) described above has described the case where the cable is used to connect the gaming machine main body 1001' and the player tracking device 3001. The present invention is, however, not limited to those examples, but any of wired and wireless connections may be employed. The same goes for the connection between the player tracking device 3001 and the server: any of wired and wireless connections may be employed.

In the case where the existing network of the gaming machine main body 1001' and the server is a connectionless communication network and the server is provided with a connector corresponding to each gaming machine main body 1001', the server can identify the source gaming machine main body 1001' of that signal based on the fact from which connector the received signal comes. Therefore, the data transmitted from the gaming machine main body 1001' to the server is not necessarily required to have data such as a destination address and a destination port number. When the player tracking device 3001 is introduced to the existing network of this kind, the player tracking device 3001 is not necessarily required to be set to be able to receive the data in which the value of the server is set as the destination address and the destination port number.

As described above, the "a device adapted to enable wired or wireless communication with the gaming machine main body in response to an instruction and/or operation for connecting the data communication terminal device to the gaming machine main body" may be the "a device adapted to establish wired or wireless communication with the gaming machine main body in response to an instruction and/or operation for connecting the data communication terminal device to the gaming machine main body" in (5-A) described above, or may be the "a device adapted to enable data transmitted from the gaming machine main body to the server to be received in response to an instruction and/or operation for connecting the data communication terminal device to the gaming machine main body" in (5-B) described above.

The device in (5-A) described above is, for example, the device adapted to establish the connection in the connection oriented communication network, which is composed of a control portion, an interface (such as a connector and an antenna), etc. The device in (5-B) described above is, for example, the device adapted to establish the connection in the connectionless communication network, which is composed of a control portion, an interface, etc. The instruction described above is, for example, inputted to the control portion (a computer), and relates to the setting of a software. The operation described above refers to a physical operation to hardware such as connection of equipment, for example.

The "a device adapted to receive data from the gaming machine main body in a state where the communication with the gaming machine main body is available" may be "a device adapted to receive data from the gaming machine main body in a state where the communication connection with the gaming machine main body is established" in (5-A), or may be "a device adapted to receive data from the gaming machine main body in a state where the data transmitted from the gaming machine main body to the server can be received" in (5-B) described above.

The device in (5-A) described above is, for example, the device adapted to execute the communication after the connection in the connection oriented communication network is established, which is composed of a control portion, an interface, etc. The device in (5-B) described above is, for example, the device adapted to receive data in the connectionless communication network, which is composed of a control portion, an interface, etc.

The "a device adapted to enable wired or wireless communication with the server in response to an instruction and/or operation for connecting the data communication terminal device to the server" may be the "a device adapted to establish wired or wireless communication connection with the server in response to an instruction and/or operation for connecting the data communication terminal device to the server" in (5-A) and (5-B) described above, or may be the device adapted to enable data transmission to the server in response to an instruction and/or operation for connecting the data communication terminal device to the server.

The device in (5-A) and (5-B) described above are, for example, the device adapted to establish the connection in the connection oriented communication network, which is composed of a control portion, an interface, etc. The device adapted to enable data transmission to the server is the device adapted to enable data transmission in the connectionless communication network, which is composed of a control portion, an interface, etc.

The "a device adapted to transmit data to the server in a state where the connection to the server is available" may be the "a device adapted to transmit data to the server in a state where the communication connection with the server is established" in (5-A) and (5-B), or may be the device adapted to transmit data to the server in a state where data transmission to the server is available.

The communication between the data communication terminal device and the gaming machine main body, and the communication between the data communication terminal device and the server may be entirely connection oriented communications, or connectionless communications. One of them may be the connection oriented communication, and the other may be the connectionless communication.

When the connectionless communication is carried out between the gaming machine main body and the data communication terminal device, the communication may be unidirectional communication from the gaming machine main body to the data communication terminal device. When the connectionless communication is carried out between the data communication terminal device and the server, the communication may be unidirectional communication from the gaming machine main body to the server. When such the unidirectional communication is carried out, the data communication terminal device is installed between the gaming machine main body and the server in the existing network for carrying out the connectionless unidirectional communication from the gaming machine main body to the server, and thus the data communication terminal device can be applied to the existing network.

Furthermore, when no connector for outputting to the outside is provided in the existing gaming machine main body, a cable provided inside of the gaming machine main body is branched and a connector is provided in one of branched cable. This enables the connector and the data communication terminal device to be connected to each other, thereby enabling data transmission from the gaming machine main body to the data communication terminal device.

The data communication terminal device of the present invention constitutes the gaming machine unit along with the gaming machine main body.

The game initiation or completion data output device provided in the gaming machine unit may be provided in the gaming machine main body, or may be provided in the data communication terminal device. The gaming machine main body and the data communication terminal device may constitute the game initiation or completion data output device.

Furthermore, the player identification information reading device and the game execution data output device provided in the gaming machine unit may be provided in the gaming machine main body, or may be provided in the data communication terminal device. The gaming machine unit identification information may be stored in the gaming machine main body, or may be stored in the data communication terminal device. Any one of the identification information set in the gaming machine main body, or the data communication terminal device may be used as the gaming machine unit identification information.

In the present invention, among the data that are necessary for the game playing information integration system to acquire from the gaming machine unit, the data other than those can be acquired from the gaming machine main body is acquired from the data communication terminal device connected to the gaming machine main body, thereby making the gaming machine main body applicable to the game playing information integration system.

In addition, the data communication terminal device of the present invention may be used in the game information integration system described below, constitute the gaming machine unit along with the gaming machine main body, and be separate from the gaming machine main body and the server.

The game playing information integration system is provided with:

a plurality of gaming machine units; and a server connected to enable communication with each of the gaming machine units, wherein the gaming machine unit includes:

a player identification information reading device which is capable of reading player identification information, and, outputs the read player identification information;

number-of-consumptions data output device for outputting number-of-consumptions data related to a number-of-consumptions of game media; and number-of-payouts data output device for outputting number-of-payouts data related to a number-of-payouts of game media; wherein the gaming machine unit identification information is individually assigned to each of the gaming machine units, the server is provided with:

data storage device for storing each of the number-of-consumptions data outputted from the number-of-consumptions data output device and the number-of-payouts data outputted from the number-of-payouts data output device in association with reception time data related to data reception time of these data, player identification information, and gaming machine unit identification information.

Here, each of the player identification information reading device, the number-of-consumptions data output device, and the number-of-payouts data output device provided in the gaming machine unit may be provided in the gaming machine main body, or may be provided in the data communication terminal device. The gaming machine unit identification information may be stored in the gaming machine main body, or may be stored in the data communication terminal device. Any one of the identification information set in the gaming machine main body, or the data communication terminal device may be used as the gaming machine unit identification information.

While the embodiments of the present invention have been described hereinbefore, these embodiments are merely exemplified as specific examples, and do not limit the present invention in particular, and specific features of device or the like can be appropriately changed in design. In addition, the advantageous effects described in the embodiments of the present invention are merely enumerated as the most preferred advantageous effects derived from the present invention, and the advantageous effects according to the present invention are not limited to those described in the embodiments of the present invention.

In addition, in the foregoing detailed description, characterizing portions have been mainly set forth so as to understand the present invention more easily. The present invention is not limited to the embodiments set forth in the foregoing detailed description, and can be applied to other embodiments, and its applicable scope is various. Further, the terms and expressions used in the present specification are intended to appropriately describe the present invention, and is not intended to limit the interpretation of the present invention. In addition, in view of the concept of the invention described in the present specification, it would have been obvious to one skilled in the art to conceive other features, systems, and methods or the like included in the concept of the present invention. Therefore, recitations of the claims must be regarded to be inclusive of equivalent features from deviating from the scope of technical idea of the present invention. Furthermore, an object of Abstract is for patent office and its related general public organizations or engineers or the like belonging to the technical field, which are familiar with patent, legal terms or terminologies to be able to readily determine the technical contents of the present application and its essence in simplified search. Accordingly, the Abstract is not intended to limit the scope of the invention to be evaluated by the recitations of the claims. Moreover, it is desired that object(s) of the present invention and advantageous effect(s) specific to the present invention be construed in full consideration of the already disclosed literature or the like in order to fully understand them.

The foregoing detailed description includes processing executed by computer. The above statements and expressions are set forth for one skilled in the art to understand them most effectively. In the present specification, each of the steps employed to derive a result is to be understood as processing free of self-contradiction. In addition, in each of the steps, an electric or magnetic signal is transmitted and received, recorded, and so on. In the processing in each of the steps, such a signal is expressed by way of bit, value, symbol, character, term, and numeral or the like, it should be kept in mind that these expressions are employed for the sake of clarity. In addition, while the processing in each of the steps may be described in expression common to human act, the processing described in the present specification is executed by means of a variety of devices in principle. Further, other features required to perform each of the steps would have been self-evident from the foregoing description.

INDUSTRIAL APPLICABILITY

A game playing information integration system which outputs the operation state of game units installed in a gaming facility, the proportions of visitors by type, and the trends of the greatest common preferences of visitors seen from the proportion and other information so that such information can be grasped in real time, and provides useful information for appropriately managing the operation and management of the gaming facility while achieving greater harmony of players and the gaming facility (shop) can be provided.

EXPLANATION OF REFERENCE NUMERALS

IS Game playing information integration system
1000 Gaming machine unit
1001 Gaming machine (Gaming machine unit)
1001', 1001" Gaming machine main body
1100, 1200 Gaming machine unit
2050 IC card servers
2060 Hall conservers
2070 Member management servers
3001, 3101, 3201 Player tracking device (Data communication terminal device)

The invention claimed is:

1. A game playing information integration system comprising:

a plurality of gaming machine units; and a server connected to enable communication with each of the gaming machine units, wherein the gaming machine unit comprises a bill identifier configured to determine whether a bill is valid and to receive the bill into the gaming machine when the bill is valid and a game initiation or completion data output device which outputs a game initiation or completion data for cumulatively monitoring the number of times of game executed by the server for each game by the execution of the game, the server includes:

a data storage device which stores the game initiation or completion data outputted by the game initiation or completion data output device and reception time data indicating a reception time of the game initiation or completion data in association with each other, and stores, in advance, map layout indication image data of a gaming facility, location information of said each gaming machine unit indicated in the map layout indication image data, and when the game initiation or completion data is received from the gaming machine unit, and lookup data with identification information for each gaming machine unit included in the game initiation or completion data;

an analysis processing device for performing analysis of data received from the gaming machine unit and then stored in the data storage device; and an output device which produces image data depending on the results analyzed by this analysis device and outputs the image data to an external portion, the analysis processing device produces a cumulative value of game initiation or completion data for each gaming machine unit based on the game initiation or completion data and the reception time data stored in the data storage device, and the output device executes a processing of outputting an image of the location information of each gaming machine unit in the outputted map layout indication image as an image data changed depending on the cumulative value.

2. The game playing information integration system according to claim 1, wherein the analysis device grasps the number of all players from player identification information transmitted from each gaming machine unit, produces an average rate of game execution of players by time unit, and produces a rate of operation of all game units by time unit, and the output device produces graph image data from the rate of game execution and operability and outputs the graph image data to an external portion.

3. A data communication terminal device for use in the game playing information integration system according to claim 1, wherein:

the data communication terminal device is the device constituting the gaming machine unit along with a gaming machine main body, and the device separate from the gaming machine main body and the server, the data communication terminal device including:

a device adapted to enable wired or wireless communication with the gaming machine main body in response to an instruction or operation for connecting the data communication terminal device to the gaming machine main body;

a device adapted to receive data from the gaming machine main body in a state where the communication with the gaming machine main body becomes available;

a device adapted to enable wired or wireless communication with the server in response to an instruction or operation for connecting the data communication terminal device to the server; and a device adapted to transmit data to the server in a state where the communication with the server becomes available.

4. The data communication terminal device according to claim 3, wherein the analysis device grasps the number of all players from player identification information transmitted from each gaming machine unit, produces an average rate of game execution of players by time unit, and produces a rate of operation of all game units by time unit, and the output device produces graph image data from the rate of game execution and operability and outputs the graph image data to an external portion.

5. A game playing information integration system comprising:

a plurality of gaming machine units; and a server connected to enable communication with each of the gaming machine units, wherein the gaming machine unit comprises:

a bill identifier configured to determine whether a bill is valid and to receive the bill into the gaming machine when the bill is valid;

a player identification information reading device which is capable of reading player identification information, and, outputs the read player identification information; and a game execution data output device which outputs to the server predetermined data by the execution of game, gaming machine unit identification information is individually assigned to each of the gaming machine units, the server comprises:

a data storage device which stores the player identification information, the predetermined data outputted by the game execution data output device, and reception time data indicating reception time of the predetermined data in association with each other;

an analysis processing device for performing analysis of data received from the gaming machine unit and then stored in the data storage device; and an output device produces image data depending on the results analyzed by this analysis device and outputs the image data to an external portion, the analysis processing device executes, based on data stored in the data storage device, a processing which produces data relating to at least (x) to (y), (x) a cumulative value of the predetermined data of each player at the gaming machine unit, (y) a cumulative value of cumulative number of visitors by the type of players classified into player identification information of each player at the gaming machine unit, and further the output device executes:

by the analysis device, based on the two cumulative values produced by the processings (x) and (y), a processing of editing a map layout indication image showing a state that the gaming machine units are disposed in a gaming facility to change based on a cumulative value of the predetermined data, outputting the edited map layout information to indicate, and a processing of generating and outputting a graph image based on the cumulative value of the number of visitors by the type of players classified in the player identification information in advance.

6. The game playing information integration system according to claim 5, wherein a processing of producing and outputting a graph image based on the cumulative value obtained in the (x) by the analysis device is executed.

7. A data communication terminal device for use in the game playing information integration system according to claim 5, wherein:

the data communication terminal device is the device constituting the gaming machine unit along with a gaming machine main body, and the device separate from the gaming machine main body and the server, the data communication terminal device including:

a device adapted to enable wired or wireless communication with the gaming machine main body in response to an instruction or operation for connecting the data communication terminal device to the gaming machine main body;

a device adapted to receive data from the gaming machine main body in a state where the communication with the gaming machine main body becomes available;

a device adapted to enable wired or wireless communication with the server in response to an instruction or operation for connecting the data communication terminal device to the server; and a device adapted to transmit data to the server in a state where the communication with the server becomes available.

8. The data communication terminal device according to claim 7, wherein a processing of producing and outputting a graph image based on the cumulative value obtained in the (x) by the analysis device is executed.

* * * * *